US011905706B2

(12) United States Patent
Harber et al.

(10) Patent No.: US 11,905,706 B2
(45) **Date of Patent: *Feb. 20, 2024**

(54) RIGID PANEL CONTAINMENT SYSTEM AND RELATED METHODS

(71) Applicant: Abatement Technologies, Inc., Suwanee, GA (US)

(72) Inventors: Blair Lawrence Harber, St. Davids (CA); Adam Brian Hunninck, Stevensville (CA)

(73) Assignee: ABATEMENT TECHNOLOGIES, INC., Suwanee, GA (US)

( * ) Notice: Subject to any disclaimer, the term of this patent is extended or adjusted under 35 U.S.C. 154(b) by 484 days.

This patent is subject to a terminal disclaimer.

(21) Appl. No.: 16/990,351

(22) Filed: Aug. 11, 2020

(65) Prior Publication Data

US 2020/0370296 A1 Nov. 26, 2020

Related U.S. Application Data

(63) Continuation of application No. 16/407,111, filed on May 8, 2019, now Pat. No. 10,774,527, which is a (Continued)

(51) Int. Cl.
*E04B 2/78* (2006.01)
*E04B 2/74* (2006.01)
(Continued)

(52) U.S. Cl.
CPC ..... *E04B 2/7854* (2013.01); *E04B 2/721* (2013.01); *E04B 2/7448* (2013.01);
(Continued)

(58) Field of Classification Search
CPC ..... E04B 2/7854; E04B 2/7448; E04B 2/766; E04B 2002/7498; E04B 2002/7487;
(Continued)

(56) References Cited

U.S. PATENT DOCUMENTS 3,685,223 A 8/1972 Sherwood
4,127,196 A 11/1978 Boucher
(Continued)

FOREIGN PATENT DOCUMENTS

FR 2891288 A1 * 3/2007 ..... E04B 2/7457
FR 2993586 A1 * 1/2014 ..... E04B 2/7448
(Continued)

OTHER PUBLICATIONS

U.S. Appl. No. 15/909,278, "Non-Final Office Action", dated Jan. 23, 2019, 9 pages.
(Continued)

*Primary Examiner* — Michael Safavi
(74) *Attorney, Agent, or Firm* — Kilpatrick Townsend & Stockton LLP

(57) ABSTRACT

A containment system may include four different widths of panel assemblies, at least four different types of corner assemblies, various types of door assemblies, multiple types of three-way corners or 'T' intersections, multiple types of exhaust panel assemblies, multiple types of wall seal assemblies, and other components that form a modular system capable of adapting to various configurations using a minimal number of fasteners, brackets, and/or clamps. Each panel assembly includes a lower assembly, an upper assembly slideably attached to the lower assembly, at least one adjustment mechanism that interfaces with both the lower assembly and the upper assembly, and a sealing member extending between the upper assembly and the lower assembly.

17 Claims, 52 Drawing Sheets

Related U.S. Application Data continuation of application No. 15/909,278, filed on Mar. 1, 2018, now Pat. No. 10,329,760.

(60) Provisional application No. 62/465,402, filed on Mar. 1, 2017.

(51) Int. Cl.

| | |
|---|---|
| ***E04B 2/72*** | (2006.01) |
| ***E04B 2/76*** | (2006.01) |
| ***E04B 2/82*** | (2006.01) |
| ***E04C 2/38*** | (2006.01) |

(52) U.S. Cl.

CPC ..... *E04B 2/7459* (2013.01); *E04B 2/763* (2013.01); *E04B 2/7818* (2013.01); *E04B 2/827* (2013.01); *E04C 2/38* (2013.01); *E04B 2/761* (2013.01); *E04B 2/766* (2013.01); *E04B 2002/7487* (2013.01); *E04B 2002/7498* (2013.01)

(58) Field of Classification Search

CPC ..... E04B 2/7459; E04B 2/78; E04B 2/7809; E04B 2/7818; E04B 2/7827; E04B 2/7836; E04B 2002/725; E04B 2/789; E04B 2/7872; E04B 2/721; E04B 2/763; E04B 2/761; E04B 2/38

See application file for complete search history.

(56) References Cited

U.S. PATENT DOCUMENTS

| | | | | |
|---|---|---|---|---|
| 4,277,920 | A | 7/1981 | Dixon | |
| 4,731,961 | A * | 3/1988 | Bona | E04H 1/1277 52/63 |
| 5,054,255 | A | 10/1991 | Maninfior | |
| 5,735,100 | A * | 4/1998 | Campbell | E04B 5/14 52/745.11 |
| 5,992,109 | A * | 11/1999 | Jonker | E04B 2/821 52/586.1 |
| 6,119,430 | A * | 9/2000 | Nicholls | E02D 29/02 52/118 |
| 8,839,592 | B2 | 9/2014 | Foran | |
| 10,041,249 | B1 | 8/2018 | Hebert et al. | |
| 10,329,759 | B2 | 6/2019 | Feldpausch et al. | |
| 10,329,760 | B2 | 6/2019 | Harber et al. | |
| 2006/0179788 | A1 * | 8/2006 | Nicoletti | E04B 2/7455 52/741.15 |
| 2010/0064619 | A1 | 3/2010 | Huang | |
| 2011/0078960 | A1 | 4/2011 | Luttmann | |
| 2014/0033642 | A1 * | 2/2014 | Foran | E04G 21/30 52/782.1 |
| 2014/0075869 | A1 | 3/2014 | Hager et al. | |
| 2018/0274231 | A1 | 9/2018 | Epstein et al. | |

FOREIGN PATENT DOCUMENTS

| | | | | |
|---|---|---|---|---|
| KR | 20090114045 | A * | 11/2009 | E02B 2/74 |
| WO | WO-2009116466 | A1 * | 9/2009 | E04B 2/7448 |
| WO | WO-2019171280 | A1 * | 9/2019 | E04B 2/72 |

OTHER PUBLICATIONS

U.S. Appl. No. 15/909,278, "Notice of Allowance", dated Apr. 1, 2019, 5 pages.

U.S. Appl. No. 16/407,111, "Non-Final Office Action", dated Jun. 9, 2020, 6 pages.

U.S. Appl. No. 16/407,111, "Notice of Allowance", dated Jul. 23, 2020, 5 pages.

* cited by examiner

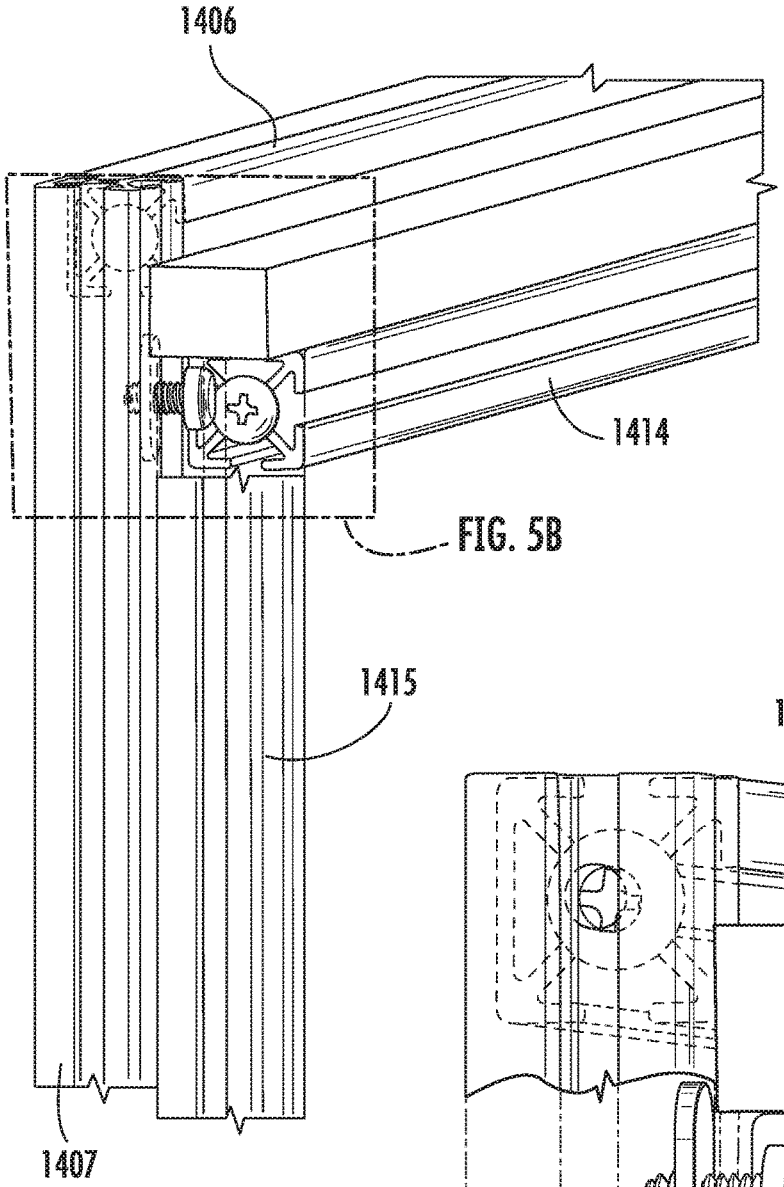
FIG. 5B
FIG. 5A
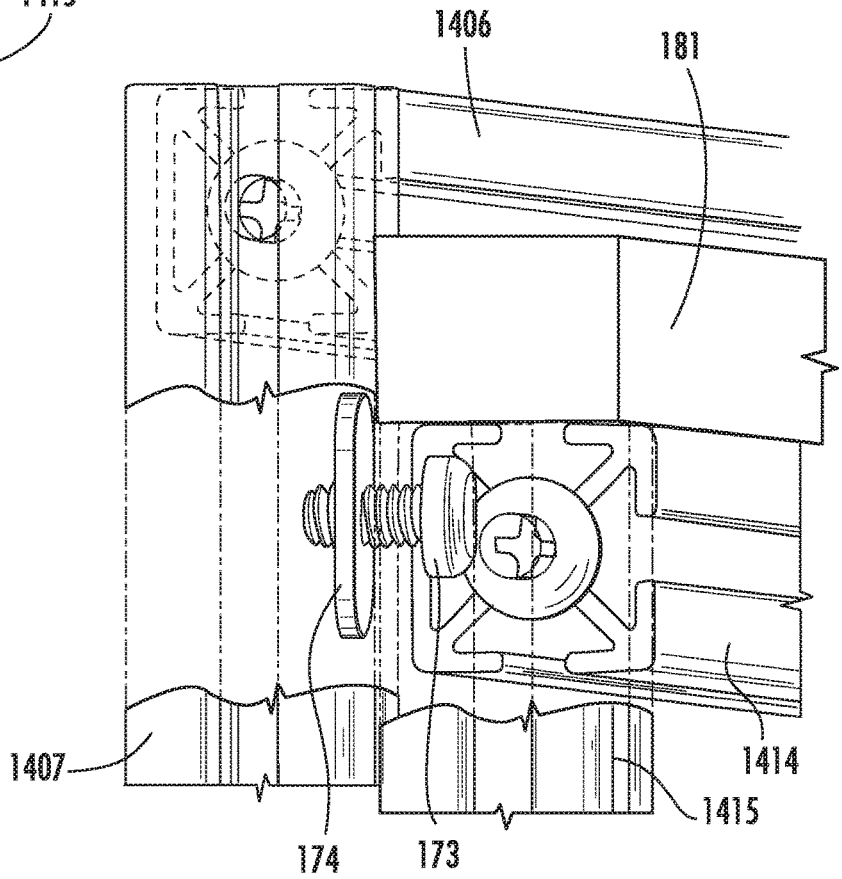
FIG. 5B

RIGID PANEL CONTAINMENT SYSTEM AND RELATED METHODS

CROSS REFERENCE TO RELATED APPLICATIONS

This application is a continuation of U.S. patent application Ser. No. 16/407,111 ("the '111 application"), filed May 8, 2019, currently pending, which is a continuation of U.S. patent application Ser. No. 15/909,278 ("the '278 application"), filed on Mar. 1, 2018, which is related to and claims the benefit of U.S. Provisional Application No. 62/465,402 ("the '402 application"), filed on Mar. 1, 2017, entitled RIGID PANEL CONTAINMENT SYSTEM. The '111, '278 and '402 applications are each hereby incorporated in their entirety by this reference.

FIELD OF THE INVENTION

This invention relates to devices and methods for facilitating maintenance and service operations while providing air filtration to contain and capture hazardous and/or non-hazardous particulate, biological, and gas phase contaminants released into the air as a result of these activities.

BACKGROUND

Similar to virtually any building, healthcare facilities, such as hospitals, require construction, renovations, and maintenance including tasks necessitating access to areas that cannot be regularly cleaned, such as within walls, below floors, or above a ceiling. However, unlike many other facilities, healthcare and other facilities include requirements related to cleanliness and minimizing the risk of hospital acquired infections (HAIs) caused by hazardous airborne contaminants. There is a need to protect patients and employees from exposure to construction particles that can potentially transmit airborne infectious diseases.

The design of products, such as containment systems, that limit airflow into or out of specific areas, quarantine sites, and/or facilitate access to potentially contaminated areas in sensitive environments is challenging because there are a large number of demanding requirements and desired features, some of which compete with each other. For instance, in addition to isolating the non-sanitized construction, renovation, or maintenance environment from the sanitary healthcare environment, it is desirable that such products be compact, lightweight, easily transported, easily operated, easily maintained, aesthetically pleasing, simple to clean, simple/compact for storage, and reusable. It is desirable that they be durable and able to function in numerous different environments, as well as economical to purchase and operate.

Containment systems have been implemented in the past, but typically include inherent disadvantages. For example, U.S. Pat. No. 8,839,592 (the '592 patent) describes a containment system having upper and lower panels that slide relative to one another where the upper and lower panels are constructed with frame members and a sheet (such as polycarbonate) spanning between the frame members. The system described in the '592 patent requires at least one of the upper and lower panels have the sheet attached to an outer/external surface of the upper or lower panel frame to facilitate sealing. Arranging the sheet on the outer surface of the frame is disadvantageous for several reasons. For example, the sheet (which is often the most fragile component) is more exposed to potential impacts and abrasion with adjacent objects. The '592 patent also shows other panels with different arrangements for the sheet such that panels with surface-mounted sheets would not be compatible/interchangeable with the panels that do not include surface-mounted sheets. In addition, relying on the very large surface of the panel (where the sheet is mounted) for a seal is inherently unreliable as the seal depends on a perfectly flat surface during movement, adjustment, and operation of the system. In other words, the slightest surface imperfection, bend in a frame member, deflection or offset of the sheet caused by a fastener, or impact during assembly or operation of the system, may create an inconsistent surface (due to deflection, damage, or other changes to the components) that would be inappropriate for sealing.

The '592 patent describes additional inefficient features. For example, the '592 patent shows a single guide block for controlling movement between adjacent frame members during movement of panels relative to one another, which requires that all forces relevant to aligning each pair of frame members. The '592 patent also teaches a sealing arrangement where the panels are pressed against one another along a threaded joint extending perpendicular to the sliding direction of the panels, which would focus forces associated with sealing the interface with deflecting the panel members. In addition, the '592 patent teaches struts with channels on all four sides, which increases the likelihood of users catching or inserting objects into the channels. Furthermore, the '592 patent does not provide any solution for arranging adjacent panels to compensate for floors and ceilings that are non-horizontal and/or non-planar.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

A containment system for separating a containment area from an external environment includes at least one adjustable height panel assembly. The at least one adjustable height panel assembly includes a lower assembly, an upper assembly slideably attached to the lower assembly, a locked configuration wherein the upper assembly and the lower assembly constrained from movement relative to one another at least in a vertical direction, an unlocked configuration wherein the upper assembly and the lower assembly can move relative to one another at least in the vertical direction, at least one adjustment mechanism that interfaces with both the lower assembly and the upper assembly, wherein the at least one adjustment mechanism changes the at least one adjustable height panel assembly between the locked configuration and the unlocked configuration, and a sealing member extending between the upper assembly and the lower assembly, wherein the sealing member maintains a seal between the containment area and the external environment in both the unlocked configuration and in the locked configuration.

A containment system for separating a containment area from an external environment includes at least one adjustable height panel assembly. The at least one adjustable height panel assembly includes a lower assembly, an upper assembly slideably attached to the lower assembly, a locked configuration wherein the upper assembly and the lower assembly constrained from movement relative to one another at least in a vertical direction, an unlocked configuration wherein the upper assembly and the lower assembly can move relative to one another at least in the vertical direction, at least one adjustment mechanism that interfaces with both the lower assembly and the upper assembly, wherein the at least one adjustment mechanism changes the at least one adjustable height panel assembly between the locked configuration and the unlocked configuration, and at least four guides for aligning the upper assembly and the lower assembly.

BRIEF DESCRIPTION OF THE DRAWINGS

Illustrative embodiments of the present invention are described in detail below with reference to the following drawing figures.

FIGS. 5A and 5B are partial perspective views of the upper guides for aligning vertical members of the containment system depicted in FIG. 1.

FIG. 1B is an interior side perspective view of the door assembly of FIG. 11A.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1-26B illustrate examples of a maintenance, renovation, or construction containment system 100 that facilitates isolation of a containment area adjacent to the containment system 100 from the external environment. In some cases, the containment system 100 creates a barrier between a containment area and an external environment of the containment system 100. The containment area may include a workspace or an enclosed area (i.e., an area where contaminants should be contained). Many of the sub-assemblies of the containment system 100 are designed to be height-adjustable within a range, so that the containment system 100 can extend from a floor to a ceiling. As described in more detail below, the containment system 100 can be infinitely adjusted to define an area of adjustable size and/or shape to limit access to and provide a seal between the defined area (also referred to as the containment area) and the external environment. The containment system 100 is designed modularly so that the necessary modules can be attached to one another to create the desired containment area. Each module or component (i.e., panel assembly, corner assembly, door assembly, etc.) is designed with an interior side (configured to be in the containment area) and an exterior side opposite of the interior side facing the external environment. Many of the sub-assemblies of the containment system 100 are designed such that adjustment mechanisms (e.g., L-bracket 151 and knob 156) are located on the interior side of the assembly so the exterior side of the sub-assembly can be designed with smooth surfaces and a minimum of exposed edges or protrusions and such that tampering from the exterior of the containment system 100 can be avoided. The containment system 100 may include as many as four different widths of panel assemblies, at least four different types of corner assemblies, various types of door assemblies, multiple types of three-way corners or 'T' intersections, multiple types of exhaust panel assemblies, multiple types of wall seal assemblies, and other components that form a modular system capable of adapting to various configurations using a minimal number of fasteners, brackets, and/or clamps.

Figure 1:
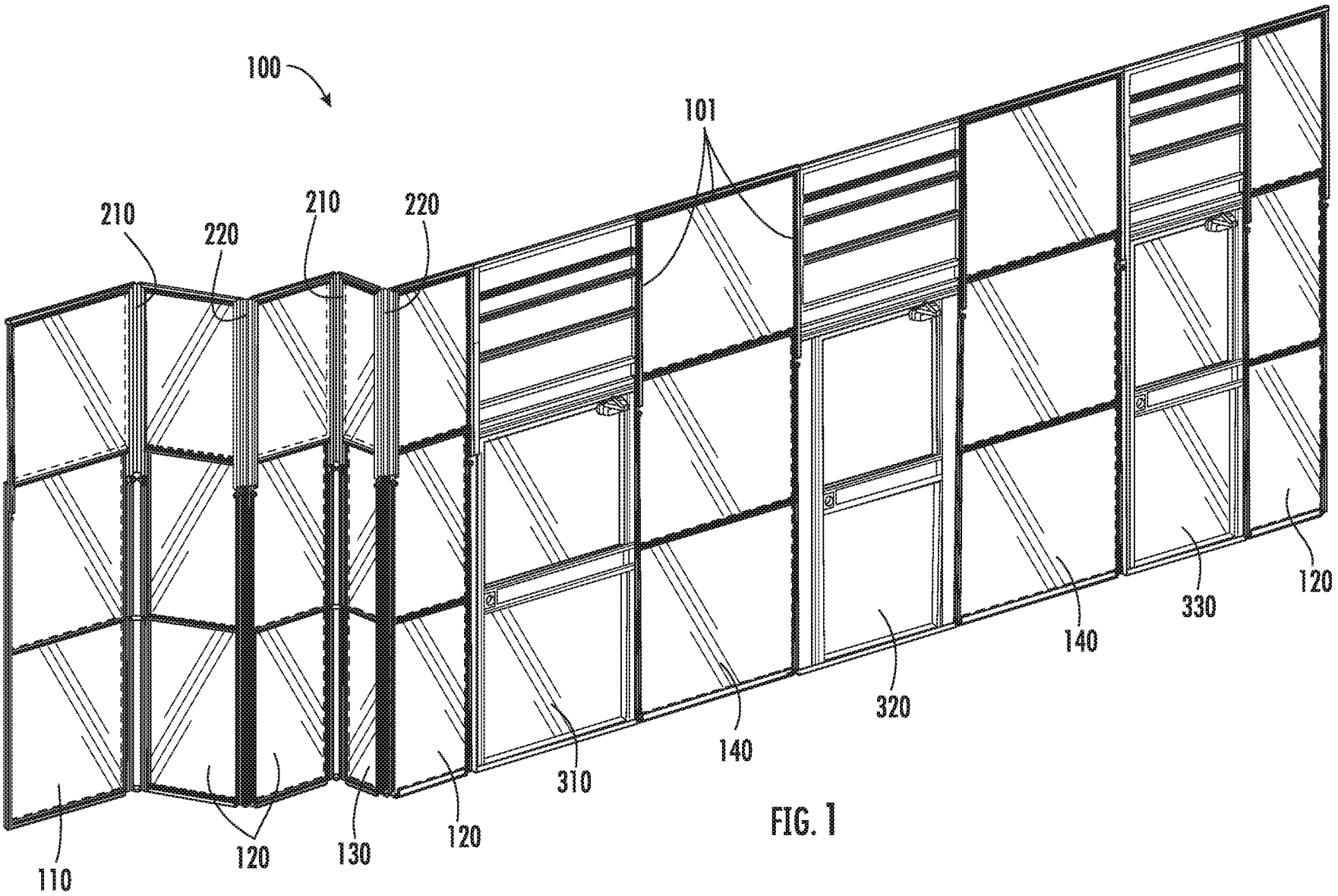
FIG. 1 is a perspective view of a maintenance/construction containment system according to one example of this invention.

As illustrated in FIG. 1, the maintenance/construction containment system 100 may include various subcomponents and subassemblies. Many of the subcomponents or subassemblies may be height-adjustable to adapt to various ceiling configurations/heights. In some embodiments, the containment system 100 is capable of creating wall heights (e.g., to match a ceiling) of approximately 7' to approximately 10'-3" (84" to 123"), or any other suitable wall height. As an example of the various subcomponents, the containment system 100 may include one or more panel assemblies (110, 120, 130, 140). The panel assemblies may have different standard widths to ensure the containment system 100 can be configured to create the desired path and shape. For example, the panel assemblies may include a small panel assembly 130, a narrow panel assembly 120, a medium panel assembly 110, and a wide panel assembly 140, although each panel assembly may have any suitable width. The panel assemblies may attach to one another side-by-side to form a continuous wall or, in some cases, other components may be disposed between panel assemblies. For example, the containment system 100 may include one or more corner assemblies (210, 220) and/or one or more door assemblies (310, 320, 330).

Figure 6:
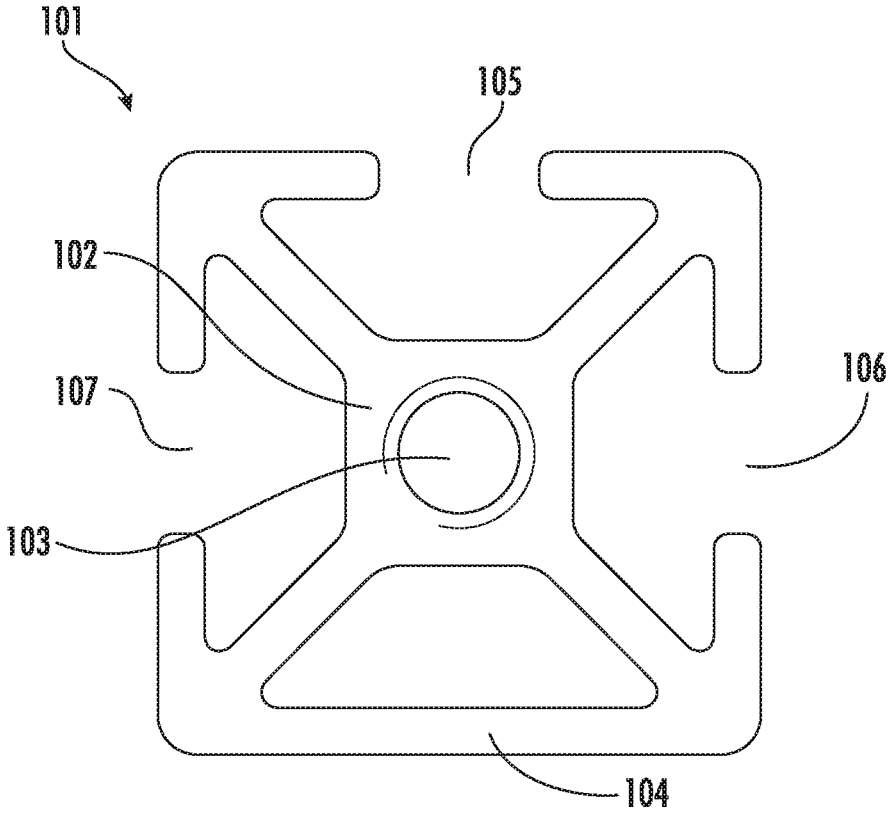
FIG. 6 is an end view of a strut of the containment system depicted in FIG. 1.

The various assemblies and subcomponents of the containment system 100 may be constructed using one or more sections of a strut 101 (see FIGS. 1 and 6). The strut 101 may be metallic, thermoplastic, composite, or any other appropriate material. As shown in FIG. 6, which shows an exemplary cross-section of the strut 101, the strut 101 may include a central hub 102 with a hole 103 where the hole 103 may be present at one or both ends of the strut and, in some cases, may be threaded. In some cases, the outer surface of the strut 101 has a generally square cross-section and may include one side with a continuous surface 104 and three sides with channels including a first channel 105 opposite the continuous surface and second and third channels 106, 107 on faces adjacent the continuous surface 104. In some examples, various subcomponents of the containment system 100, such as lower members, upper members, side members, and/or other components (e.g., see members 1205-1209, 1213-1216, 1405-1409, 1413-1416, 3307-3308, 3315-3316, 2101-2102, 2111-2112, 2201-2202, and 2211-2212 described below and illustrated in FIGS. 2-5, 8-13 and 15), are constructed using struts 101 such that each such member includes a central hub 102, one or more holes 103, and multiple channels extending along its respective length. In addition, although not illustrated, each member may include a compressible member inserted into at least one of the channels along the length of the member. For example, a strip of foam may be inserted into at least one of the channels. In some cases, the compressible member may be large enough to occupy most of the channel and protrude through the opening of the channel. In some examples, a portion of another component, such as a window member (e.g., 1402, 1403, 1412, 1202, 1203, 1212, which are described below) may be inserted into a channel with a compressible member such that the compressible member compresses and/or deforms around the component within the channel. The compressible member thus creates a tight secure fit of the component within the channel and reduces movement, rattling, vibration, abrasion, etc. of the component around its perimeter.

Figure 2A:
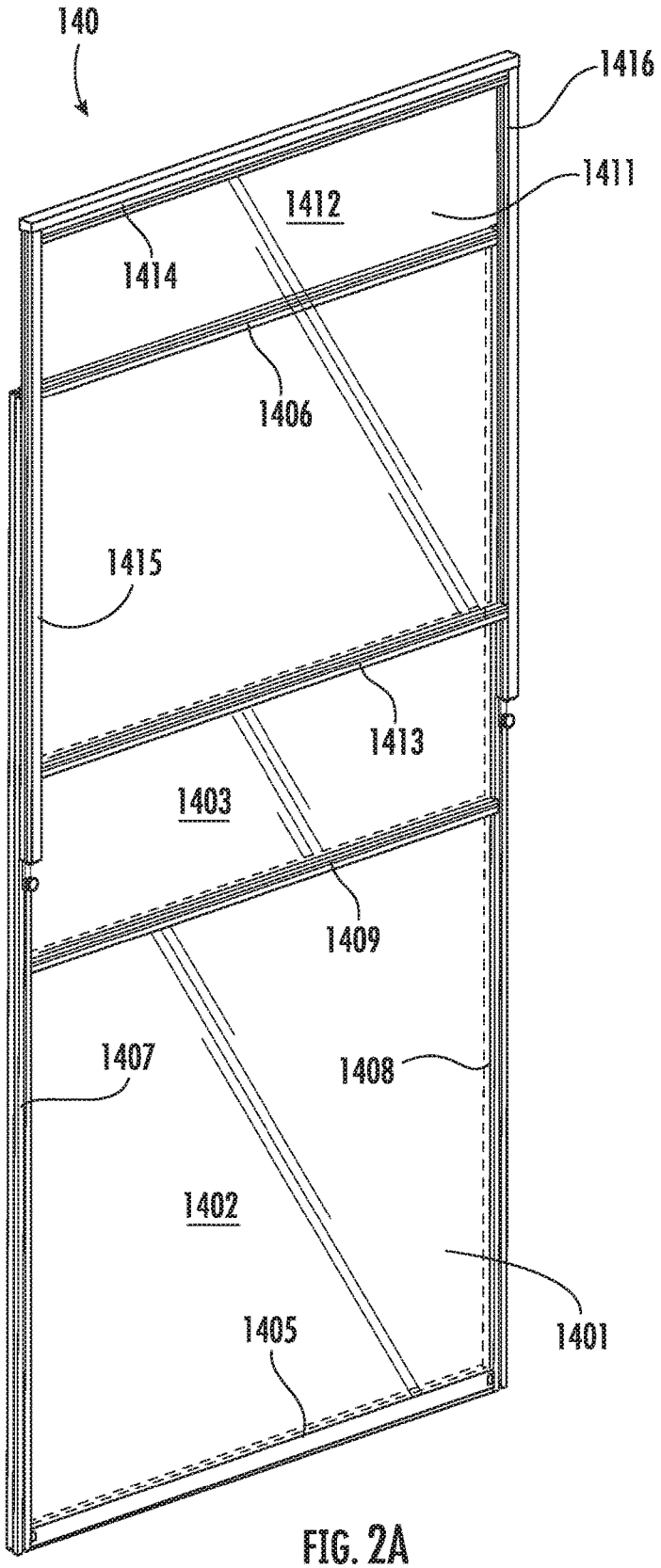
FIGS. 2A and 2B are interior perspective views of a wide panel assembly and a narrow panel assembly, respectively, of the containment system depicted in FIG. 1.
Figure 2B:
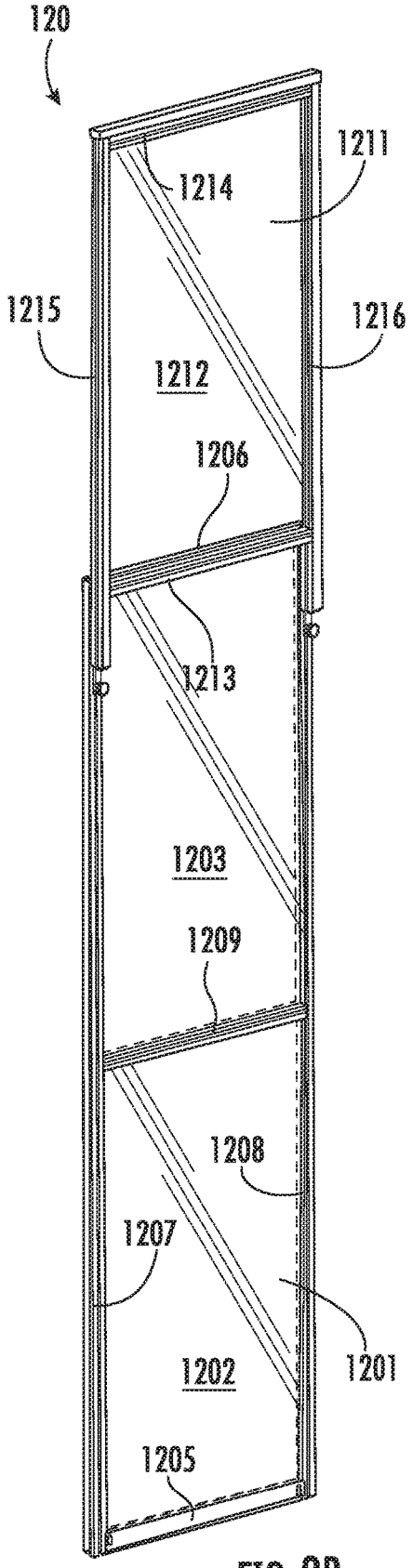

The various panel assemblies (110, 120, 130, 140) are structured similarly except for the variations in width. Each panel assembly includes a lower assembly and an upper assembly that is approximately half the size of the lower assembly such that the upper and lower assemblies are attached to one another and, in some cases, can slide relative to one another. FIGS. 2A and 2B show examples of the wide panel assembly 140 and the narrow panel assembly 120, respectively. In some embodiments, the wide panel assembly 140 is approximately 48" wide, the narrow panel assembly 120 is approximately 24" wide, the small panel assembly 130 is approximately 12" wide, and the medium panel assembly 110 is approximately 36" wide, although the panel assemblies may have any suitable width.

As shown in FIG. 2A, the wide panel assembly 140 includes a lower assembly 1401 and an upper assembly 1411. The lower assembly 1401 may be in the shape of a large rectangle and include a lower edge member 1405, an upper edge member 1406, and vertical side members 1407, 1408 extending between the lower edge member 1405 and the upper edge member 1406 such that the edge members frame one or more window members 1402, 1403, explained in more detail below. The lower assembly 1401 may also include a horizontal cross brace 1409 extending between the two vertical side members 1407 and 1408 where the horizontal cross brace 1409 is approximately halfway between the lower edge member 1405 and the upper edge member 1406. In some examples, the lower assembly 1401 includes a lower window member 1402 below the horizontal cross brace 1409 and an upper window member 1403 above the horizontal cross brace 1409. As mentioned above, lower edge member 1405, upper edge member 1406, vertical side members 1407, 1408 and horizontal cross brace 1409 can be in the form of struts 101, shown in FIG. 6.

The upper assembly 1411 may be in the shape of a rectangle and include a lower edge member 1413, an upper edge member 1414, and vertical side members 1415, 1416 extending from the upper edge member 1414 toward the lower edge member 1413 (in some cases, extending past the lower edge member 1413) such that the edge members frame a window member 1412. In the illustrated example, lower edge member 1413, upper edge member 1414, and vertical side members 1415, 1416 are in the form of struts 101, shown in FIG. 6.

As shown in FIG. 2B, the narrow panel assembly 120 includes a lower assembly 1201 and an upper assembly 1211. The lower assembly 1201 may be in the shape of a large rectangle and include a lower edge member 1205, an upper edge member 1206, and vertical side members 1207, 1208 extending between the lower edge member 1205 and the upper edge member 1206 such that the edge members frame one or more window members 1202, 1203. The lower assembly 1201 may also include a horizontal cross brace 1209 extending between the two vertical side members 1207 and 1208 where the horizontal cross brace 1209 is approximately halfway between the lower edge member 1205 and the upper edge member 1206. In some examples, the lower assembly 1201 includes a lower window member 1202 below the horizontal cross brace 1209 and an upper window member 1203 above the horizontal cross brace 1209. In the illustrated example, lower edge member 1205, upper edge member 1206, vertical side members 1207, 1208 and horizontal cross brace 1209 are in the form of struts 101, shown in FIG. 6.

The upper assembly 1211 may be in the shape of a rectangle and include a lower edge member 1213, an upper edge member 1214, and vertical side members 1215, 1216 extending from the upper edge member 1214 toward the lower edge member 1213 (in some cases, extending past the lower edge member 1213) such that the edge members frame a window member 1212. The window members (1202, 1203, 1212, 1402, 1403, 1412, etc.) may be constructed from materials that are rigid or semi-rigid such as, by way of non-limiting example, polycarbonate, plastic, or composite, and may be transparent, translucent, opaque, or a combination thereof. In the illustrated example, lower edge member 1213, upper edge member 1214 and vertical side members 1215, 1216 are in the form of struts 101, shown in FIG. 6.

Figure 10A:
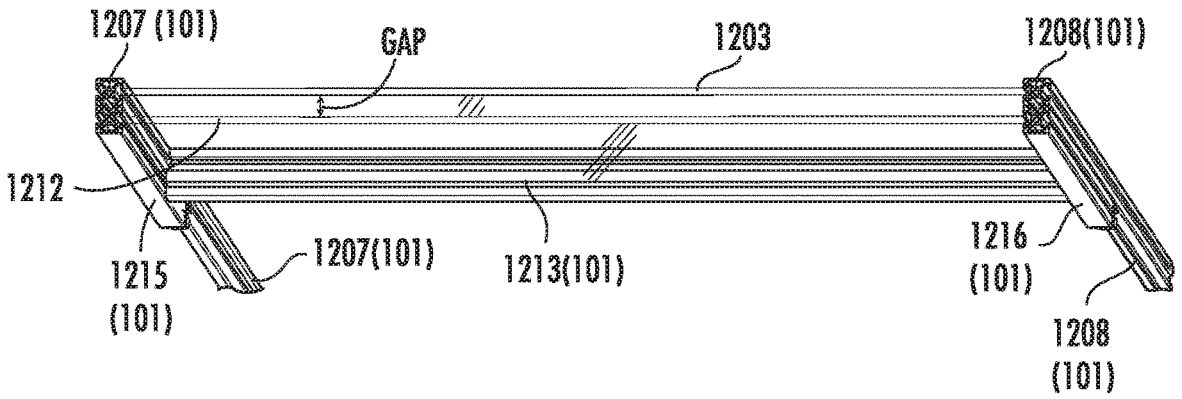
FIG. 10A is a partial perspective view of the sealing member of the panel assembly of FIG. 2B.

As shown in FIG. 10A (which shows a cross section of an area where the upper assembly 1211 and the lower assembly 1201 overlap), the window members 1212, 1203 are inserted into the channels of each of the surrounding members, which are in the form of struts 101. For example, window member 1212 is inserted into the respective channels of lower edge member 1213 (see FIG. 10C), vertical side member 1215, vertical side member 1216, and upper edge member 1214 (not shown in FIG. 10A). As described above, in some embodiments, a compressible member, such as, but not limited to, foam, rubber, or polymer, is inserted into respective channels such that when window member 1212 is inserted into the channels, the compressible member compresses and/or deforms around the window member 1212 within the channel. The compressible member thus creates a tight secure fit of the window member 1212 within the channels and reduces movement, rattling, vibration, abrasion, etc. of the window member 1212 around its perimeter. In some areas, the window member 1212 of the upper assembly 1211 overlaps the window member 1203 of the lower assembly 1201. In other words, light passing through the containment system 100 in these areas would pass through both window member 1203 and window member 1212. In addition, there is a gap between the two window members 1203 and 1212, as shown in FIGS. 10A and 10C.

Figure 3A:
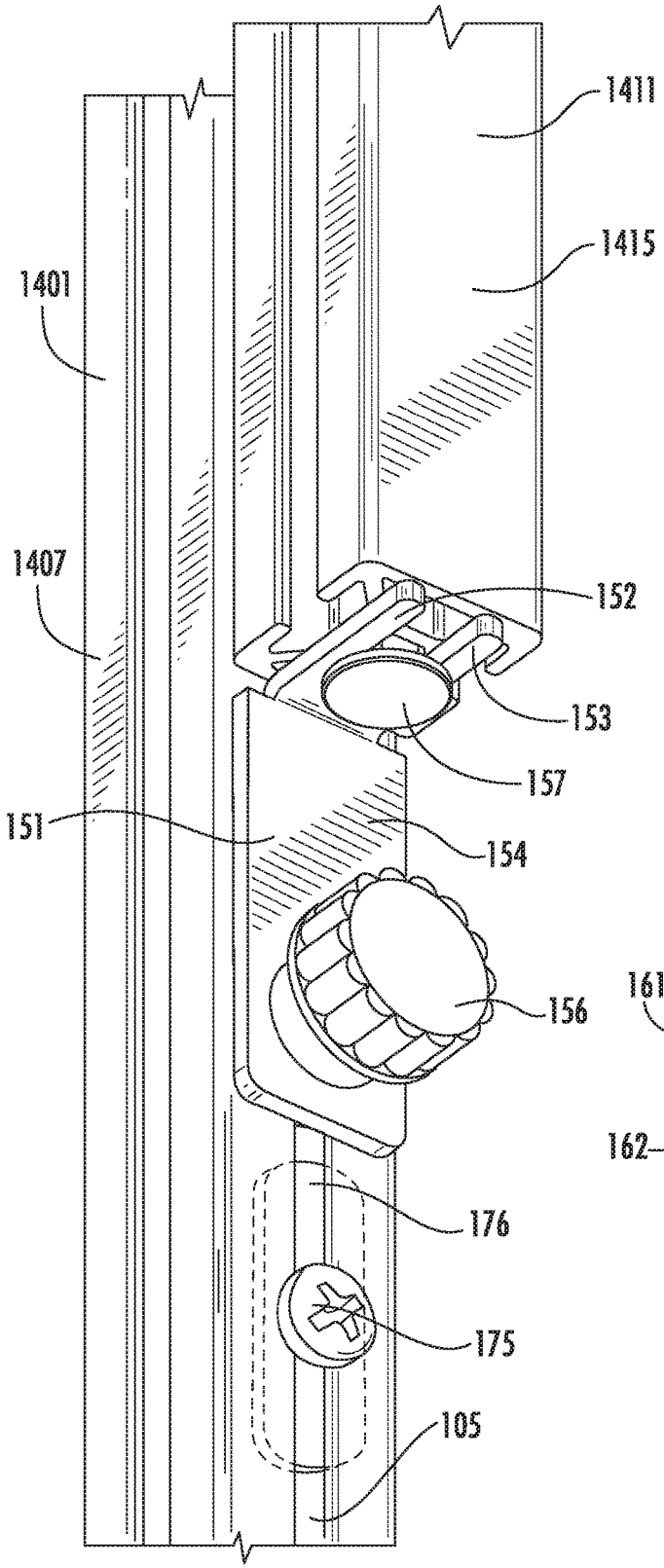
FIG. 3A is a partial perspective view of an L-bracket of the containment system depicted in FIG. 1.

As shown in FIG. 3A, one way to position the upper assembly 1411 relative to the lower assembly 1401 is by using adjustable L-brackets 151 positioned between the vertical members (such as between vertical side member 1408 of lower assembly 1401 and vertical side member 1416 of upper assembly 1411 or between vertical side member 1407 of lower assembly 1401 and vertical side member 1415 of upper assembly 1411, as shown in FIG. 3A).

Figure 7:
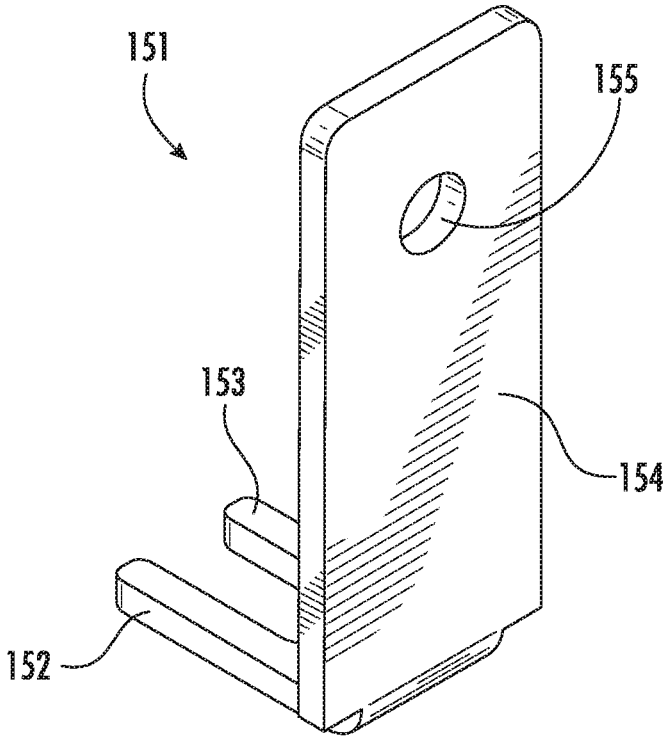
FIG. 7 is a perspective view of the L-bracket depicted in FIG. 3A.

The L-bracket 151 (see FIG. 3A) includes a main body portion 154 that is coupled with channel 105 of the vertical side member 1407 of the lower assembly 1401. A trapped fastener (not illustrated) is arranged with a head disposed in channel 105 and a threaded (or partially threaded) shaft extending through the channel 105 such that the trapped fastener can slide along the length of the channel 105 unless/until an object (such as a nut or knob) threads onto the shaft of the trapped fastener to press the head of the trapped fastener against the inner surface of the channel. A knob 156 is coupled with the threaded shaft of the trapped fastener that passes through hole 155 of the main body portion 154 of the L-bracket 151 (see FIG. 7). As shown in FIGS. 3A and 7, the L-bracket 151 also includes protrusions 152 and 153 that are positioned to abut the end of the vertical side member 1415 of the upper assembly 1411 when the L-bracket 151 is coupled with the upper assembly 1411. The two protrusions 152 and 153 are far enough apart for a shaft of a fastener 157 to pass therebetween before attaching to hole 103 at the end of vertical side member 1415 (in the form of strut 101) of upper assembly 1411.

Figure 4A:
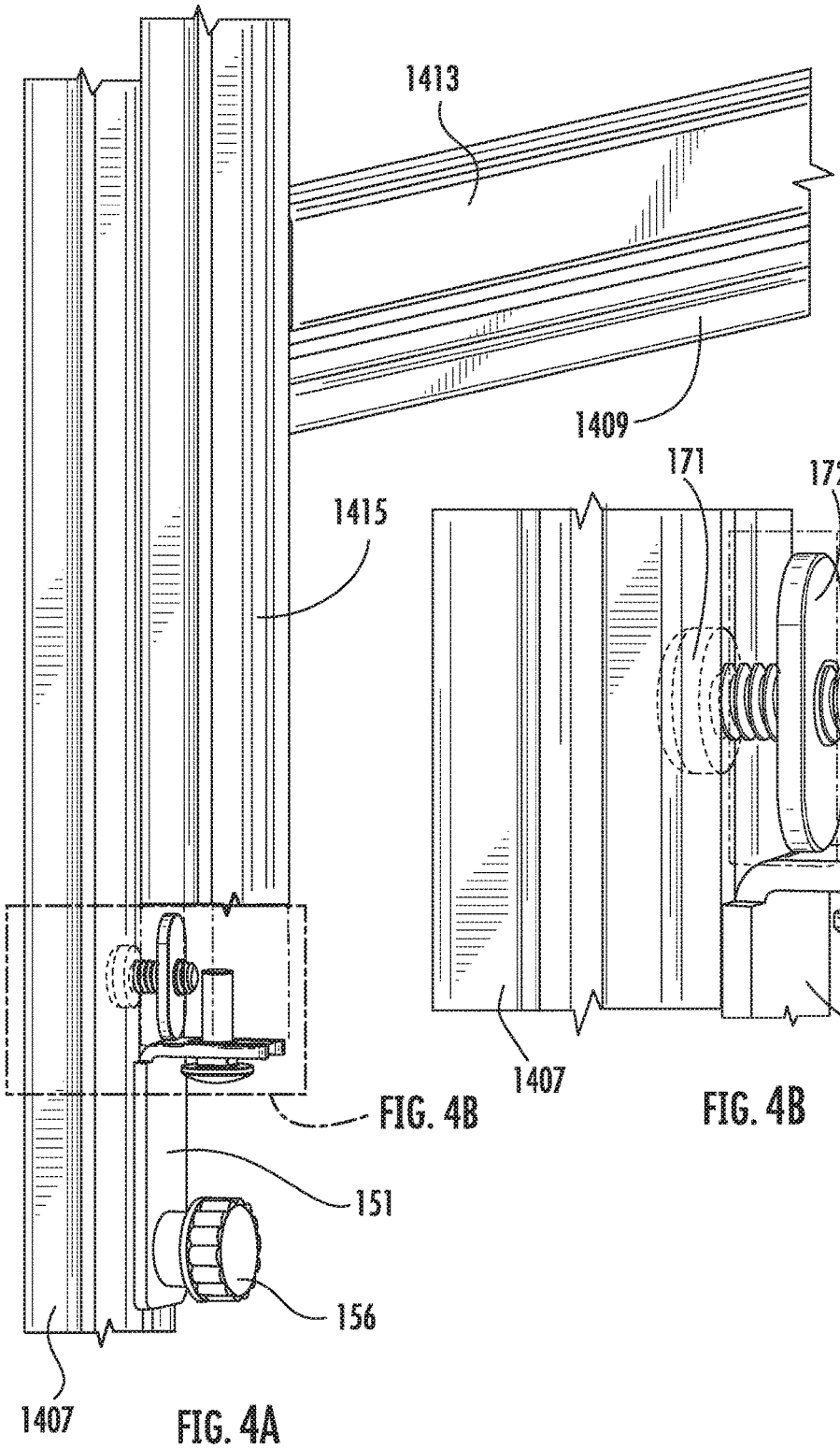
FIGS. 4A and 4B are partial perspective views of the lower guides for aligning vertical members of the containment system depicted in FIG. 1.
Figure 4B:
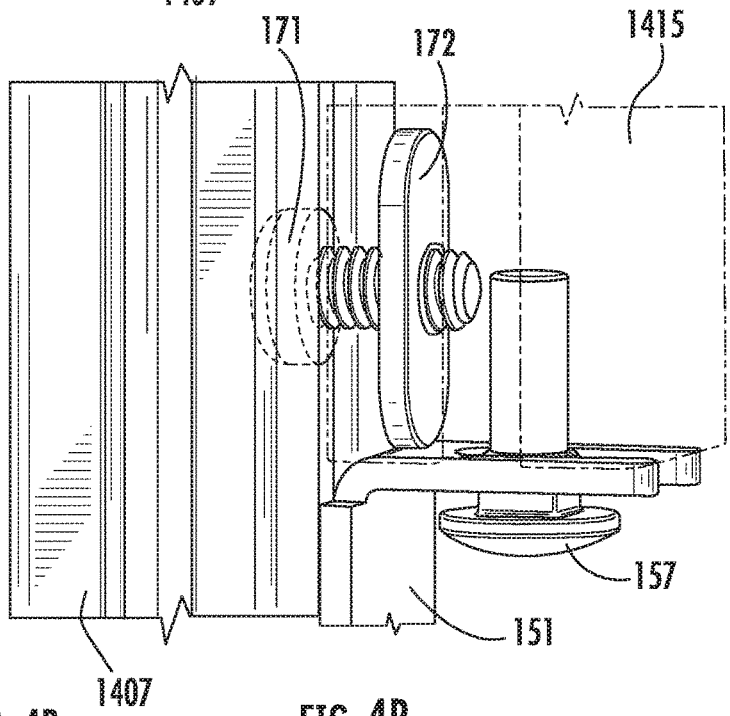

To define a locked configuration, the knob 156 is tightened to secure the L-bracket 151 relative to the adjacent member (e.g., vertical side member 1407, as shown in FIG. 4A). To define an unlocked configuration, the knob 156 is loosened to allow the L-bracket 151 to move relative to the adjacent member (e.g., vertical side member 1407, as shown in FIG. 4A). In some embodiments, the L-bracket 151 includes clearances relative to the fastener 157 such that the L-bracket 151 and the adjacent member (e.g., vertical side member 1415) are only constrained relative to one another in the vertical direction. In other words, locking the L-bracket 151 in position (by tightening threading knob 156) does not impart any force on the vertical side member 1415. When the L-bracket 151 is disengaged (by loosening threading knob 156), the L-bracket 151 moves with vertical side member 1415 relative to vertical side member 1407 (i.e., (a) moving the vertical side member 1415 up relative to the vertical side member 1407 causes the head of fastener 157 to pull the two protrusions 152 and 153 to move the L-bracket 151 with the vertical side member 1415 and (b) moving the vertical side member 1415 down relative to the vertical side member 1407 causes the bottom surface of vertical side member 1415 to push the two protrusions 152 and 153 to move the L-bracket 151 with the vertical side member 1415).

In other embodiments, the L-bracket 151 can function with or without the fastener 157. Without fastener 157, although gravity ensures that the upper assembly 1411 will rest on protrusions 152 and 153 in most conditions, when the upper assembly 1411 moves upward relative to the lower assembly 1401, a user must move the L-bracket 151 independently. Threading knob 156 onto the shaft of the trapped fastener extending from vertical side member 1407 of the lower assembly 1401 presses the L-bracket 151 against vertical side member 1407 to lock the L-bracket 151 into position relative to vertical side member 1407 of the lower assembly 1401. The arrangement of the protrusions 152 and 153 relative to the upper assembly 1411 ensures that threading knob 156 onto the shaft of the trapped fastener secured to vertical side member 1407 (even if tightening the L-bracket 151 against vertical side member 1407) will not move vertical side member 1415 of the upper assembly 1411 relative to vertical side member 1407 of the lower assembly 1401. In other words, tightening knob 156 defines a vertical location of L-bracket 151 (and consequently vertical side member 1415) but does not move vertical side member 1415 toward vertical side member 1407. The panel assemblies (e.g., 110, 120, 130, 140) are arranged such that at a maximum height, the knob 156 is accessible at reasonable height from the ground. In some embodiments, the knob 156, at a maximum height of the panel assembly, is located 6'-3" (75") from the ground, although other heights are possible.

Figure 3B:
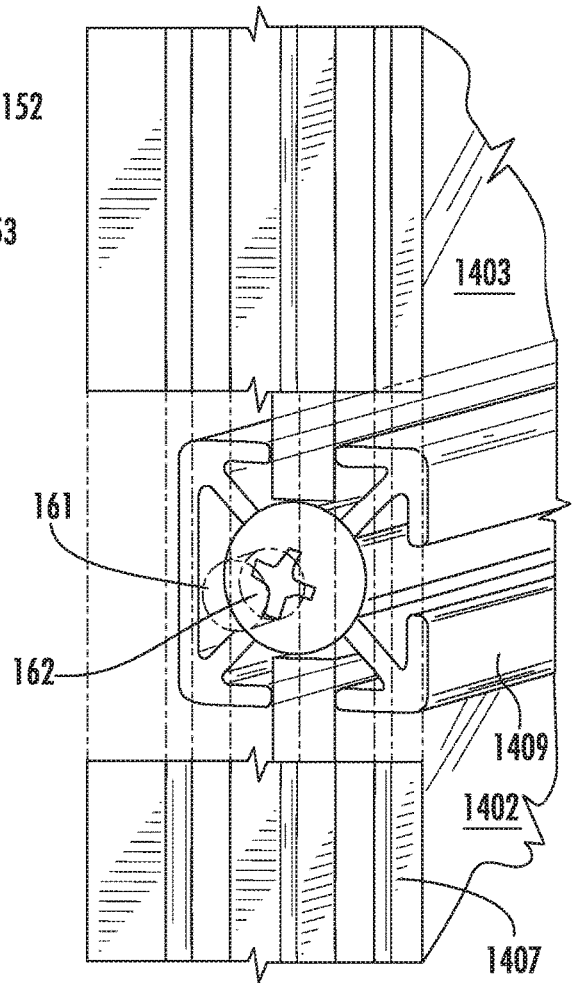
FIG. 3B is a partial perspective view of an intersection of two members of the containment system depicted in FIG. 1.
Figure 9:
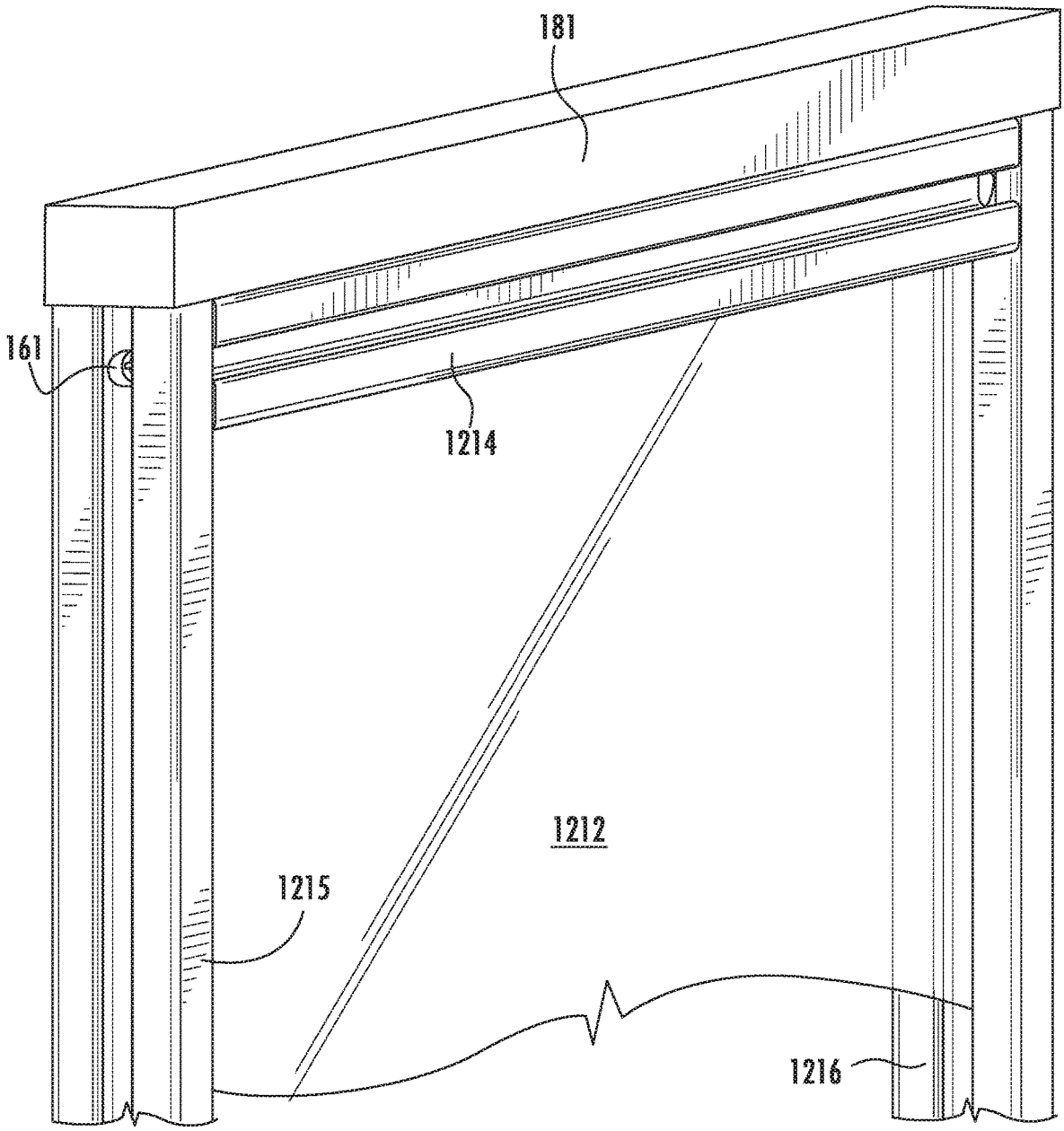
FIG. 9 is a cross-sectioned partial perspective view of the panel assembly of FIG. 2B.

FIG. 3B shows one example for attaching perpendicular members to one another. In this example, vertical side member 1407 and horizontal cross brace 1409 (both of the lower assembly 1401) are the two perpendicular members. In FIG. 3B, vertical side member 1407 is shown transparent. A fastener 162 is threaded into hole 103 of the horizontal cross brace 1409 and the head of the fastener 162 is inserted into a channel of the vertical side member 1407. At the appropriate location, a clearance hole 161 is drilled through the central hub 102 of the strut 101 such that a tool (i.e., a screwdriver, Allen wrench, or other appropriate tool) can pass through the clearance hole 161 and interface with the fastener 162. Another example using a clearance hole 161 is shown in FIG. 9. In some embodiments, all horizontal members (e.g., lower edge member 1405, upper edge member 1406, horizontal cross brace 1409, lower edge member 1413, upper edge member 1414, lower edge member 1205, upper edge member 1206, horizontal cross brace 1209, lower edge member 1213, upper edge member 1214, etc.) are attached to adjacent vertical members in this manner.

Guides for aligning and constraining movement of the vertical side members of adjacent panels are shown in FIGS. 4A-5B. In some examples, each guide includes a fastener (e.g., 171, 173) and a nut (e.g., 172, 174). These drawings show, as an example, the interface between vertical side member 1407 (of the lower assembly 1401) and vertical side member 1415 (of the upper assembly 1411). The interface includes at least two guides that remain as far apart from one another as possible. As shown in FIGS. 4A and 4B, a lower guide is located near a bottom of the vertical side member 1415 where a nut 172 is located in a channel of the vertical side member 1415 facing the vertical side member 1407. A corresponding fastener 171 is threaded into the nut 172 where the head of the fastener 171 is located in a channel of the vertical side member 1407. The lower guide remains secured to the vertical side member 1415 where the nut 172 engages the channel such that the head of the fastener 171 slides through the channel of the vertical side member 1407 when the vertical side members 1407, 1415 move relative to one another. As shown in FIGS. 5A and 5B, an upper guide is located near a top of the vertical side member 1415 (of the upper assembly 1411) where a nut 174 is located in a channel of the vertical side member 1407 (of the lower assembly 1401) facing the vertical side member 1415. A corresponding fastener 173 is threaded into the nut 174 where the head of the fastener 173 is located in a channel of the vertical side member 1415. The upper guide remains secured to the vertical side member 1407 where the nut 174 engages the channel such that the head of the fastener 173 slides through the channel of the vertical side member 1415 when the two members 1407, 1415 move relative to one another. The fasteners 171, 173 may include a portion of the shaft without threads such that the non-threaded portion interfaces with a channel (105, 106, 107) of the appropriate member to reduce scoring or scraping of the channel. In some examples, the fasteners (e.g., 171, 173) are metallic and in other embodiments are non-metallic (e.g., plastic, composite, or other non-metallic materials) to facilitate sliding through the channel of the vertical side members (e.g., due to reduced friction, reduced noise, and other factors).

In some embodiments, as described above, there are two guides for each pair of interfacing members (e.g., 1407, 1415) such that an interface between adjacent moving assemblies (e.g., lower assembly 1401 and upper assembly 1411) includes four guides (i.e., four points of contact). The four guides may be located as far from one another as possible. For example, for an interface between lower assembly 1401 and upper assembly 1411, a first guide is located near the bottom of vertical side member 1415, a second guide is located near the bottom of vertical side member 1416, a third guide is located near the top of vertical side member 1407, and a fourth guide is located near the top of vertical side member 1408.

Figure 8A:
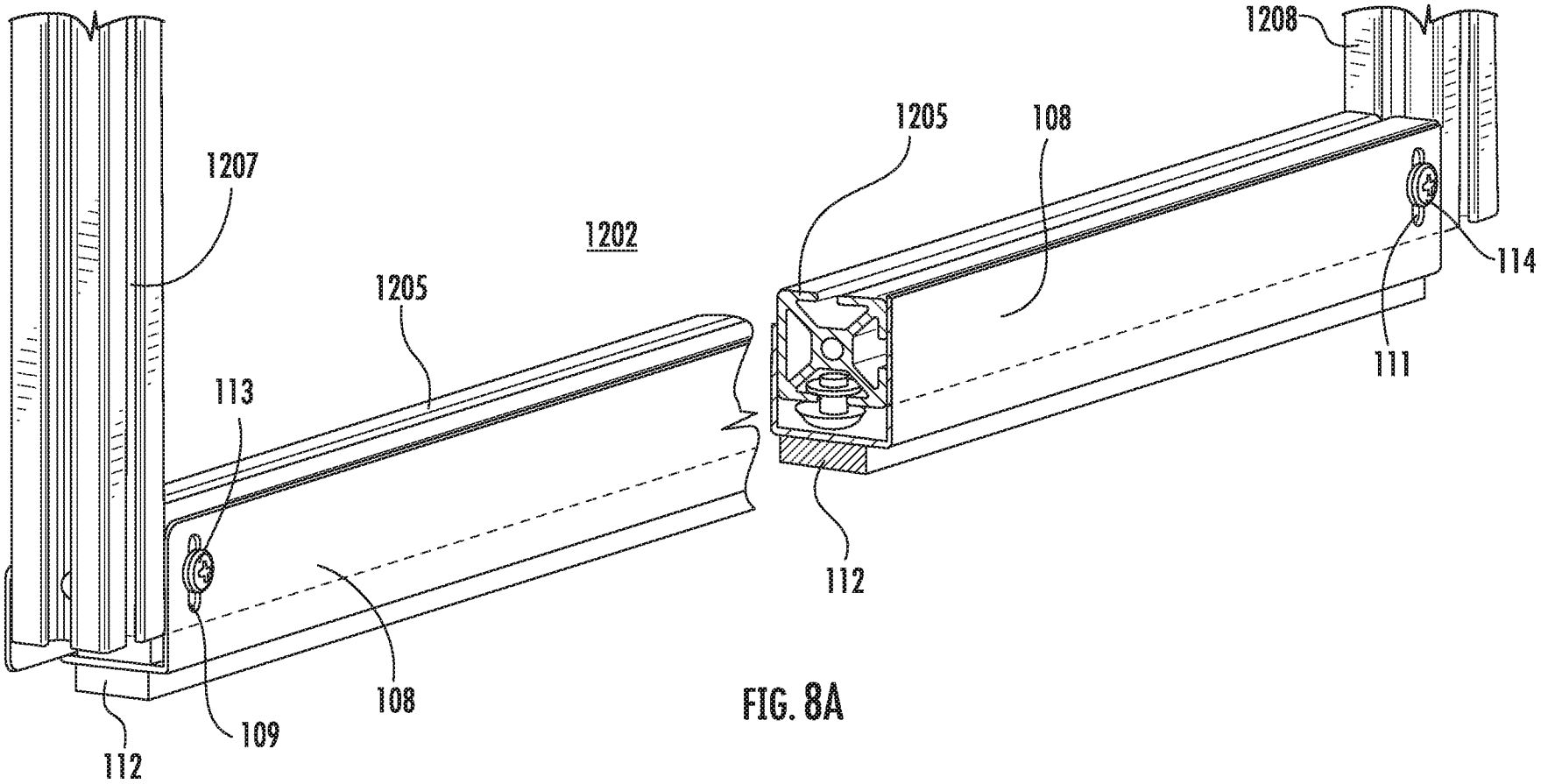
FIG. 8A is a partial perspective view of the panel assembly of FIG. 2B.
Figure 8B:
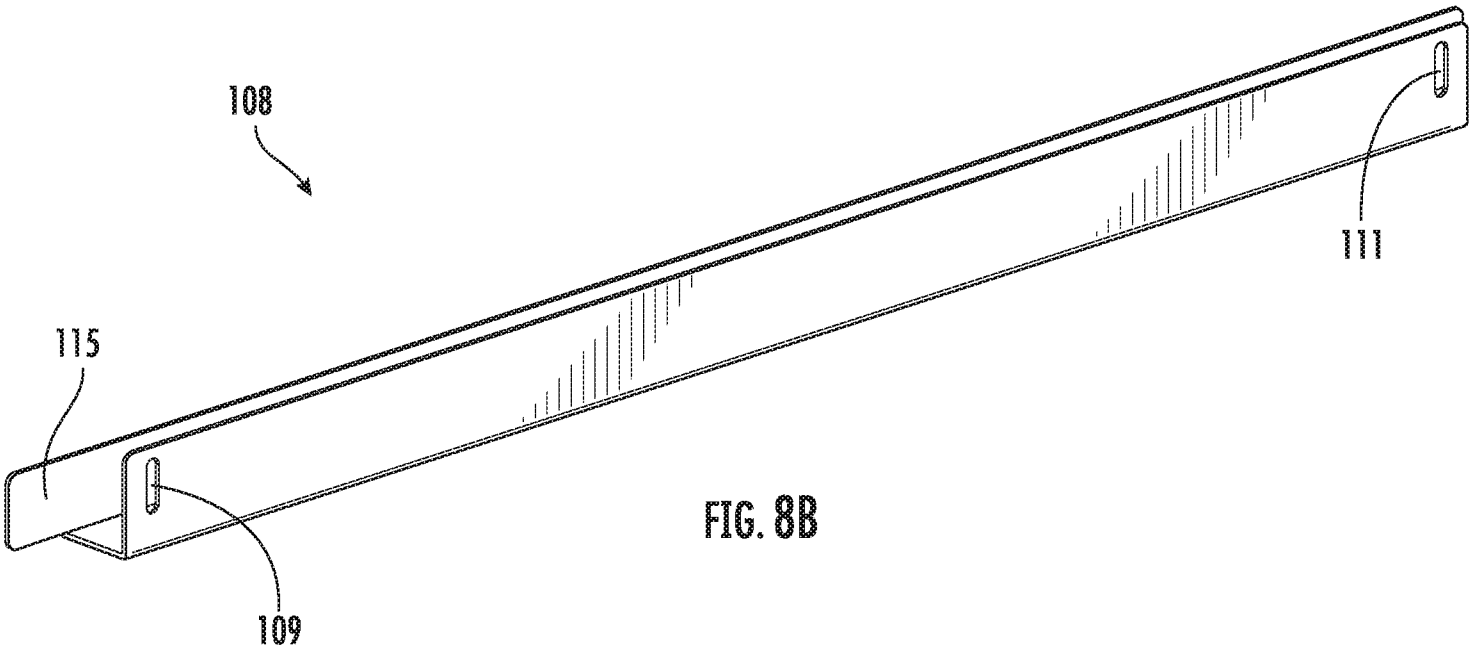
FIG. 8B is a perspective view of the portion of the panel assembly of FIG. 8A.
Figure 8C:
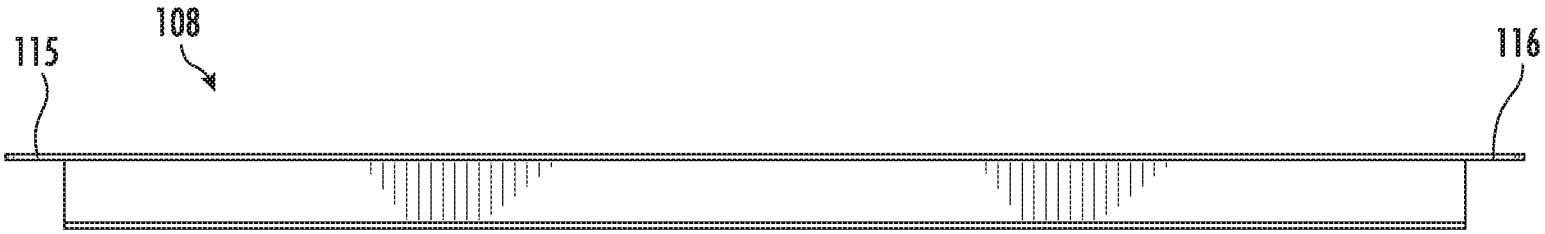
FIG. 8C is a top view of the portion of the panel assembly of FIG. 8B.

FIGS. 8A-8C show the bottom portion of a lower assembly 1201 of an exemplary panel configured to interface with a floor. In this example, as shown in FIG. 8A, the lower edge member 1205 of lower assembly 1201 interfaces with vertical side members 1207 and 1208 of the lower assembly 1201. The lower edge member 1205 of lower assembly 1201 interfaces with a bottom cover 108, which includes overhanging tabs 115, 116 and slotted holes 109, 111 at each end to allow the cover 108 to move/pivot and to be secured in position relative to the lower edge member 1205 of the lower assembly 1201 to be adaptable to ground slopes or contours. In addition, a bottom surface of the cover 108 may include a flexible sealing portion 112. The cover 108 may have a 'C' channel cross section. In some examples, there may be at least one fastener attaching the bottom cover 108 to the lower edge member 1205 such that the cover 108 may pivot about the at least one fastener to adapt to ground contours (see FIG. 8A). The fastener may be located approximately halfway along the length of lower edge member 1205. When the lower assembly 1201 is in the desired position, the cover 108 may be secured in position by tightening fasteners 113 and 114 in slotted holes 109 and 111, respectively.

FIG. 9 illustrates one example of the upper assembly 1211 that is configured to interface with a ceiling. The upper assembly 1211 includes a flexible portion 181 that can be pressed against a ceiling surface. In some examples, the flexible portion 181 is a foam gasket or any other appropriate compressible member.

Figure 10B:
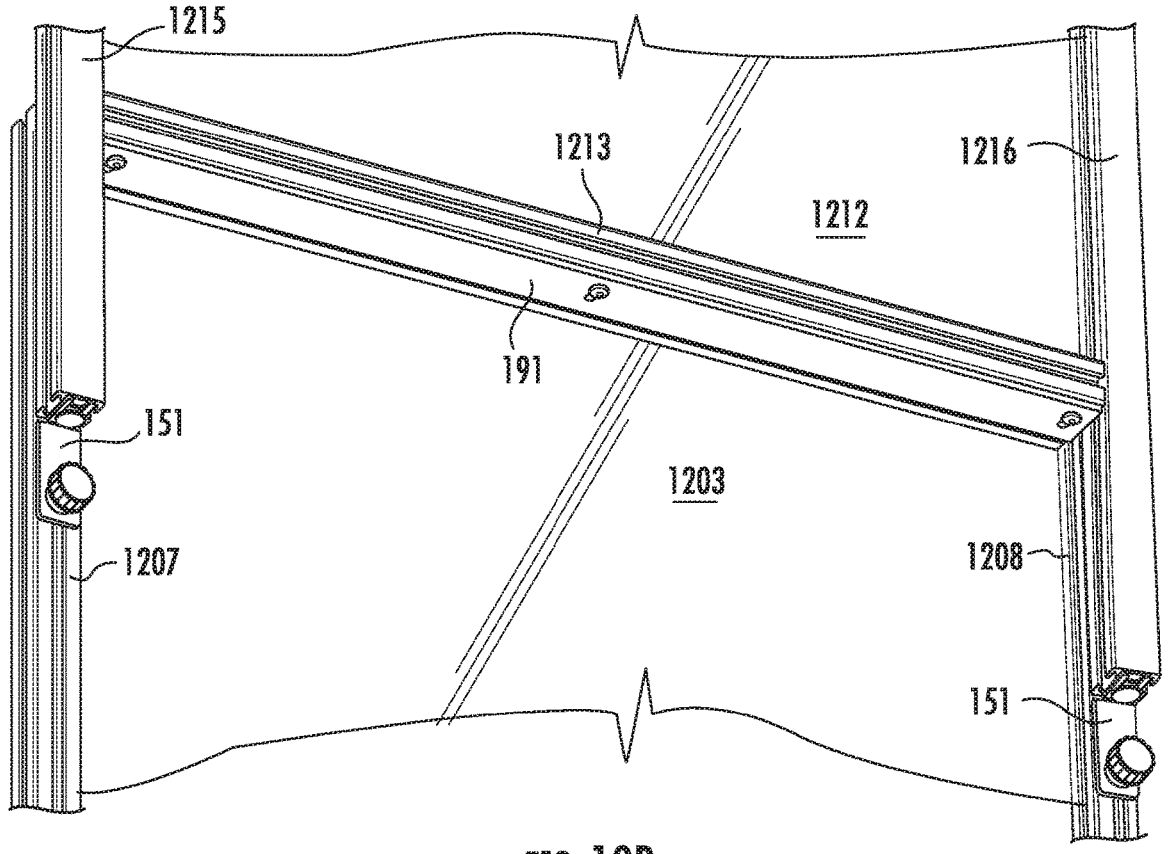
FIG. 10B is a partial perspective view of the sealing member of the panel assembly of FIG. 2B.
Figure 10C:
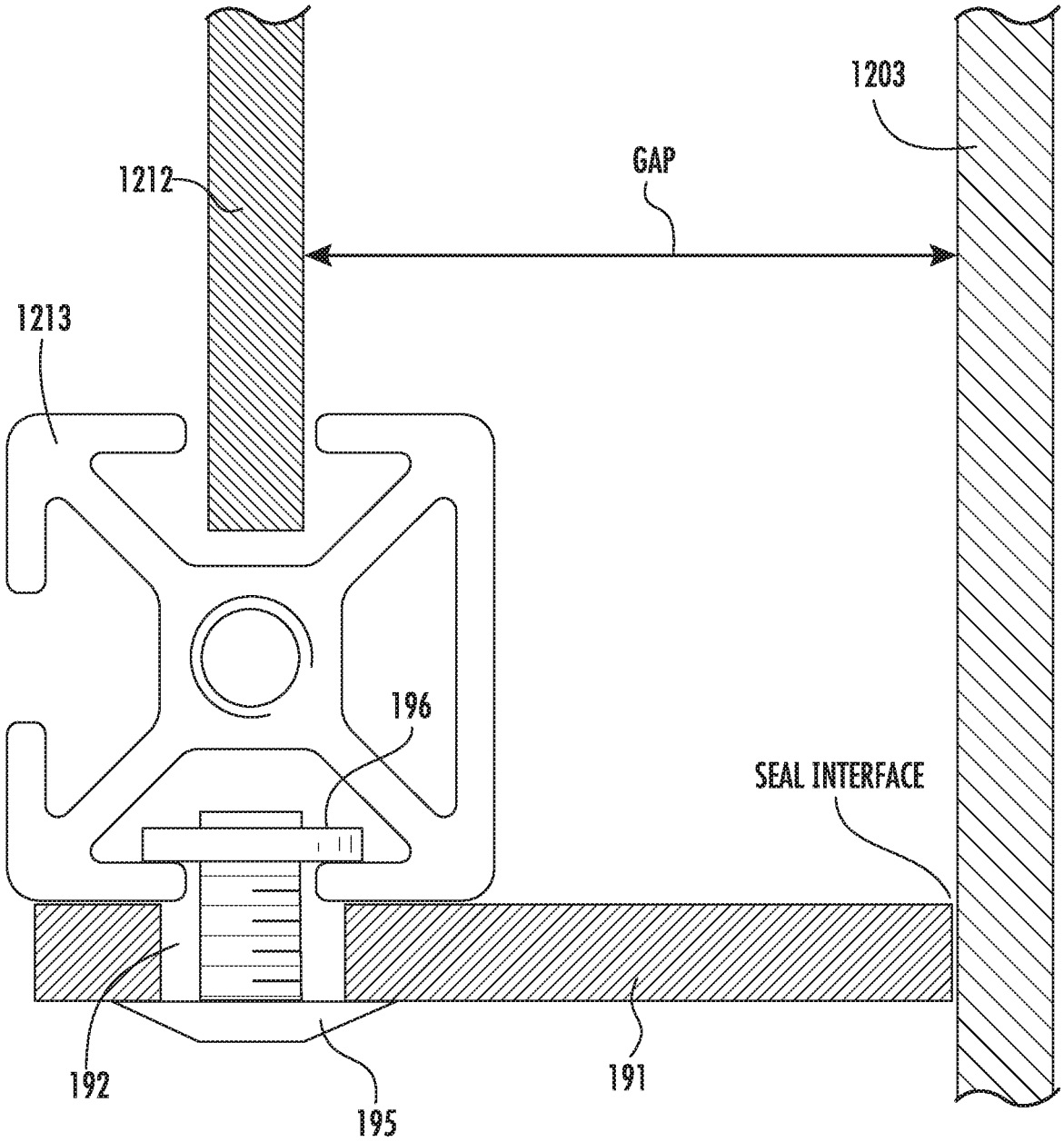
FIG. 10C is a detail cross-sectioned view of the sealing member of the panel assembly of FIG. 2B.

One example for sealing between adjacent upper and lower assemblies (such as upper assembly 1211 and lower assembly 1201) is shown in FIGS. 10B and 10 C. In areas where the window members overlap, as shown in FIGS. 10A and 10C, there is a gap between the adjacent window members (e.g., between window member 1203 of the lower assembly 1201 and window member 1212 of the upper assembly 1211). The lower edge of window member 1212 is inserted into the upper channel of lower edge member 1213 (see FIG. 10C). As shown in FIGS. 10B and 10C, the lower channel of lower edge member 1213 interfaces with a sealing member 191. The sealing member 191 extends from the lower edge member 1213 of the upper assembly 1211 in a direction perpendicular to the surface of window members 1203 and 1212. As shown in FIG. 10C, the sealing member 191 is attached using at least one fastener 195 that engages a nut 196 in a channel of the appropriate member (e.g., lower edge member 1213). In some embodiments, as shown in FIG. 10C, the at least one fastener 195 passes through a slotted hole 192 in the sealing member 191, which allows the sealing member 191 to be adjusted to minimize an opening between a distal end of the sealing member 191 and the window member 1203 at the seal interface.

The sealing member 191 may be attached to the lower edge member of the upper assembly (e.g., lower edge member 1413 of the upper assembly 1411 or lower edge member 1213 of the upper assembly 1211). As shown in FIG. 10B, the sealing member 191 may be attached to a lower surface of the lower edge member. In some examples, either in lieu of or in addition to the sealing member 191 attached to the lower edge member of the upper assembly, a sealing member 191 may be attached to the upper edge member of the lower assembly (e.g., upper edge member 1406 of the lower assembly 1401 or upper edge member 1206 of the lower assembly 1201). The following explanation is described in relation to an exemplary sealing member 191 attached to lower edge member 1213 (consistent with FIGS. 10B and 10C) but is applicable to multiple sealing member configurations. The attachment of the sealing member 191 to the lower edge member may utilize one or more fasteners (see FIG. 10B), adhesive, other attachment methods, and/or a combination thereof. The sealing member 191 extends toward, but does not contact, the window member of the lower assembly (e.g., window member 1403 of lower assembly 1401 or window member 1203 of lower assembly 1201) and creates a seal interface (see FIG. 10C). When the upper and lower assemblies move relative to one another (i.e., to adjust the overall height of the panel to adapt to a given ceiling height), the sealing member 191 moves with the upper assembly (e.g., upper assembly 1411 or upper assembly 1211). The seal interface between the sealing member 191 and the window member of the lower assembly moves along the surface of the window member of the lower assembly. The seal interface does not need to be an airtight seal, so long as it provides a sufficient seal to limit significant airflow through the panel. In addition, the seal interface is not affected by relative movement between the upper and lower assemblies. In other words, the seal interface is constant whether the position of the upper assembly relative to the lower assembly is being adjusted (i.e., by loosening or tightening L-brackets 151 as described above) or is constant. In addition, the sealing member 191 may act as a stop to limit movement of the upper assembly relative to the lower assembly. For example, if the sealing member 191 is attached to lower edge member 1213 of the upper assembly 1211, when the upper assembly 1211 moves up relative to lower assembly 1201, the sealing member 191 will contact upper edge member 1206, which (a) limits travel of the upper assembly 1211 relative to the lower assembly 1201 and (b) prevents over-travel of the upper assembly 1211 to prevent disengagement from the lower assembly 1201.

In some examples, the sealing member 191 is constructed from similar materials as the window members (e.g., window members 1203 and 1212) and may be constructed from materials that are rigid or semi-rigid and may be transparent, translucent, opaque, or a combination thereof. In other examples, the sealing member 191 may be constructed from a compliant, flexible material such as a rubber or polymer. In examples where the sealing member 191 is flexible, the sealing member 191 may be designed to contact the adjacent window member (e.g., window member 1203 as shown in FIG. 10C). When the sealing member 191 contacts the adjacent window member, the sealing member 191 may act as a wiper seal against the surface of the adjacent window member (e.g., window member 1203 as shown in FIG. 10C).

Figure 11A:
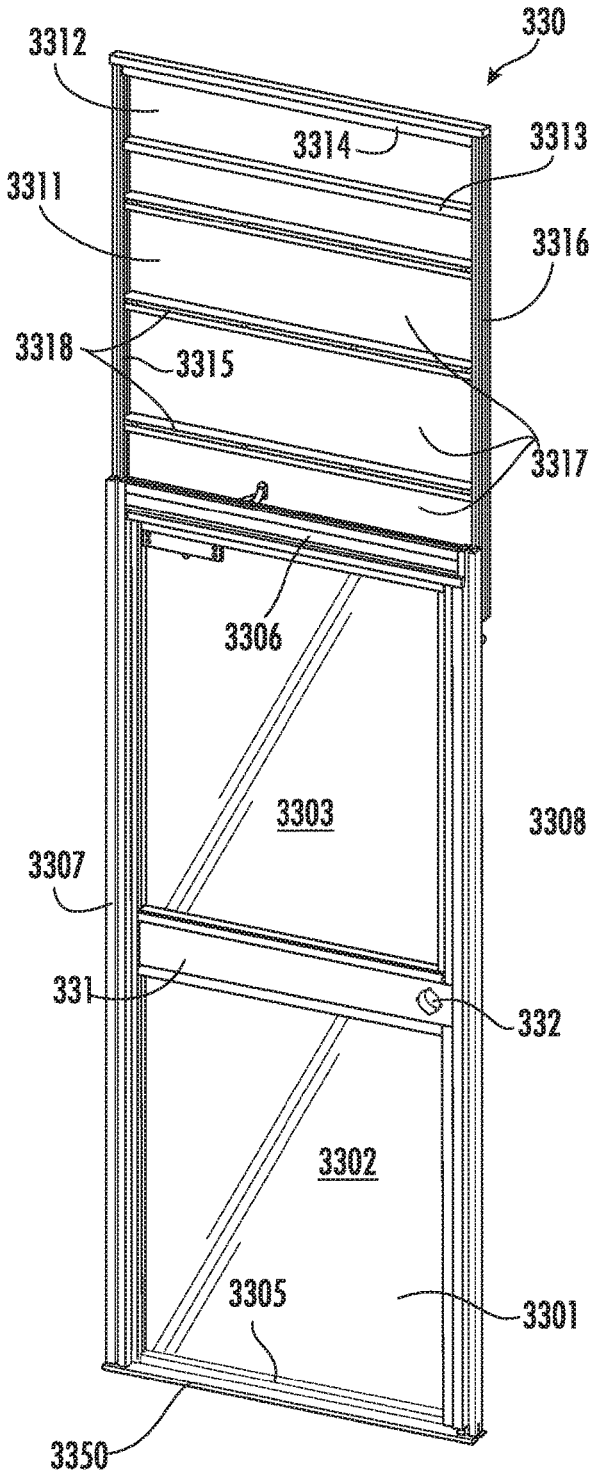
FIG. 11A is an exterior side perspective view of a door assembly of the containment system depicted in FIG. 1.
Figure 11B:
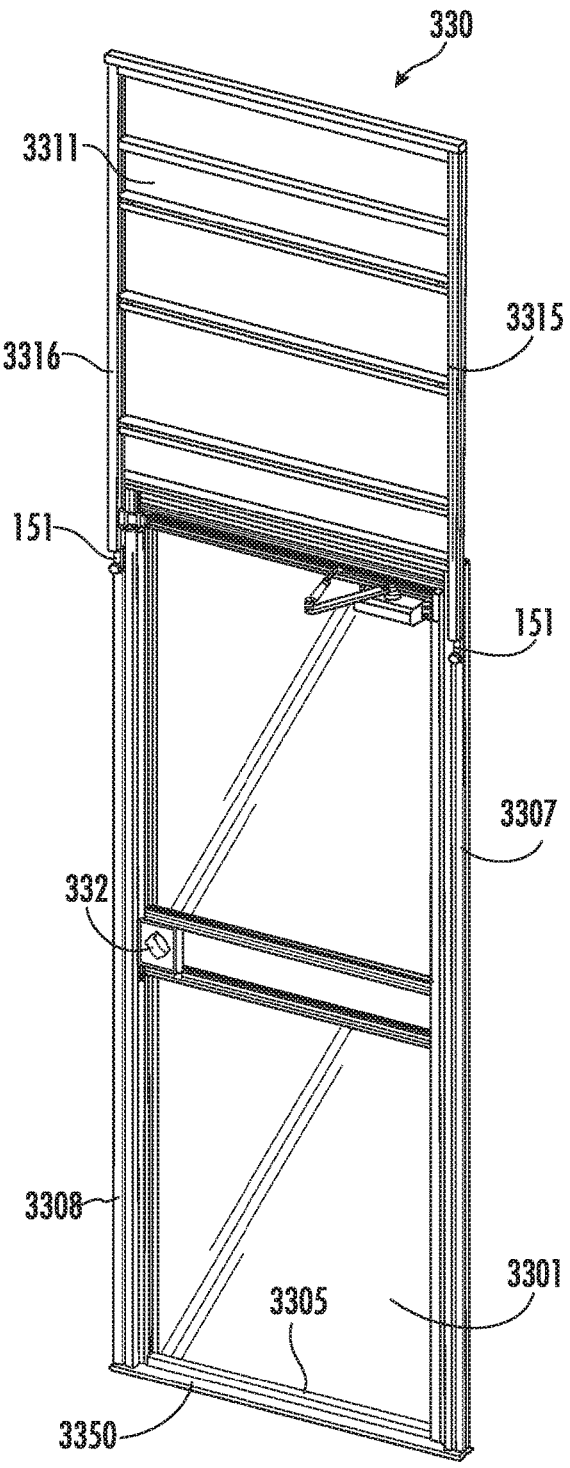
FIG. 11C is a top view of a threshold member of the door assembly depicted in FIG. 11A.
FIG. 11D is a detail perspective view of the threshold member depicted in FIG. 11C.
FIG. 11E is an end view of the threshold member depicted in FIG. 11C.
FIG. 11F is a partial perspective view of the door assembly depicted in FIG. 11A.

One example of a door assembly 330 is shown in FIGS. 11A and 11B. As shown in FIG. 1, the door assembly 330 (or 320) may be attached side by side to other components of the containment system 100 such as panel assembly 120, panel assembly 140, inside corner assembly 210, outside corner assembly 220, or any other appropriate component or assembly. The door assembly 330 may be adjustable in height and include a lower assembly 3301 and an upper assembly 3311. The upper assembly 3311 may include a lower edge member 3313, an upper edge member 3314, and vertical side members 3315, 3316. In some embodiments, the door assemblies may be available in multiple standard sizes (widths) including, for example, 44" and 32" sizes, or in any other appropriate size. In addition, the door assemblies may be configured such that the door can be arranged to open inwards or outwards. Changing between an inward-opening configuration and an outward-opening configuration may require moving the seals of the door assembly. The lower assembly 3301 may include a door 331 with a threshold member 3350 below the door 331 and a header member 3306 above the door. The door 331 also has a lower edge member 3305 along with vertical side members 3307, 3308 extending between the lower edge member 3305 and the header member 3306, where the lower edge member 3305 and vertical side members 3307, 3308 are in the form of struts 101. Window members 3302, 3303 may be supported on the lower assembly 3301. The door 331 may also include an opening 332 configured for standard door knob/handle and locking mechanisms. As shown in FIGS. 22B and 22C, the vertical side member 3308 may include multiple adjacent members (e.g., the two members 3308*a* and 3308*b* shown in FIGS. 22B and 22C). Vertical side member 3307 may include a similar arrangement with multiple adjacent members. As shown in FIG. 11B, the upper assembly 3311 and the lower assembly 3301 can move relative to one another (similar to other panels) and can be secured in a desired position using one or more L-brackets 151 as described above. Based on the fit and arrangement of the components, the door may be adjusted to match size and shape of the desired location (including compensation for uneven floors, walls, and ceilings). In some embodiments, the door assembly can be adjusted between a rectangular shape and a parallelogram shape to compensate for these issues.

The lower assembly 3301 and the upper assembly 3311 of the door assembly 330 overlap one another (similar to panel assemblies 120, 140). However, to ensure that the doorway opening is not obstructed, the panels of the upper assembly 3311 must be arranged to reach but not extend below the header member 3306. As shown in FIGS. 11A and 11B, the upper assembly 3311 may include a static window member 3312 and a plurality of removable modular window members 3317. The static window member 3312 may be arranged between the lower edge member 3313 and the upper edge member 3314 such that the static window member 3312 (and the lower edge member 3313) interface with the header member 3306 when the door assembly 330 is arranged at a minimum height (i.e., when there are no removable modular window members 3317). One or more removable modular window members 3317 may be inserted below the static window member 3312 for adjusting the door assembly 330 above the minimum height. The uppermost removable modular window member 3317 interfaces with lower edge member 3313 and a spacer member 3318 between each pair of adjacent removable modular window members 3317. The removable modular window members 3317 have a plurality of standard heights such that they can be combined to adapt the upper assembly 3311 to any necessary height. In some embodiments, the spacer members 3318 each have a groove at an upper edge and at a lower edge to engage a removable modular window member 3317.

Figure 11C:
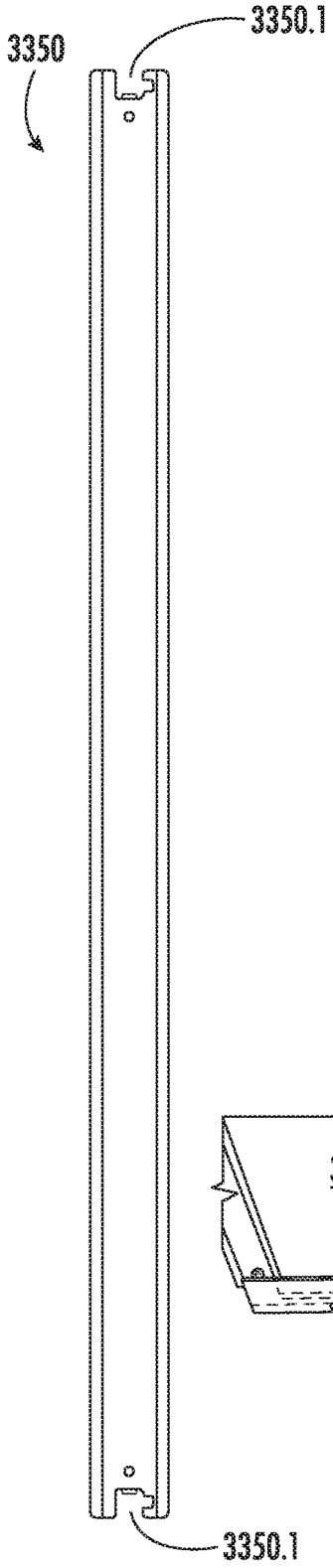
Figure 11D:
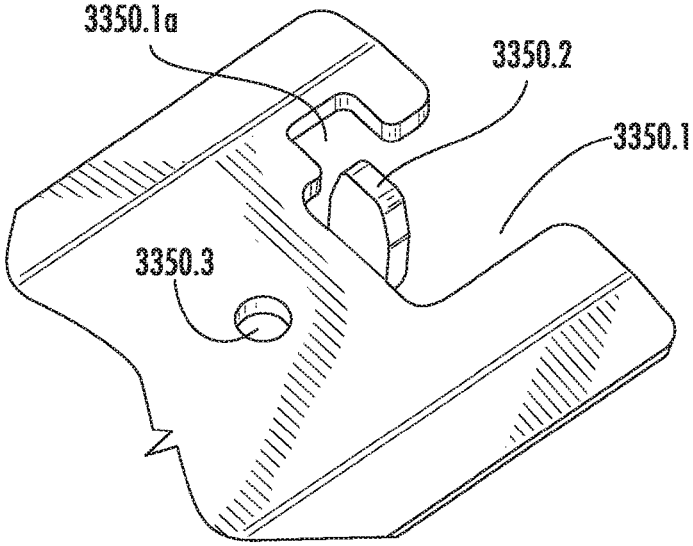
Figure 11E:
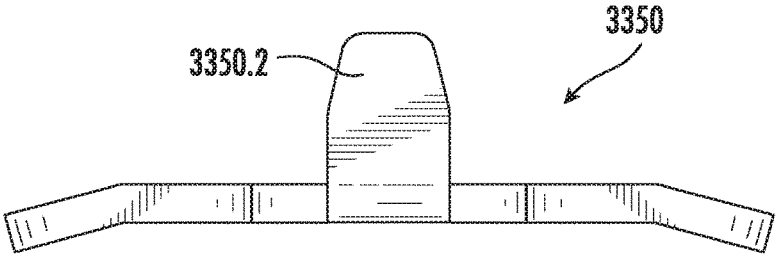
Figure 11F:
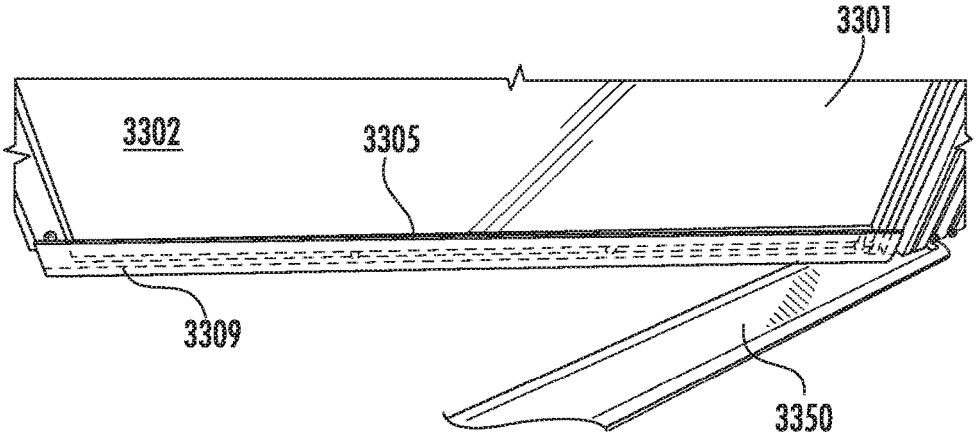

As shown in FIG. 11F, the door assembly 330 may include a seal member 3309 extending down from the lower edge member 3305. The seal member 3309 may include slotted holes such that the seal member 3309 can be adjusted to seal against the threshold member 3350 (similar to sealing member 191).

The threshold member 3350 is shown in FIGS. 11C-11E and includes a cutout 3350.1 at each end, upstanding tabs 3350.2 for interfacing with a channel of vertical member (e.g., vertical side members 3307, 3308), and fastener holes 3350.3. The fastener holes 3350.3 are configured such that a fastener (not shown) may pass through fastener hole 3350.3 from the underside of the threshold member 3350 to engage hole 103 of a vertical member of the upper side of the threshold member 3350. The cutout 3350.1 allows a portion of a fitting 401 to pass through the threshold member 3350 for installation (see FIG. 22C). The cutout 3350.1 may include a notch 3350.1*a* such that when the fitting 401 passes through threshold member 3350, the notch 3350.1*a* allows clearance for fastener 407, which engages hole 404 of the fitting 401 (see FIGS. 16A and 22C). In addition, as shown in FIGS. 22B and 22C, the fitting 401 can be combined with at least one spacer 411 to vertically offset adjacent panels.

Figure 12A:
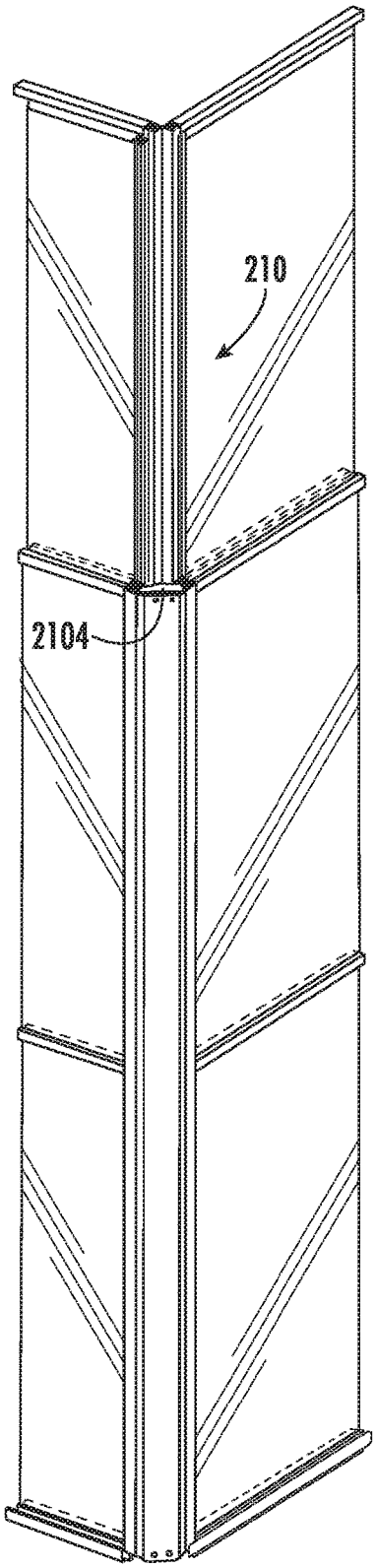
FIG. 12A is an exterior side perspective view of an inside corner assembly of the containment system depicted in FIG. 1.
Figure 12B:
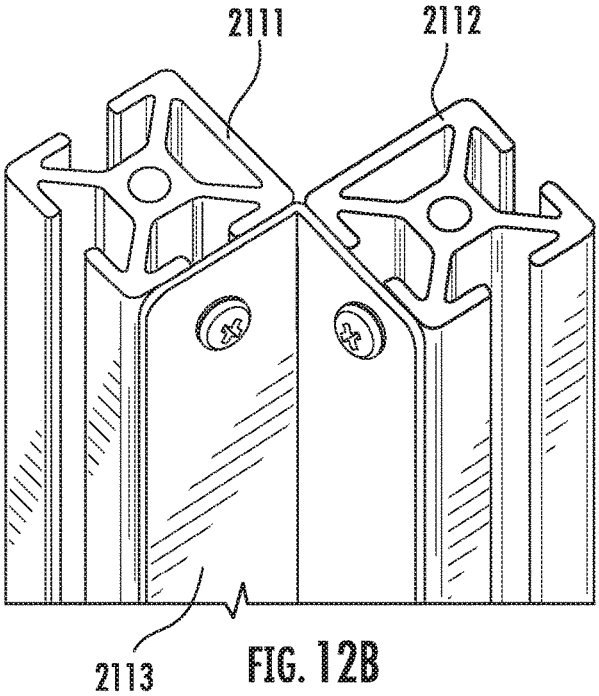
FIGS. 12B and 12C are partial interior side perspective views of the inside corner assembly of FIG. 12A.

FIGS. 12A-12K illustrate one example of an inside corner assembly 210 of the containment system 100. Inside corner assemblies 210 can be used to position panels at a desired angle relative to one another. The inside corner assembly 210 is arranged such that a vertex of the corner points toward the exterior of the containment system 100 as shown in FIG. 12A, which is an exterior perspective view of inside corner assembly 210. Although inside corner assembly 210 is illustrated as a 90° corner, the inside corner assembly 210 can be any fixed angle, such as 30°, 45°, 60°, 75°, 105°, 135°, or any other angle to connect adjacent panels at the desired angle.

Figure 12C:
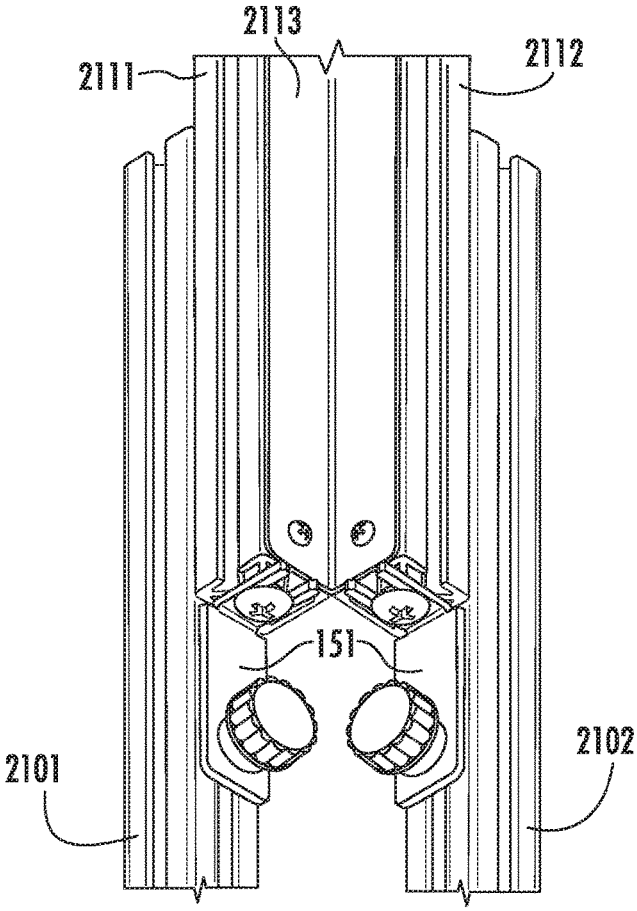
Figure 12D:
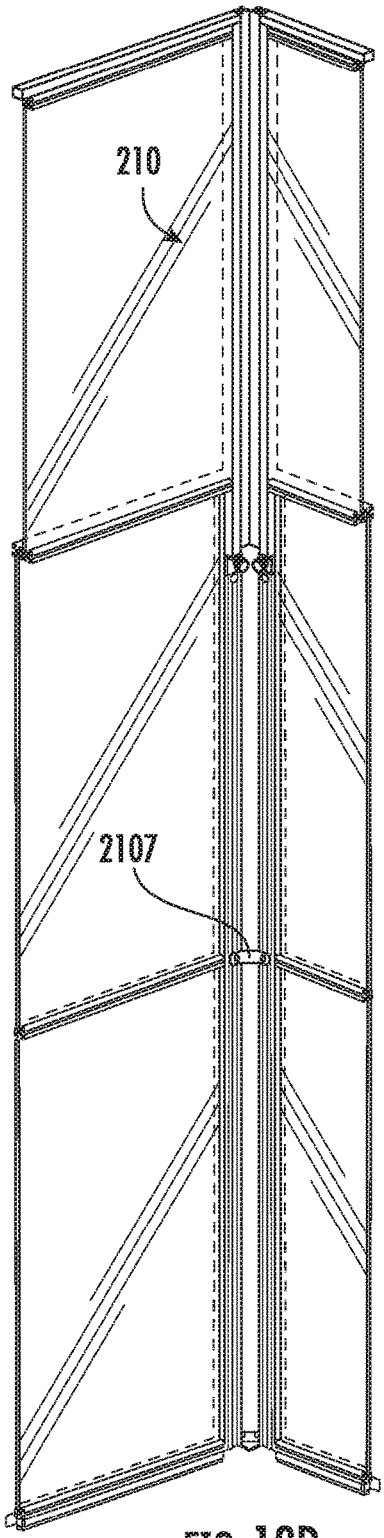
FIG. 12D is an interior side perspective view of the inside corner assembly of FIG. 12A.
Figure 12E:
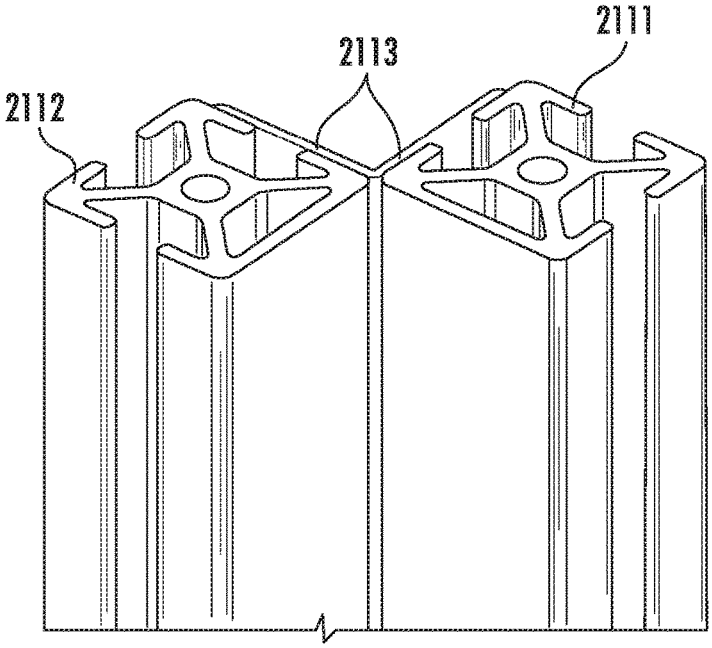
FIGS. 12E and 12F are partial exterior side perspective views of the inside corner assembly of FIG. 12A.
Figure 12F:
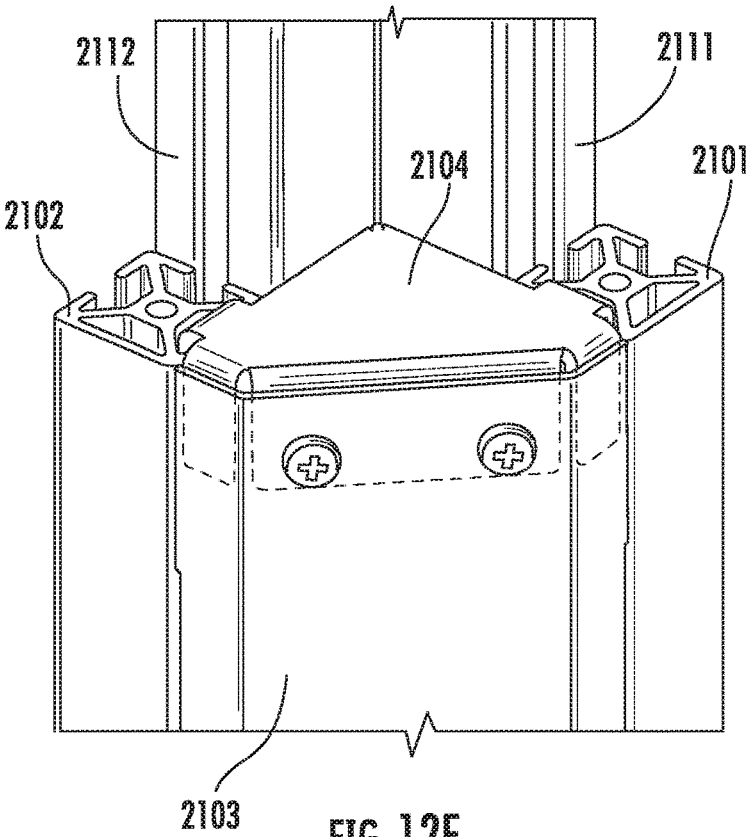
Figure 12G:
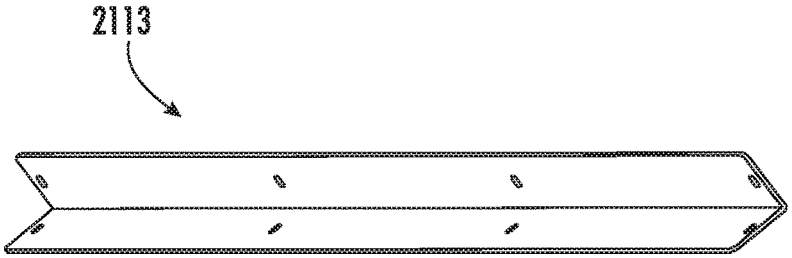
FIGS. 12G and 12H are perspective and end views, respectively, of an upper closeout of the inside corner assembly of FIG. 12A.
Figure 12H:
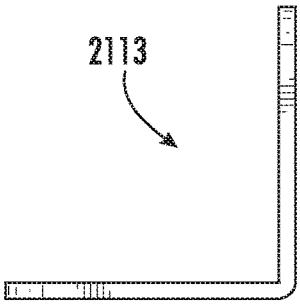
Figure 12J:
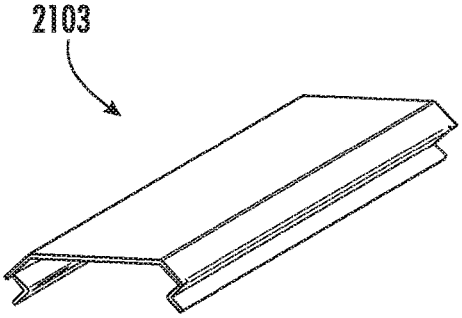
FIGS. 12J and 12K are perspective and end views, respectively, of a lower closeout of the inside corner assembly of FIG. 12A.
Figure 12K:
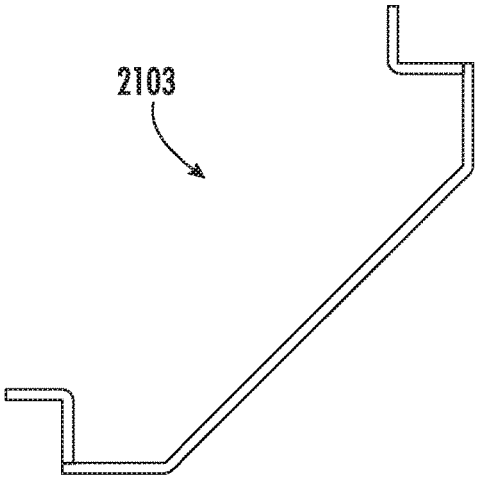
Figure 12L:
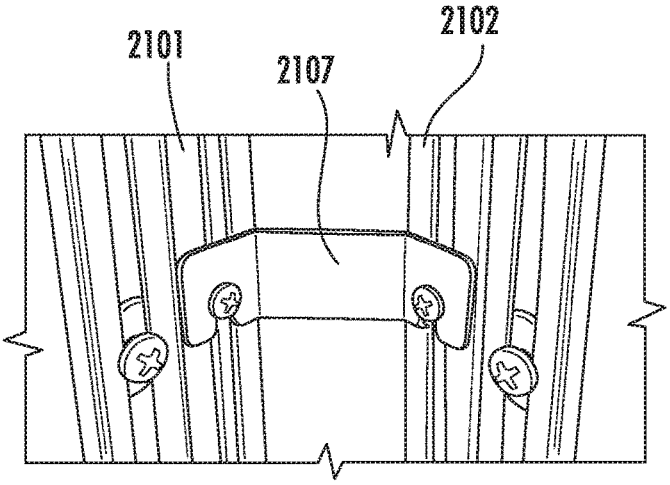
FIG. 12L is an interior side partial perspective view of the inside corner assembly of FIG. 12A.

In some cases, the inside corner assembly 210 includes lower vertical members 2101 and 2102, which interface with upper vertical members 2111 and 2112, respectively. As shown in FIGS. 12C and 12D, L-brackets 151 on the interior side of the inside corner assembly 210 enable the adjustment of the relative positions of the vertical members (2101, 2102, 2111, 2112), as described above. The upper vertical members 2111 and 2112 form a corner with closeout member 2113, which is shown in FIGS. 12E, 12G, and 12H. The lower vertical members 2101 and 2102 form a corner with closeout member 2103, which forms a 45° face facing the exterior side of the containment system 100. The closeout member 2103 is shown in FIGS. 12F, 12J, and 12K. On the interior side, the inside corner assembly 210 may include a bracket 2107 to ensure that lower vertical members 2101 and 2102 maintain a constant position relative to one another.

Figure 13A:
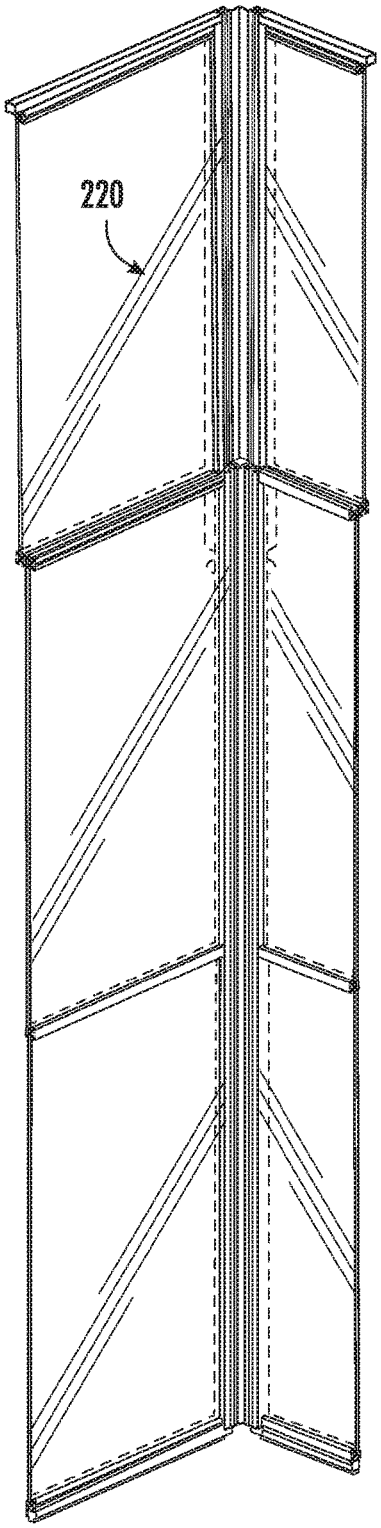
FIG. 13A is an exterior side perspective view of an outside corner assembly of the containment system depicted in FIG. 1.

FIGS. 13A-13J illustrate one example of an outside corner assembly 220 of the containment system 100. Like inside corner assemblies 210, the outside corner assemblies 220 can be used to position panels at a desired angle relative to one another. The outside corner assembly 220 is arranged such that a vertex of the corner points toward the interior (containment area) of the containment system 100 as shown in FIG. 13A, which is an exterior perspective view of outside corner assembly 220. Although outside corner assembly 220 is illustrated as a 90° corner, the outside corner assembly 220 can be any fixed angle, such as 30°, 45°, 60°, 75°, 105°, 135°, or any other angle to position adjacent panels at the desired angle relative to one another.

Figure 13B:
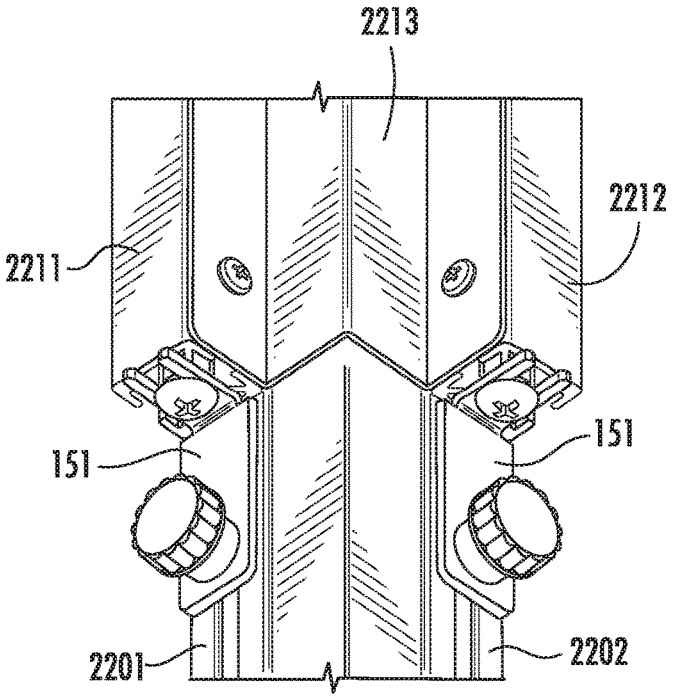
FIGS. 13B and 13C are partial interior side perspective views of the outside corner assembly of FIG. 13A.
Figure 13C:
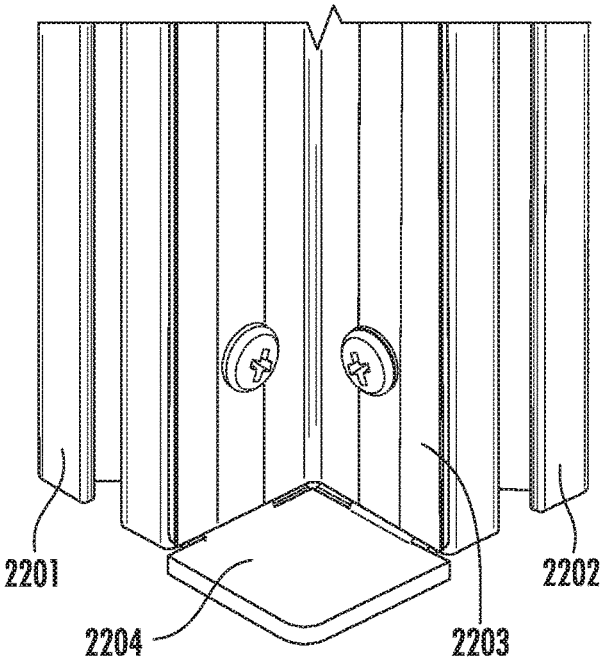
Figure 13D:
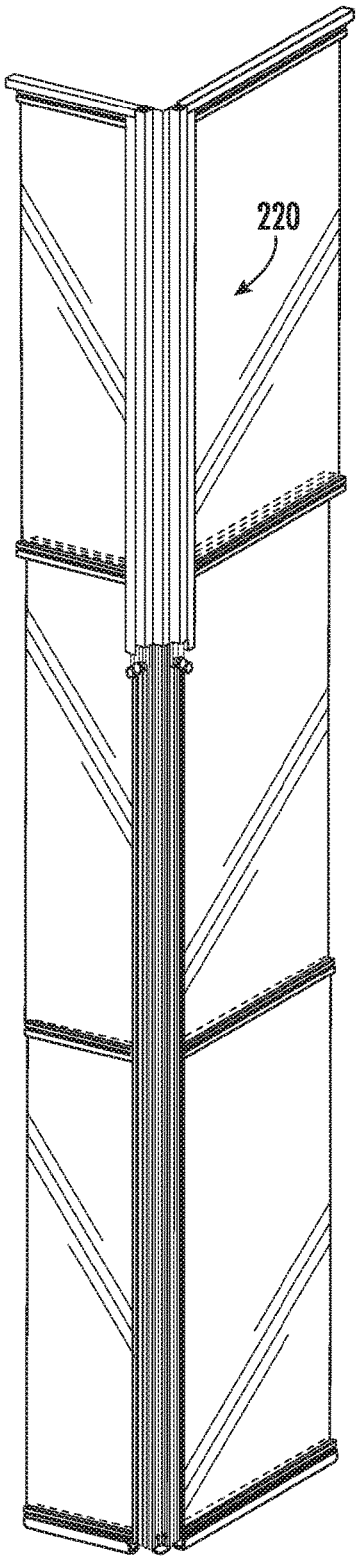
FIG. 13D is an interior side perspective view of the outside corner assembly of FIG. 13A.
Figure 13E:
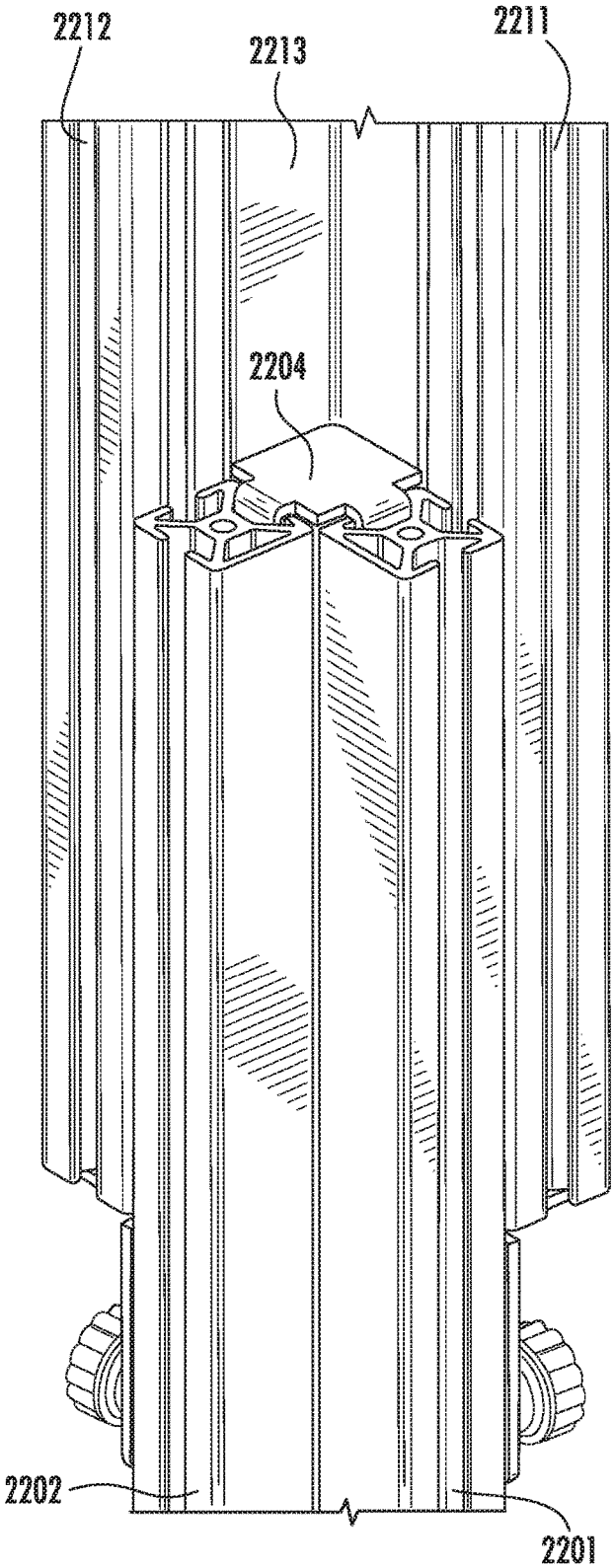
FIG. 13E is a partial exterior side perspective view of the outside corner assembly of FIG. 13A.
Figure 13F:
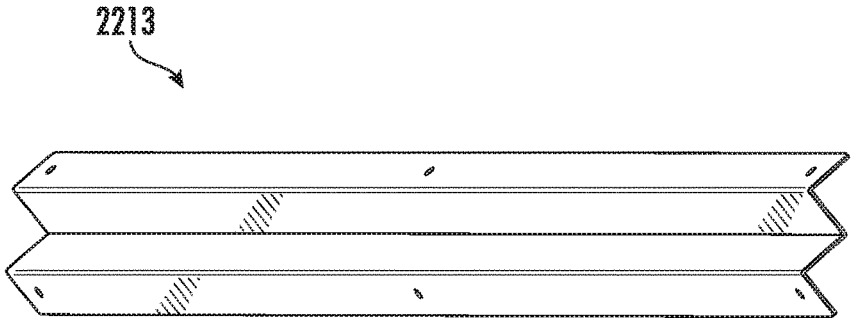
FIGS. 13F and 13G are perspective and end views, respectively, of an upper closeout of the outside corner assembly of FIG. 13A.
Figure 13G:
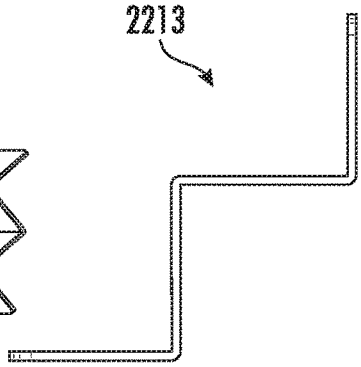
Figure 13H:
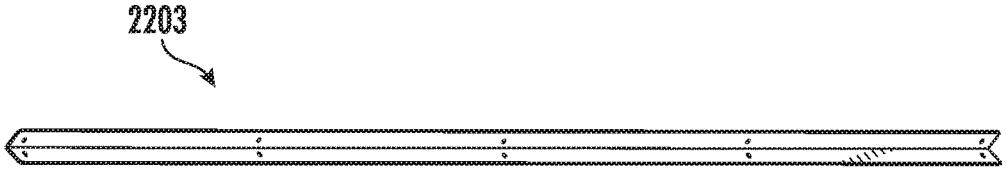
FIGS. 13H and 13J are perspective and end views, respectively, of a lower closeout of the outside corner assembly of FIG. 13A.
Figure 13J:
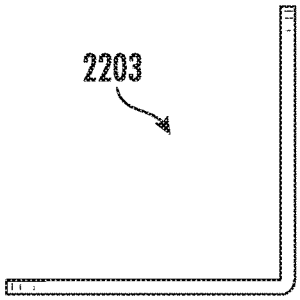

In some cases, the outside corner assembly 220 includes lower vertical members 2201 and 2202, which interface with upper vertical members 2211 and 2212, respectively. As shown in FIG. 13B, L-brackets 151 on the interior side of the outside corner assembly 220 enable adjustment of the relative positions of the vertical members (2201, 2202, 2211, 2212). The upper vertical members 2211 and 2212 form a corner with closeout member 2213, which is shown in FIGS. 13B, 13F, and 13G. The lower vertical members 2201 and 2202 form a corner with closeout member 2203, which is shown in FIGS. 13C, 13H, and 13J.

Figure 14A:
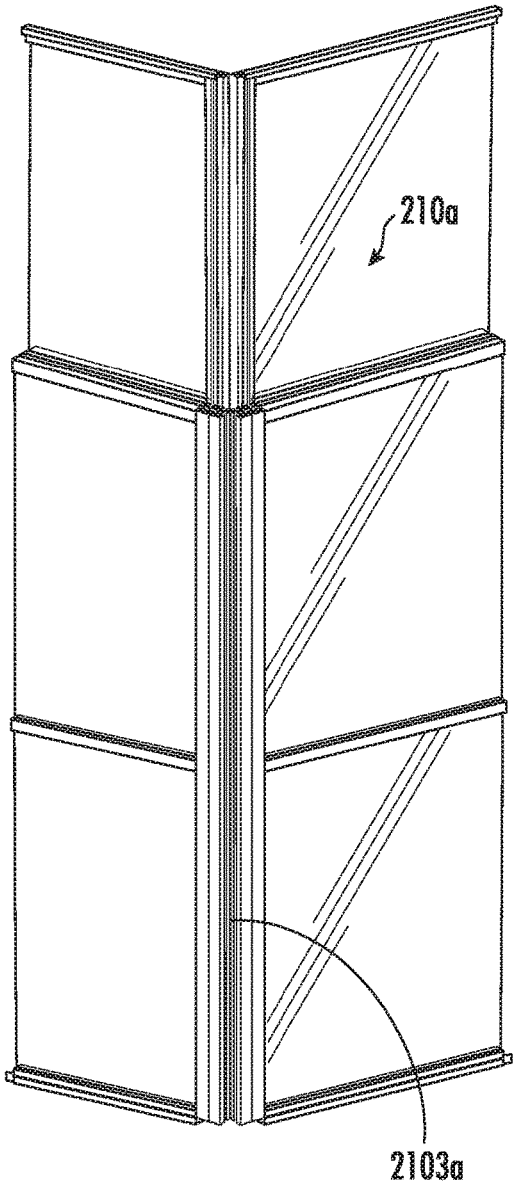
FIG. 14A is an exterior side perspective view of a hinged inside corner assembly of the containment system depicted in FIG. 1.
Figure 14B:
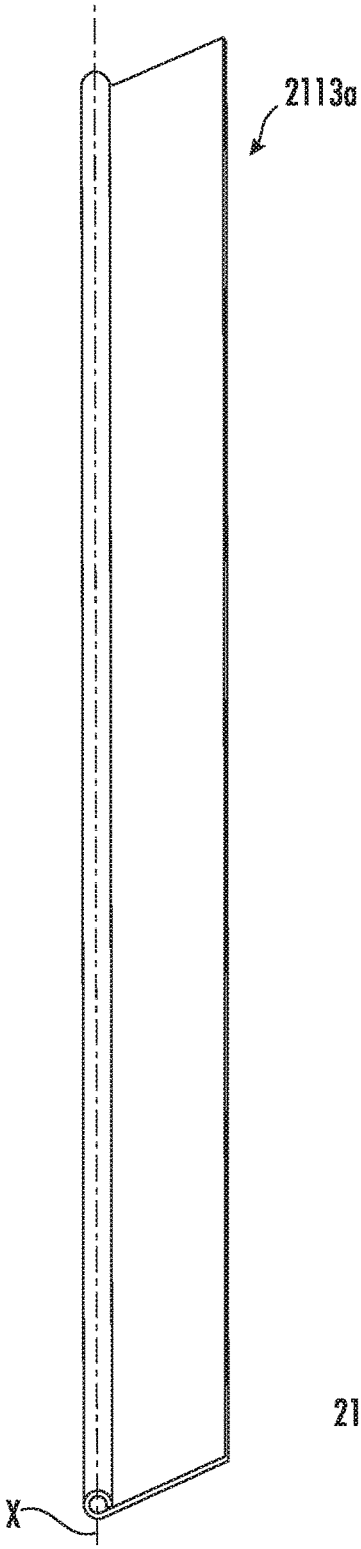
FIGS. 14B and 14C are perspective views of components of the hinged inside corner assembly depicted in FIG. 14A.
Figure 14C:
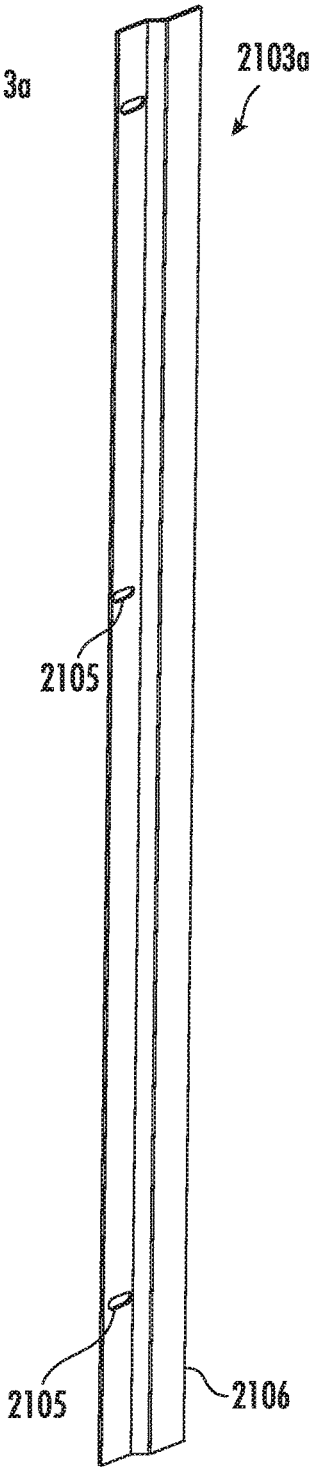
Figure 14D:
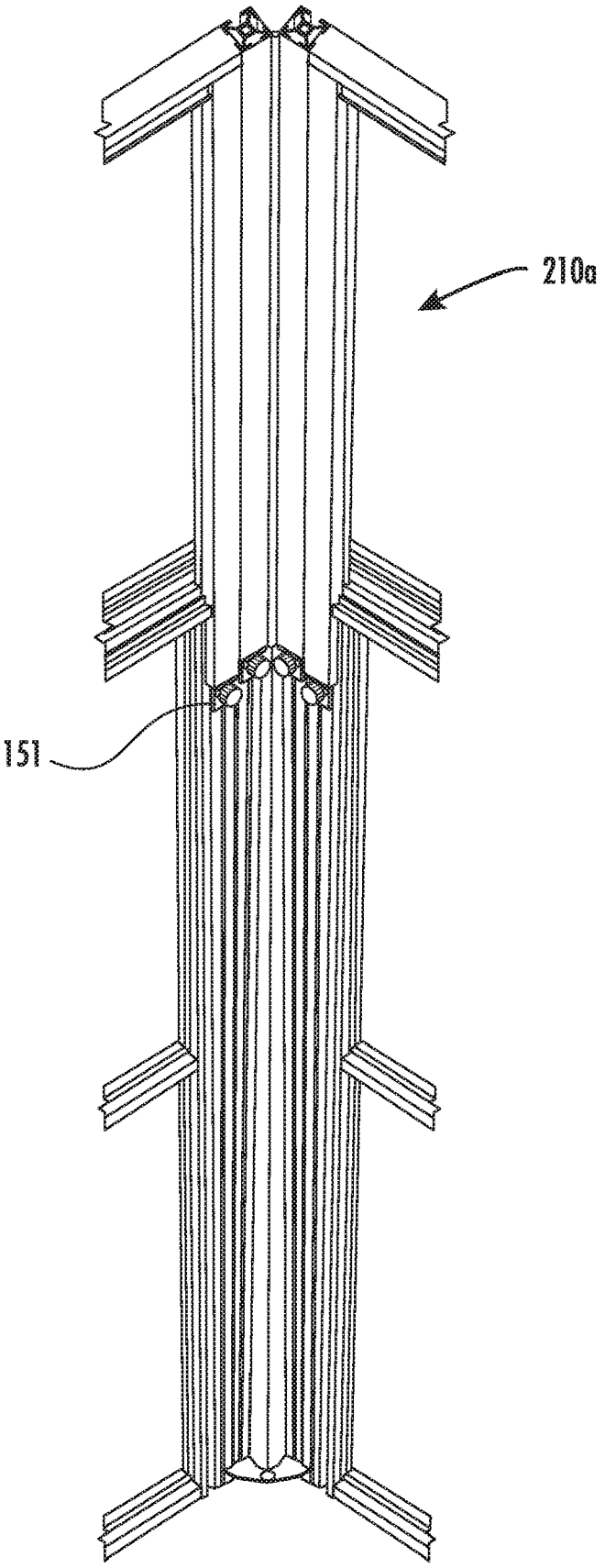
FIG. 14D is an interior perspective view of the hinged inside corner assembly depicted in FIG. 14A.

As shown in FIGS. 14A-14C, the inside corner assembly 210 may be replaced by a hinged inside corner assembly 210*a*. In the hinged inside corner assembly 210*a*, the closeout member 2113 is replaced by a pair of upper hinged members 2113*a*. The two upper hinged members 2113*a* meet and attach to one another at a common pivot axis X (see FIG. 14B). The lower closeout member 2103 is replaced by a pair of articulating members 2103*a*. The two upper hinged members 2113*a*, which attach to upper vertical members 2111 and 2112, pivot with respect to one another about pivot axis X such that hinged inside corner assembly 210*a* can be rotated on-the-fly to a desired rotational position. In other words, if a user wants to change the angle created by hinged inside corner assembly 210*a*, the two upper hinged members 2113*a* can be pivoted relative to one another. If a user wants to match a non-standard angle in a facility, the hinged inside corner assembly 210*a* can be adapted to match the angle. To ensure the lower portion of hinged inside corner assembly 210*a* is closed, the two articulating members 2103*a*, which attach to lower vertical members 2101 and 2102 via slotted holes 2105, can be adjusted such that they meet one another at their respective free edges 2106.

Figure 15A:
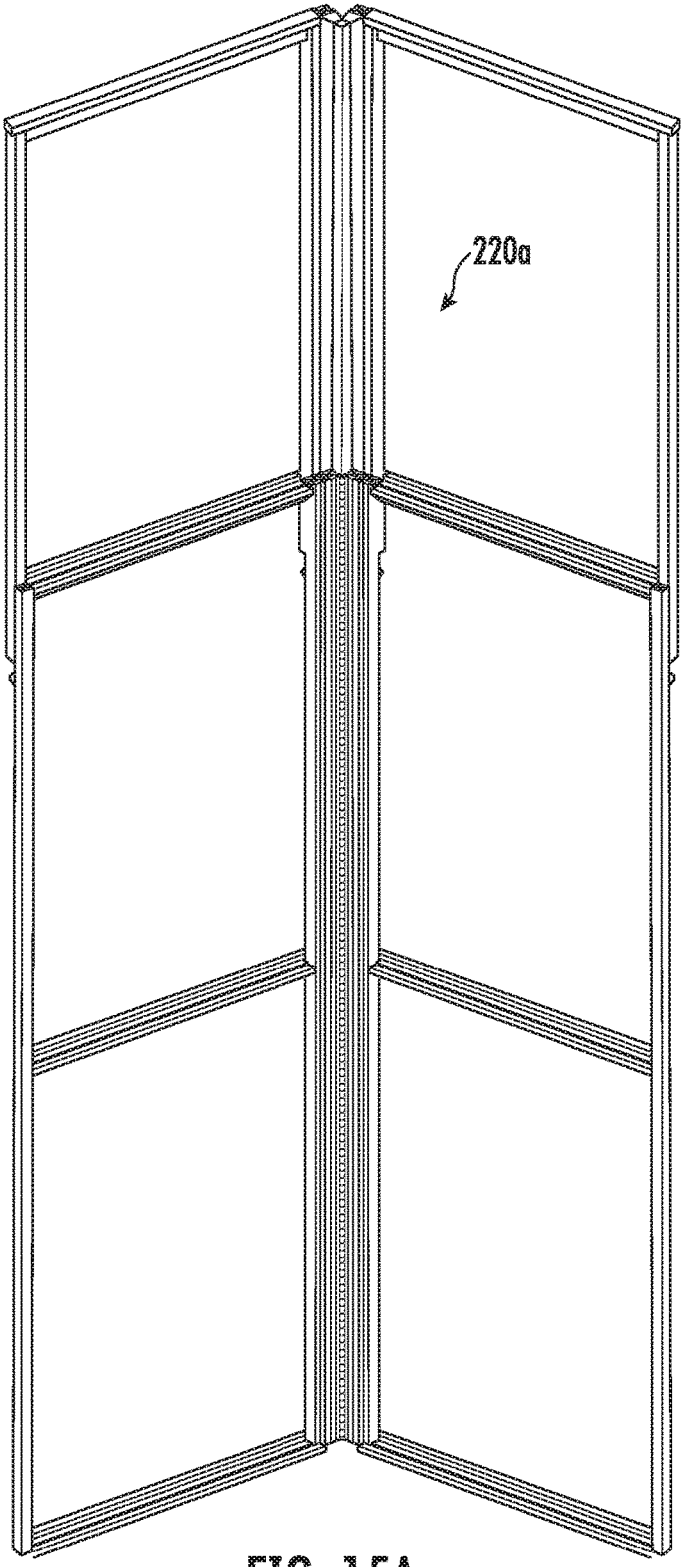
FIG. 15A is an exterior side perspective view of a hinged outside corner assembly of the containment system depicted in FIG. 1.
Figure 15B:
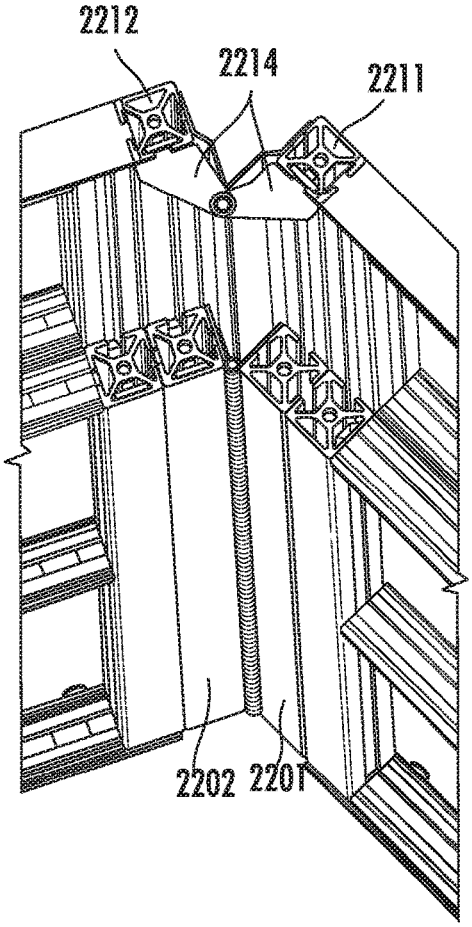
FIGS. 15B and 15C are partial perspective views of the hinged outside corner assembly depicted in FIG. 15A.
Figure 15C:
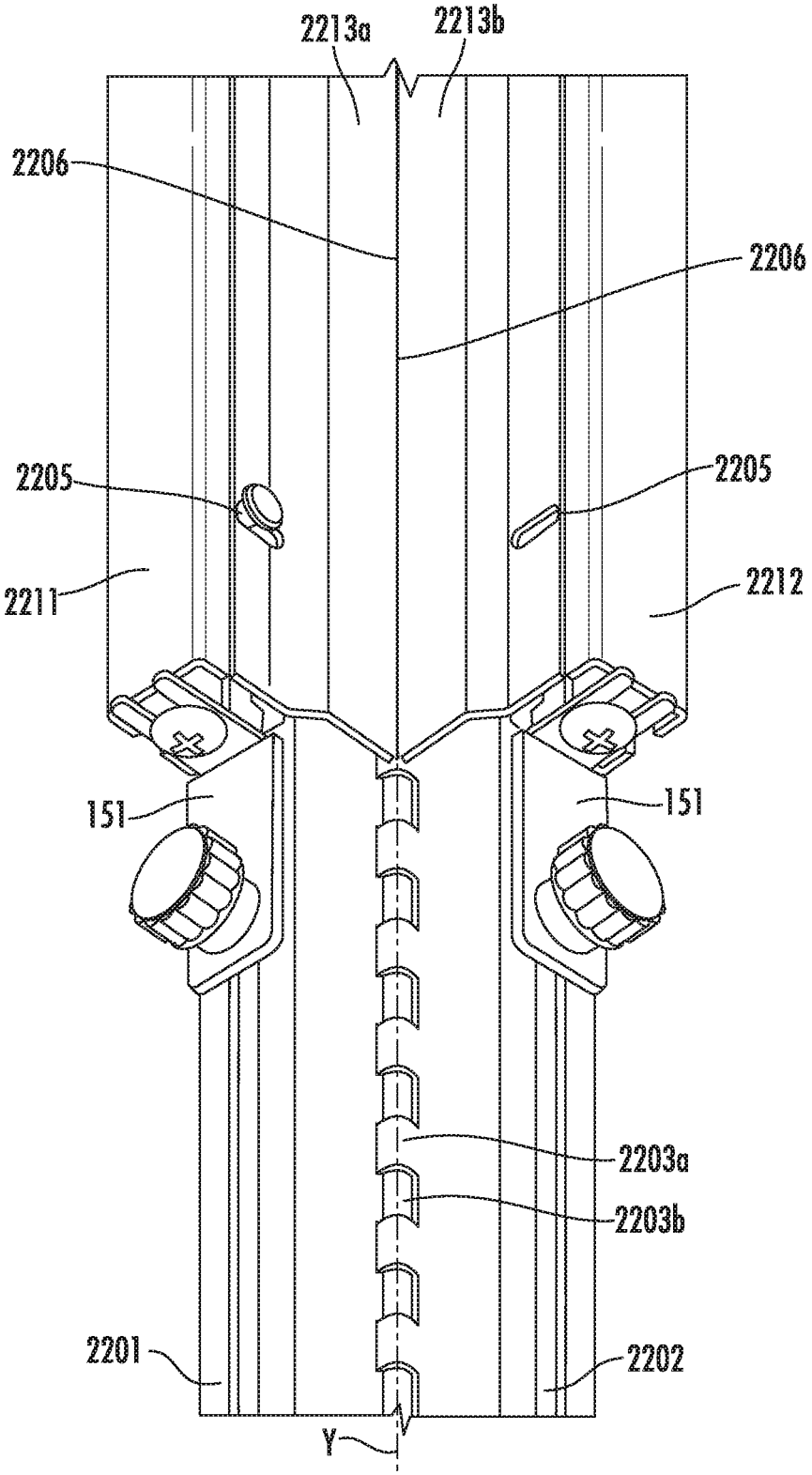
Figure 15D:
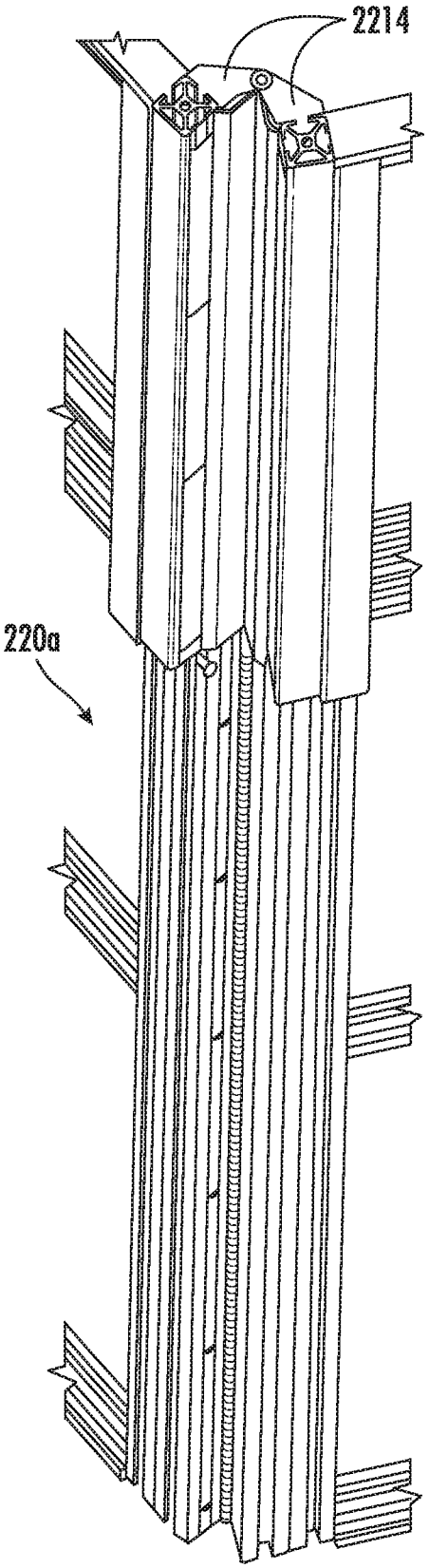
FIG. 15D is an interior perspective view of the hinged outside corner assembly depicted in FIG. 15A.

As shown in FIGS. 15A-15C, the outside corner assembly 220 may be replaced by a hinged outside corner assembly 220*a*. In the hinged outside corner assembly 220*a*, the upper closeout member 2213 is replaced by a pair of upper articulating members 2213*a* and 2213*b*. The lower closeout member 2203 is replaced by a pair of articulating members 2203*a* and 2203*b*. The two articulating members 2203*a* and 2203*b* meet and attach to one another at a common pivot axis Y similar to a piano hinge (see FIG. 15C). As shown in FIGS. 15B and 16E, near the top of the hinged outside corner assembly 220*a*, there is a pair of upper hinge fittings 2214, which are attached to upper vertical members 2211 and 2212. In particular, the lower portion 2214.2 of each fitting is inserted into a channel of the respective member (upper vertical members 2211 and 2212) such that a fastener (not shown) engages hole 2214.4 of each fitting 2214. The two upper hinge fittings 2214 attach to one another and rotate about pivot holes 2214.3 of the upper portion 2214.1 of the fitting. The two pivot holes 2214.3 are coaxial with pivot axis Y. Similar to the hinged inside corner assembly 210*a*, a user can change the rotational position of the hinged outside corner assembly 220*a* or rotate the hinged outside corner assembly 220*a* to non-standard angles. To ensure the upper portion of hinged outside corner assembly 220*a* is closed, the two articulating members 2213*a* and 2213*b*, which attach to upper vertical members 2211 and 2212, respectively, via slotted holes 2205, can be adjusted such that they meet one another at their respective free edges 2206.

Figure 16A:
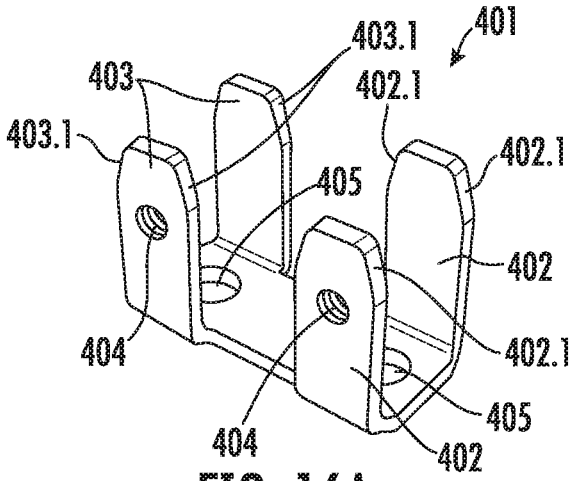
FIG. 16A is a perspective view of a fitting for securing adjacent struts of the containment system depicted in FIG. 1.
Figure 16B:
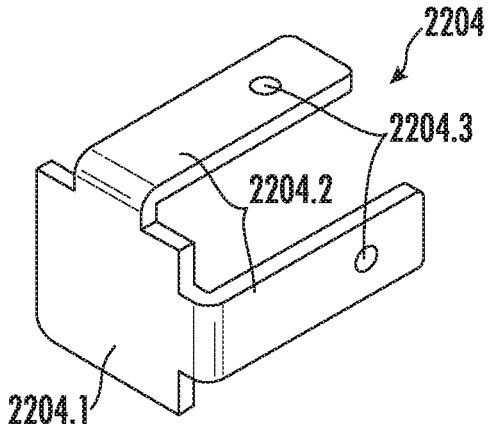
FIG. 16B is a perspective view of a corner fitting for securing struts of the containment system depicted in FIG. 1.

FIG. 16A illustrates one example of a fitting 401 for securing adjacent members (such as vertical side member 1407, vertical side member 1408, vertical side member 1207, vertical side member 1208, etc.) together. For example, when multiple panel assemblies (110, 120, 130, 140) are arranged consecutively, the vertical members from adjacent panels should be secured to one another. In some cases, the first two arms 402 of the fitting 401 are inserted into channels of a first member and the second two arms 403 of the fitting are inserted into channels of a second member. The fitting 401 may be arranged such that the arms 402, 403 with holes 404 are aligned with a portion of the respective member with channels such that fasteners can be inserted through the channels to the holes 404 to secure the fitting to each member. The other arms without holes can be inserted into the hollow areas adjacent to the continuous surface 104 of the respective member (typically on the exterior side of the respective member). In addition, fasteners can be inserted through holes 405 of the fitting 401 into the hole 103 of each respective member. The fitting 401 may be used on the bottom and/or top of vertical members from adjacent panels. In some examples, some or all of the arms 402, 403 include a taper (402.1, 403.1) to facilitate insertion into the channel of member that is attached to fitting 401.

Fitting 2204 (shown in FIGS. 13C, 13E, and 16B) is used to secure two members in parallel at a right angle to one another. The fitting 2204 includes an approximately square base plate 2204.1 and arms 2204.2 that extend from adjacent perpendicular edges of the base plate 2204.1. As shown in FIG. 13C, when the arms 2204.2 are inserted into channels of adjacent members, fasteners can be inserted through channels to engage holes 2204.3 to secure the fitting 2204 in position. Although not shown in FIG. 16B, each of the arms 2204.2 may include at least one taper (similar to arms 402, 403 of fitting 401).

Figure 16C:
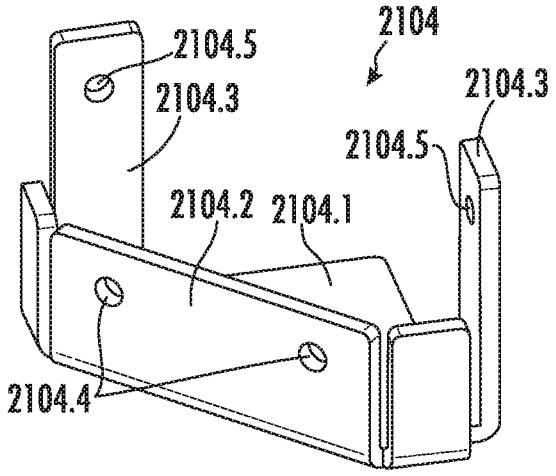
FIG. 16C is a perspective view of a 45 degree corner fitting for securing struts of the containment system depicted in FIG. 1.

As shown in FIGS. 12F and 16C, fitting 2104 secures the end of closeout member 2103. The fitting 2104 includes a base plate 2104.1 that approximately matches the opening formed at the end of closeout member 2103. The fitting 2104 also includes a 45° arm configured to attach to the inside of closeout member 2103 using fastener holes 2104.4. In addition, the fitting 2104 includes a pair of anus 2104.3 for engaging channels of adjacent members (using fastener holes 2104.5).

Figure 16D:
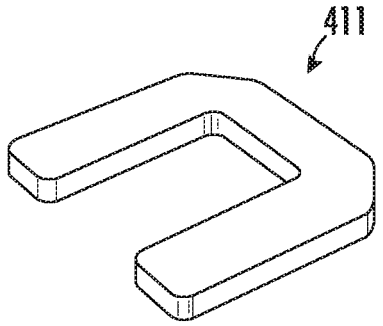
FIG. 16D is a perspective view of a spacer for securing struts of the containment system depicted in FIG. 1.
Figure 16E:
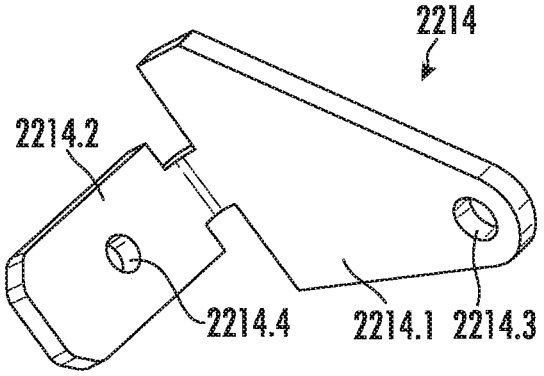
FIG. 16E is a perspective view of an upper hinge fitting of the containment system depicted in FIG. 1.

FIG. 16D illustrates a spacer 411 for adjusting heights of adjacent members (due to uneven or sloping floors or other reasons). For example, the spacer 411 can be used with fitting 401 where one or more spacers 411 are disposed between the fitting 401 and one of the members. In such an arrangement, a fastener could pass through the hole 405 of the fitting 401 through the one or more spacers 411 before engaging hole 103 of the respective member. As one example, as shown in FIG. 22B, a fastener 406 may pass through hole 405 of fitting 401 and through three spacers 411 before engaging hole 103 of vertical side member 1208. In addition, as shown in FIG. 22C, at least one spacer 411 may be used to vertically offset adjacent panels.

To reliably arrange containment system 100, a user should keep each and every sub-assembly as close to vertical (plumb) as practically possible. However, the floor which the sub-assemblies sit on, and the ceiling up to which the sub-assemblies reach are not necessarily flat or parallel throughout. Often, floors will not be absolutely level, which is particularly the near walls. Ceilings (particularly suspended ceilings) are not necessarily level across the entire expanse. Accordingly, if adjacent panels are merely directly attached to one another (without accounting for variances in the vertical direction), assembly and installation will cause portion of the sub-assemblies to be unsupported (i.e., a gap between part of the sub-assembly and the floor/ceiling) or pressed against a floor/ceiling with excessive force. In some situations, forcing sub-assemblies into such arrangements subjects the subassembly to forces that would tend to distort the sub-assembly from a rectangular shape to a parallelogram shape. In some examples, to address these issues (i.e., to avoid subjecting the sub-assemblies to distorting and disorienting forces), adjacent sub-assemblies are staggered in the vertical direction. These considerations are particularly important for doors and door frames to ensure reliable mechanisms for opening/closing and for sealing. One option for addressing these issues is to include a fitting 401 with at least one spacer 411 at an interface between two adjacent panels.

Figure 16F:
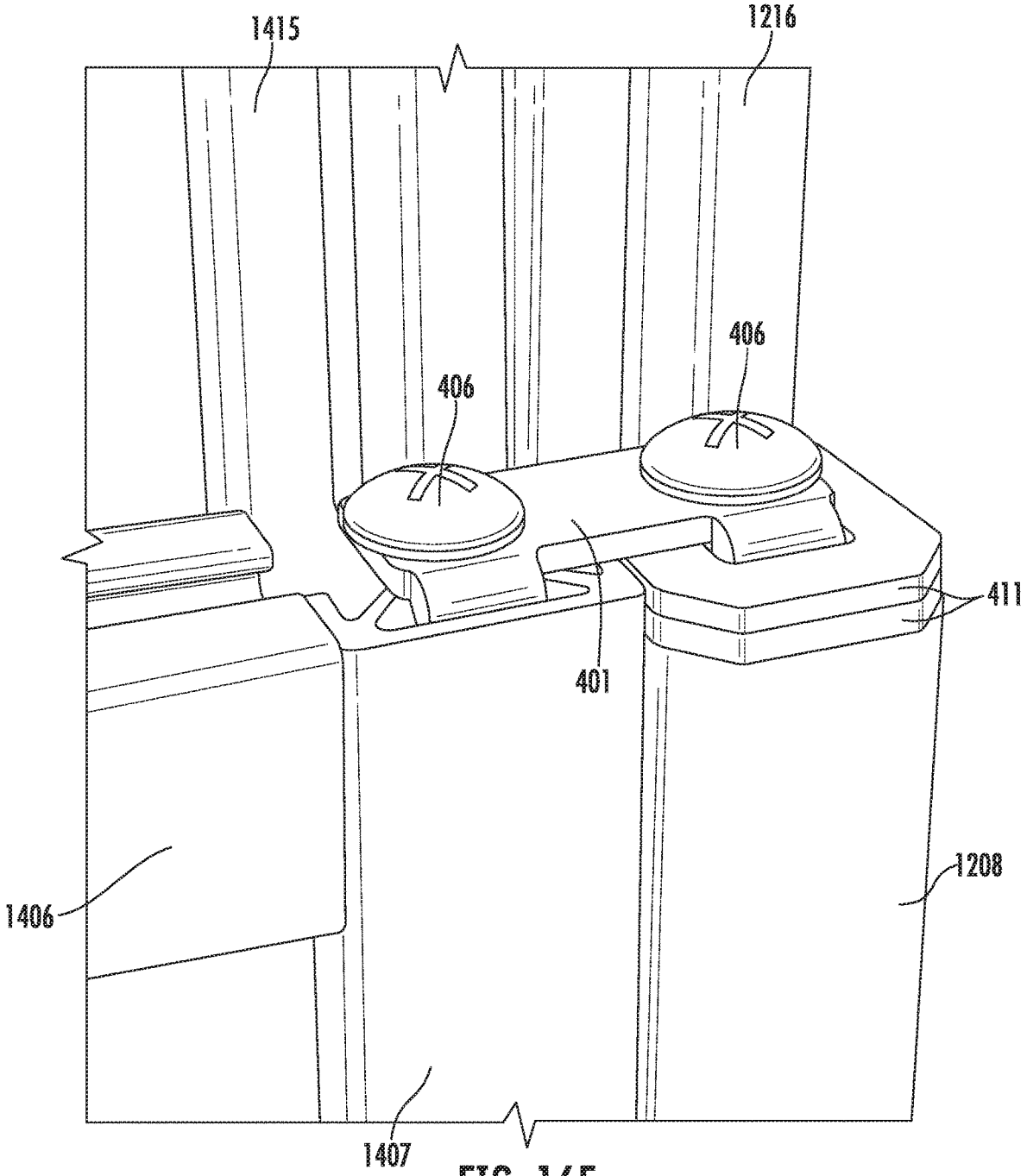
FIG. 16F is a perspective view of an assembly including two adjacent members in a staggered configuration of the containment system depicted in FIG. 1.

One example of adjacent panels that are configured to account for an uneven floor is shown in FIG. 16F. In this example, a wide panel assembly 140 and a narrow panel assembly 120 are attached to one another. In this case, the ground is sloped upward toward wide panel assembly 140 (i.e., wide panel assembly 140 sits on a higher portion of the floor). Fitting 401 is arranged to interface with the upper ends of vertical side member 1407 (of the lower assembly 1401) and vertical side member 1208 (of the lower assembly 1201). A fastener 406 passes through each hole 405 of fitting 401 and engages holes 103 of vertical side member 1407 and vertical side member 1208. As shown in FIG. 16F, two spacers 411 are inserted between vertical side member 1208 and fitting 401 such that after the fastener 406 passes through fitting 401, there is a gap (created by the two spacers 411) between fitting 401 and hole 103 of vertical side member 1208. Due to the two spacers 411, the bottom of vertical side member 1208 (and lower edge member 1205, which is not shown) is lower than the bottom of wide panel assembly 140. The sub-assemblies are designed such that variations in floor height along a given panel can be accommodated by moving/pivoting the bottom cover 108 and securing the bottom cover 108 using fasteners 113 and 114 (as described above) along with compressing flexible sealing portion 112. Combining the bottom cover 108, flexible sealing portion 112, and the ability to stagger adjacent panels using spacer(s) 411 ensures that the containment system 100 can be adapted to a wide range of floor and/or ceiling contours. Each spacer 411 may have a standard thickness, such as 3/16" or any other appropriate thickness. Although FIG. 16F shows two spacers 411, any number of spacers can be inserted to ensure the appropriate difference in height between the adjacent sub-assemblies. The spacers 411 may also be used to establish doorway threshold spacing and alignment, and set angle relationships between panel assemblies and corner assemblies.

Figure 16G:
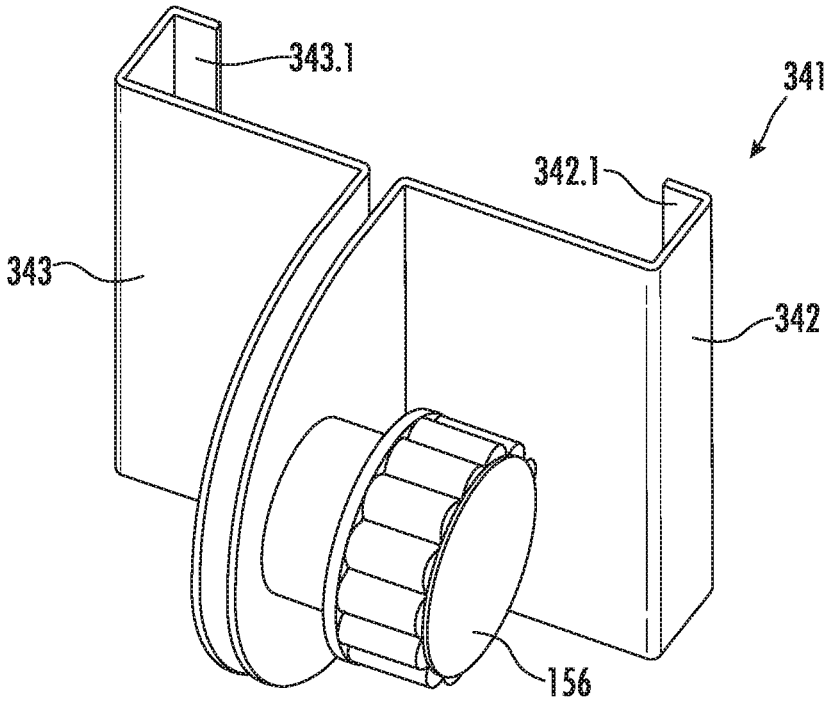
FIG. 16G is a perspective view of an adjacent member bracket assembly of the containment system depicted in FIG. 1.
Figure 16H:
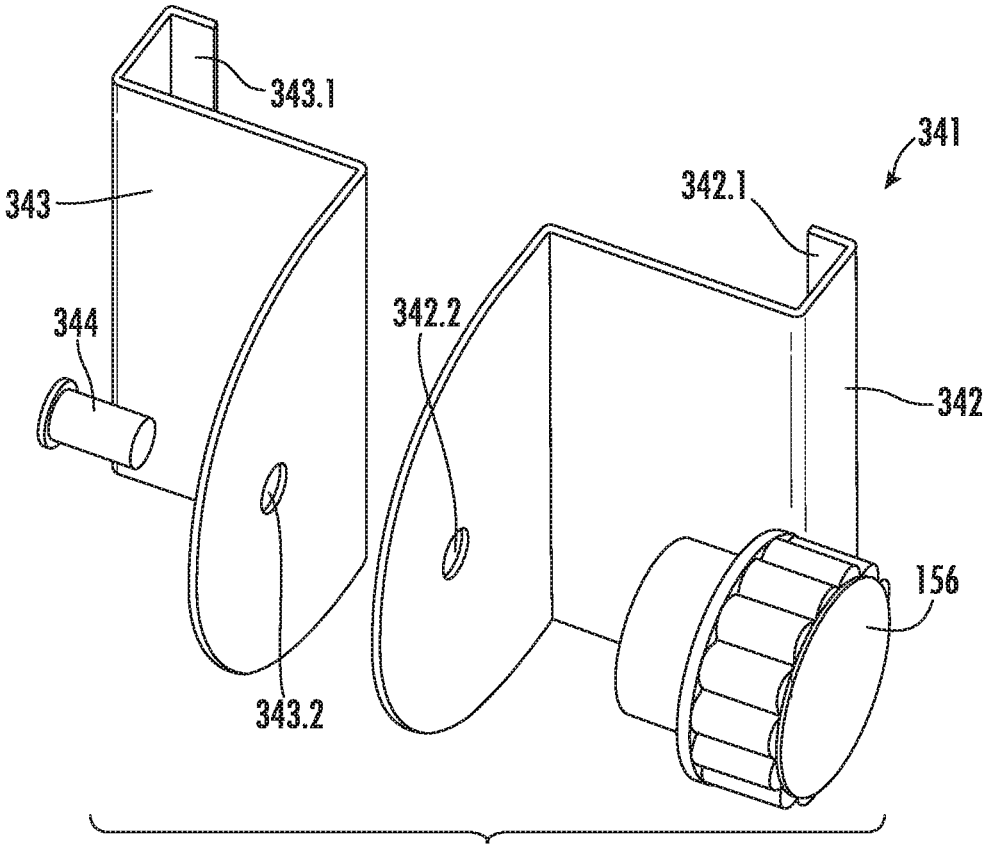
FIG. 16H is a perspective exploded view of the adjacent member bracket assembly of FIG. 16G.

Adjacent member bracket assembly 341 is shown in FIGS. 16G and 16H and includes two angle brackets 342, 343, a fastener 344, and a knob 156. In some examples, the two angles brackets 342, 343 are identical, although they need not be. The adjacent member bracket assembly 341 is one alternative for securing two adjacent parallel members together. For example, if a wide panel assembly 140 and a narrow panel assembly 120 are attached to one another, in some examples, vertical side member 1416 (of wide panel assembly 140) may be attached to vertical side member 1215 (of narrow panel assembly 120). One advantage of the adjacent member bracket assembly 341 is that the assembly can be installed without any disassembly of the containment system 100. Each angle bracket 342, 343 includes a lip 342.1, 343.1 that is inserted into a channel of the respective member. In particular, the lip 342.1, 343.1 may engage the channel that receives the window member. For example, to attach vertical side member 1416 and vertical side member 1215 as described above, lip 343.1 of bracket 343 would insert into the channel of vertical side member 1416 which also receives window member 1412. Similarly, lip 342.1 of bracket 342 would insert into the channel of vertical side member 1215 which also receives window member 1212. Once the lips 342.1, 343.1 engage the respective channels, the adjacent member bracket assembly 341 can be assembled (where fastener 344 passes through holes 342.2, 343.2 of the brackets 342, 343) and the knob 156 is tightened to pull the brackets 342, 343 toward one another.

Figure 17A:
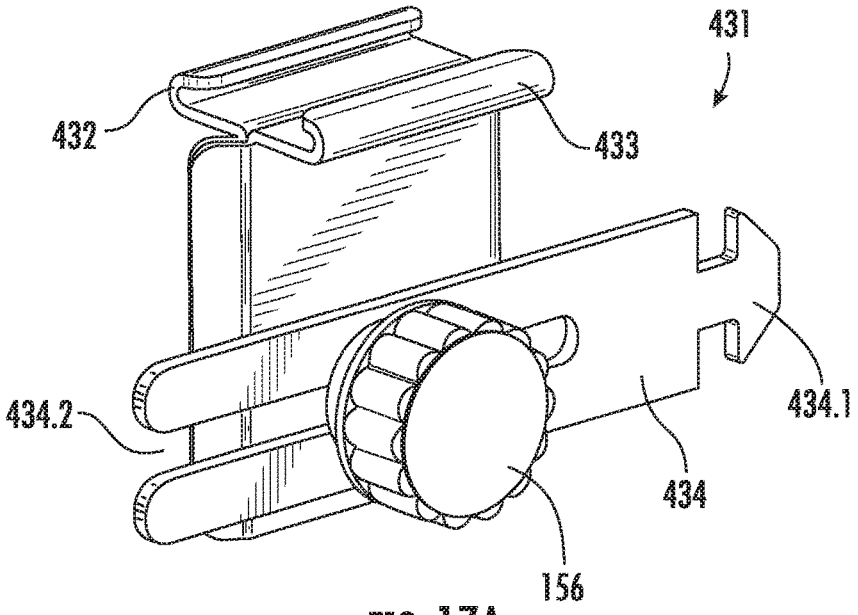
FIG. 17A is a perspective view of a ceiling bracket assembly of the containment system depicted in FIG. 1.
Figure 17B:
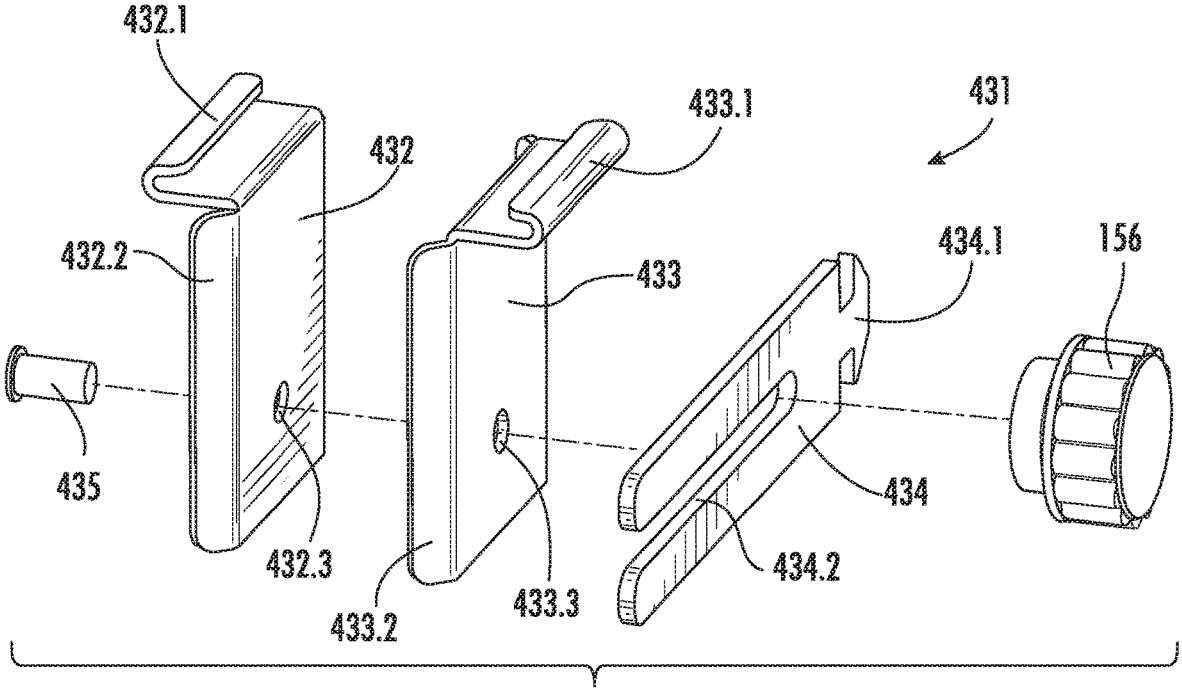
FIG. 17B is a perspective exploded view of the ceiling bracket assembly of FIG. 17A.

An exemplary ceiling bracket assembly 431 is shown in FIGS. 17A and 17B. The ceiling bracket assembly 431 includes a first vertical bracket 432, a second vertical bracket 433, and a horizontal bracket 434. Each of the vertical brackets 432, 433 includes an upper hook 432.1 and 433.1, respectively, for attaching to one or more features in a ceiling. The vertical brackets 432, 433 engage one another with respective angle portions 432.2 and 433.2 for aiding in alignment along with common holes 432.3 and 433.3 such that a fastener 435 extends through holes 432.3 and 433.3. The fastener 435 also passes through elongated slot 434.2 of horizontal bracket 434 before engaging knob 156. Tightening the knob 156 onto the shaft of fastener 435 (1) pulls the vertical brackets 432, 433 closer together thus tightening the upper hooks 432.1, 433.1 about a ceiling feature and (2) locks the fastener 435 (along with vertical brackets 432, 433) into a position along the elongated slot 434.2 of horizontal bracket 434. In some embodiments, in lieu of or in addition to the upper hooks 432.1, 433.1, the ceiling bracket assembly 431 may include features for attaching to a drywall ceiling (such as holes or other appropriate features). An engagement portion 434.1 of the horizontal bracket 434 engages a member of the containment system 100. For example, the engagement portion 434.1 may be inserted into a channel of an upper edge member (e.g., upper edge member 1414 or upper edge member 1214). The engagement portion 434.1 may include tolerances such that the engagement portion 434.1 may be angled within a channel.

Figure 18A:
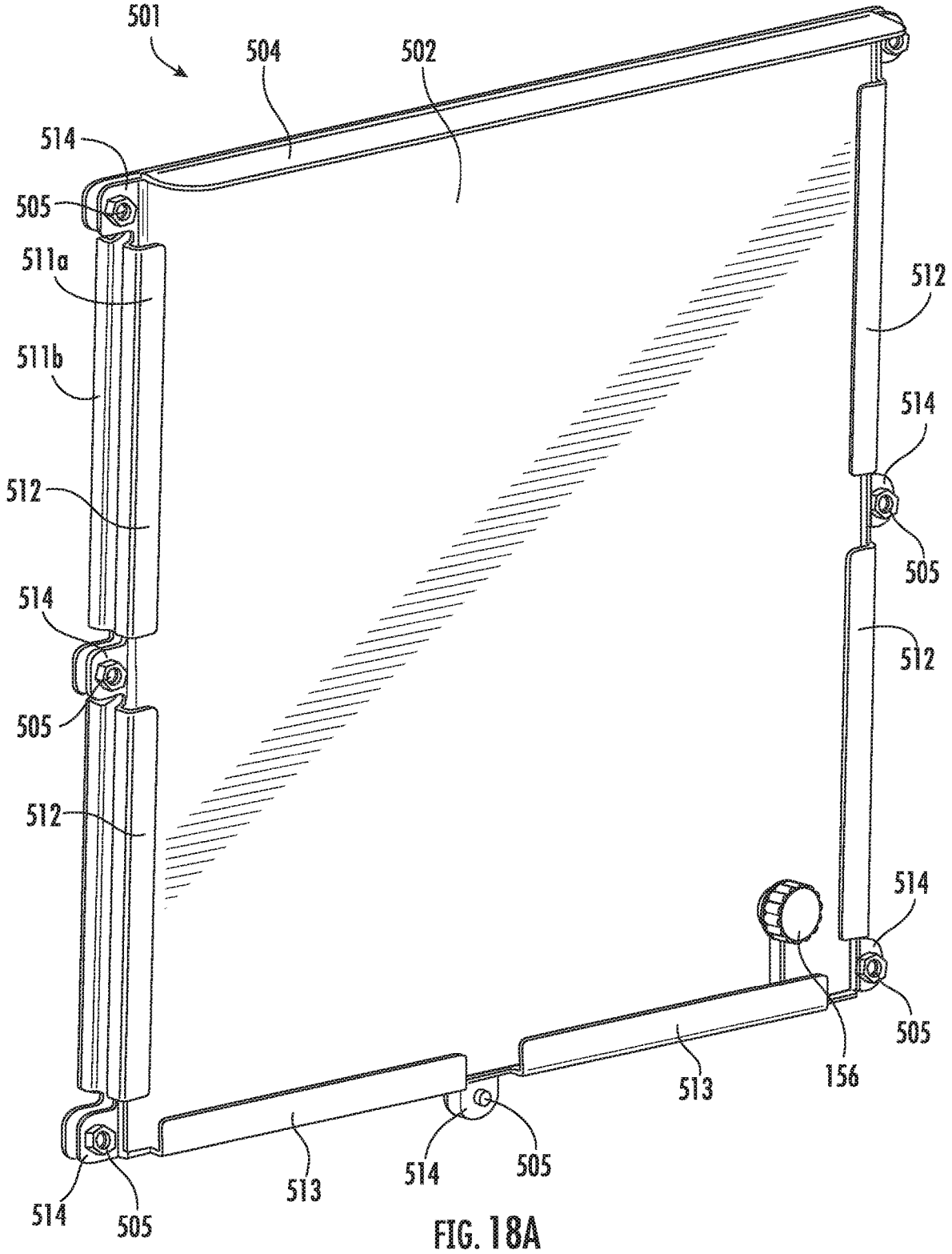
FIG. 18A is an interior side perspective view of an exhaust panel assembly of the containment system depicted in FIG. 1.
Figure 18B:
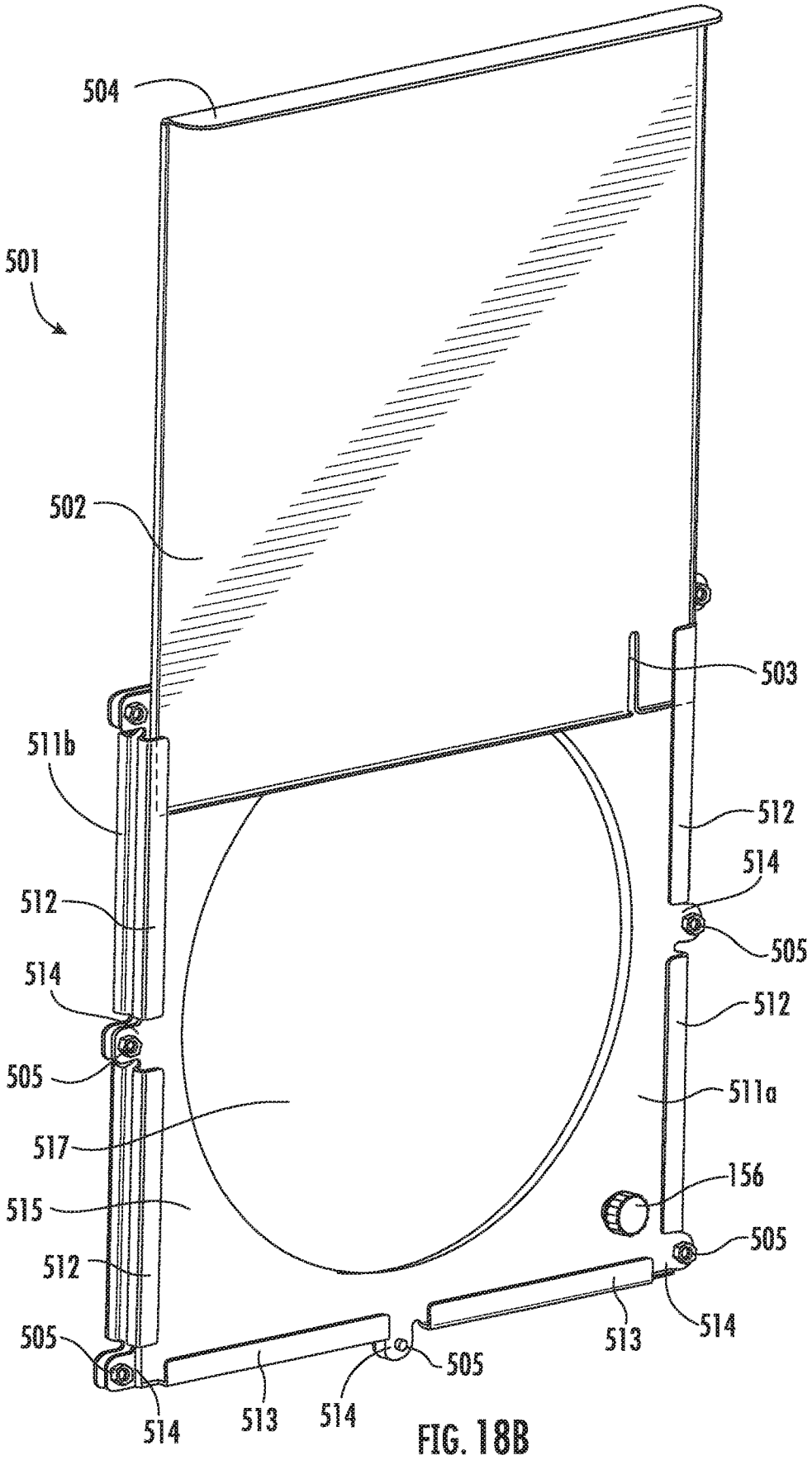
FIG. 18B is an interior side perspective view of the exhaust panel assembly of FIG. 18A in an open configuration.
Figure 18C:
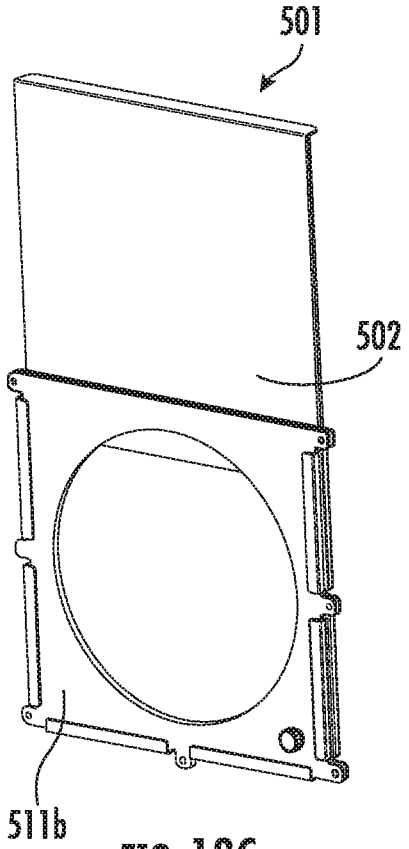
FIG. 18C is an exterior side perspective view of the exhaust panel assembly of FIG. 18B.

FIGS. 18A-18H illustrate various components of the exhaust panel assembly 501. As shown in FIGS. 18A-18C, the exhaust panel assembly 501 may include an interior panel 511*a*, an exterior panel 511*b*, and plurality of fasteners 505. The exhaust panel assembly 501 may be located in a panel assembly as part of a lower assembly or an upper assembly and is compatible with any width panel assembly. As shown in FIGS. 18A-18C, 18G, and 18H, the exhaust panel assembly 501 may also include replaceable panels such as, for example, cover plate 502, large adapter plate 531, or small adapter plate 541. The exhaust panel assembly 501 may be a component of the containment system 100 such that the exhaust panel assembly 501 is attached to one of the window members (e.g., 1202, 1203, 1212, 1402, 1403, 1412, etc.). In some examples, the interior panel 511*a* is attached to an interior side of the window member and the exterior panel 511*b* is attached to an exterior side of the window member with fasteners 505 passing through the window member. In some examples, the window member includes a hole that corresponds to the hole 517 of the interior panel 511*a*. In some examples, the hole in the window member may be smaller or larger than hole 517 but leaves room for attachment of fasteners 505 to the window member. Although interior panel 511*a* and exterior panel 511*b* are illustrated as duplicates of one another, in some examples, these components are different from one another.

The interior panel 511*a* (shown in FIGS. 18A and 18B) includes at least one vertical channel 512 and at least one horizontal channel 513 for interfacing with replaceable panels. In addition, the interior panel 511*a* includes a plurality of tabs 514 for engaging fasteners 505, a first face 515, a second face 516, and a hole 517. As one example of a replaceable panel, cover plate 502 is shown in a closed configuration in FIG. 18A and in an open configuration in FIG. 18B. In the closed configuration, the lateral edges of the cover plate 502 are engaged in the vertical channels 512 and the lower edge of the cover plate 502 is engaged in the horizontal channels 513. A knob 156 may be threaded onto a fastener (not shown) attached to interior panel 511*a* such that the fastener and the knob 156 extend through the slot 503 of the cover plate 502 and the knob 156 can secure the cover plate 502 in the closed configuration. FIGS. 18A and 18B show an example where the cover plate 502 is capable of sliding away from the closed configuration through vertical channels 512. The cover plate 502 may include an upper tab 504 to increase stiffness of the cover plate 502 and to allow a user to grip the cover plate 502 to facilitate sliding relative to the interior panel 511*a*. Other arrangements (e.g., non-sliding) are possible, such as at least one latch for removing the replaceable panel, a pivoting arrangement, or any other appropriate arrangement.

FIG. 18C is an exterior perspective view showing exterior panel 511*b*. In some examples (as shown in the drawings), exterior panel 511*b* is a duplicate of interior panel 511*a*, although it need not be. Thus, the components of exterior panel 511*b* are not described herein.

Figure 18D:
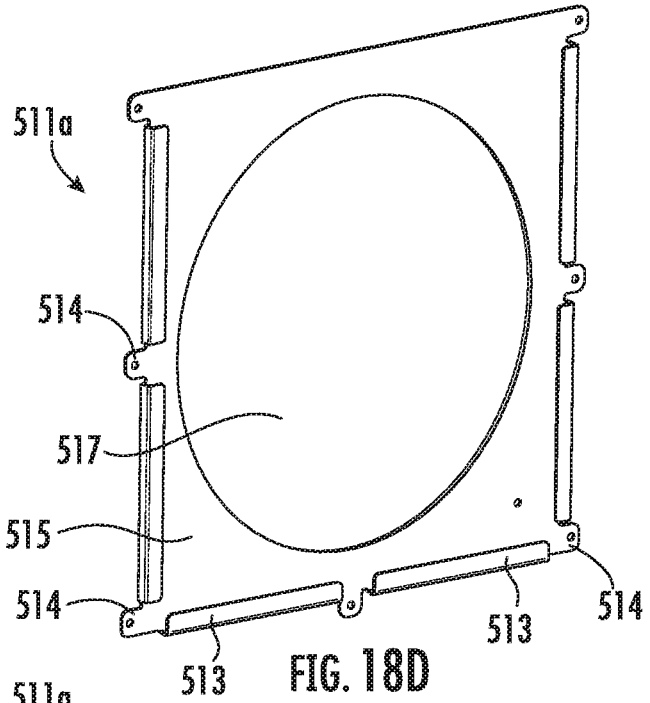
FIGS. 18D and 18E are perspective views of an interior panel of the exhaust panel assembly of FIG. 18A.
Figure 18E:
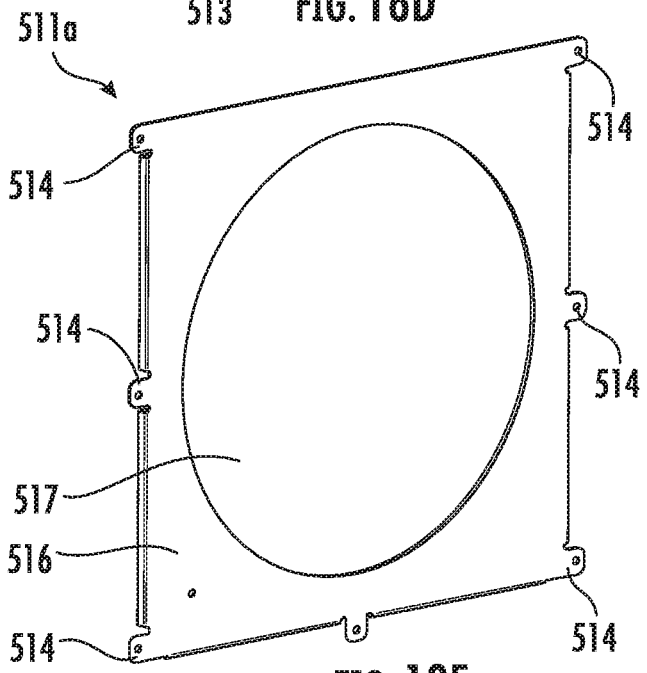
Figure 18F:
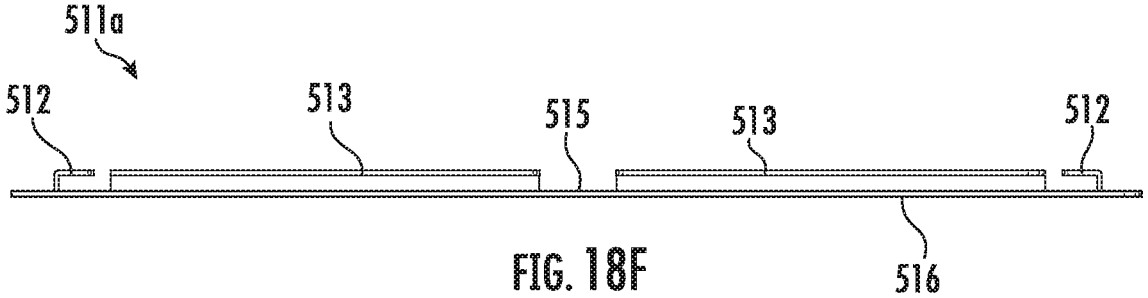
FIG. 18F is a top view of the interior panel of FIG. 18D.

FIGS. 18D-18F show the interior panel 511*a* such that the vertical channel(s) 512 and horizontal channel(s) 513 extend from the first face 515 and the second face 516 is approximately flat or planer (for facilitating attachment to the adjacent window member).

Although FIGS. 18A-18C illustrate a single cover plate 502 on the interior side of the exhaust panel assembly 501, an additional cover plate 502 may be attached to exterior panel 511*b* to ensure an effective seal between the interior and exterior of the containment system 100.

One or both of the interior panel 511*a* and the exterior panel 511*b* may attach (e.g., via vertical channel(s) 512 and/or horizontal channel(s) 513) to a ducting attachment plate (e.g., large adapter plate 531, small adapter plate 541, or any other appropriate size, such as a 10" plate). A ducting attachment plate allows an air filtration unit (not shown) to communicate (via ducting) with the interior (containment area) of the containment system 100. The air filtration unit helps capture and filter hazardous and/or non-hazardous particulate, biological, and gas phase contaminants present within the interior of the containment system 100. In some examples, air filtration unit may have the ability to create negative air pressure in the interior (containment area) of the containment system 100. One non-limiting example of an air filtration unit is the HEPA-AIRE® PAS600 Portable Air Sembber offered by Abatement Technologies.

Figure 18G:
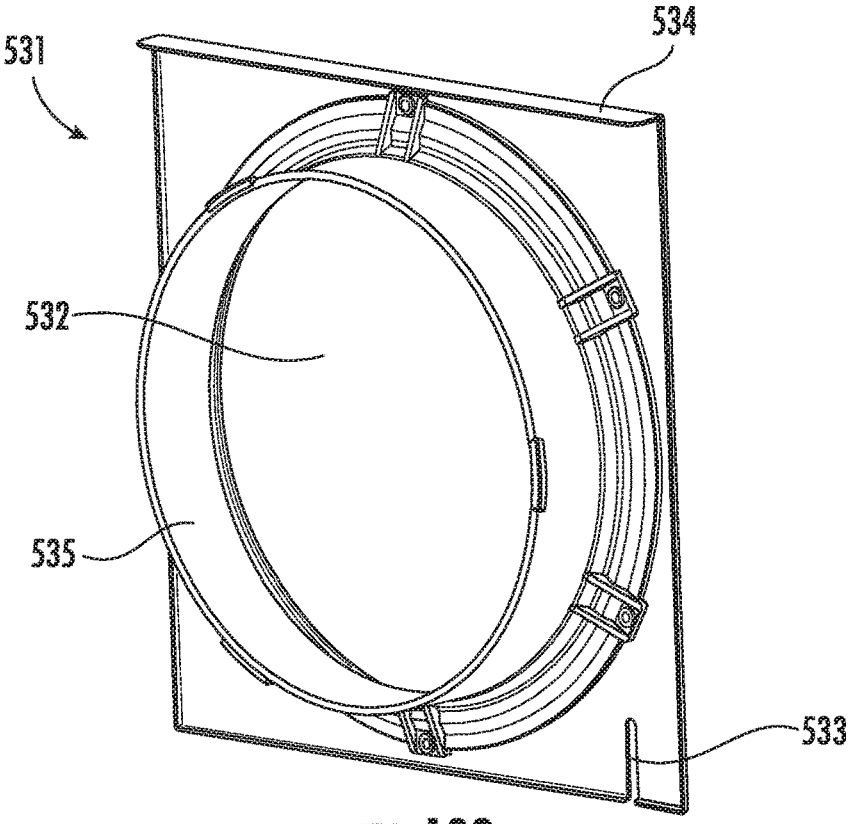
FIGS. 18G and 18H are perspective views of adapter plates of the exhaust panel assembly of FIG. 18A.

FIG. 18G illustrates one example of a large adapter plate 531. The large adapter plate 531 may include, for example, a 12" adapter or any other appropriate size, and may include a hole 532 with a flange 535 (with a standard size to accommodate industry standard ducting) and a slot 533 (similar to slot 503 of the cover plate 502) for engaging a fastener and knob 156 to secure the large adapter plate 531 in a closed configuration. The large adapter plate 531 may also include an upper tab 534 (similar to the upper tab 504 of the cover plate 502) to increase stiffness of the large adapter plate 531 and to allow a user to grip the large adapter plate 531 to facilitate sliding relative to the interior panel 511*a* (or exterior panel 511*b*).

Figure 18H:
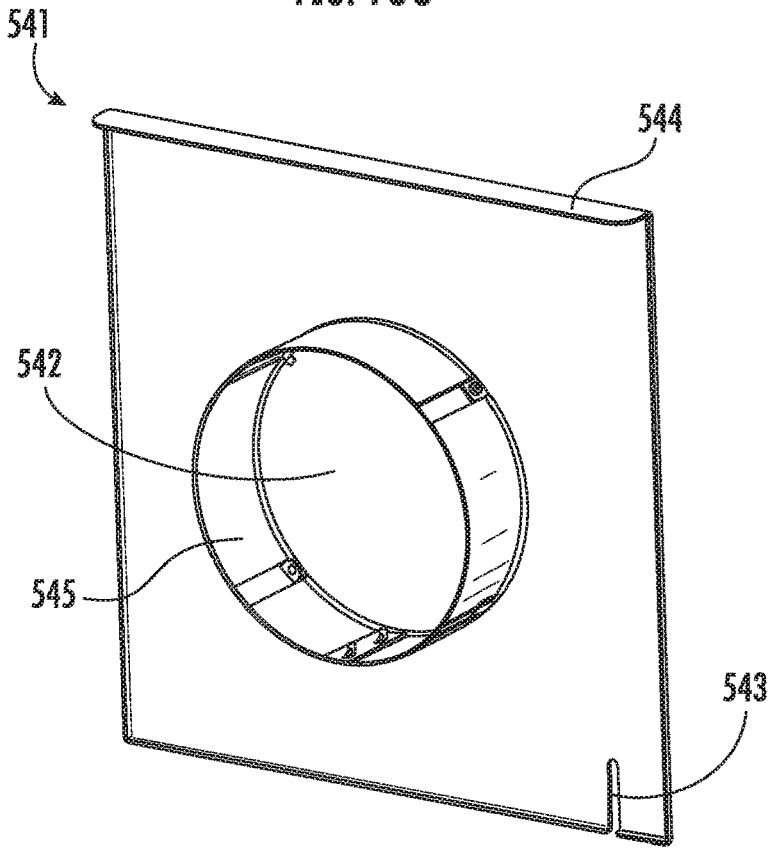

FIG. 18H illustrates one example of a small adapter plate 541. The small adapter plate 541 small adapter plate 541 may include, for example, a 8" adapter or any other appropriate size, and may include a hole 542 with a flange 545 (with a standard size to accommodate industry standard ducting) and a slot 543 (similar to slot 503 of the cover plate 502) for engaging a fastener and knob 156 to secure the small adapter plate 541 in a closed configuration. The small adapter plate 541 may also include an upper tab 544 (similar to the upper tab 504 of the cover plate 502) to increase stiffness of the small adapter plate 541 and to allow a user to grip the small adapter plate 541 to facilitate sliding relative to the interior panel 511*a* (or exterior panel 511*b*).

Figure 18J:
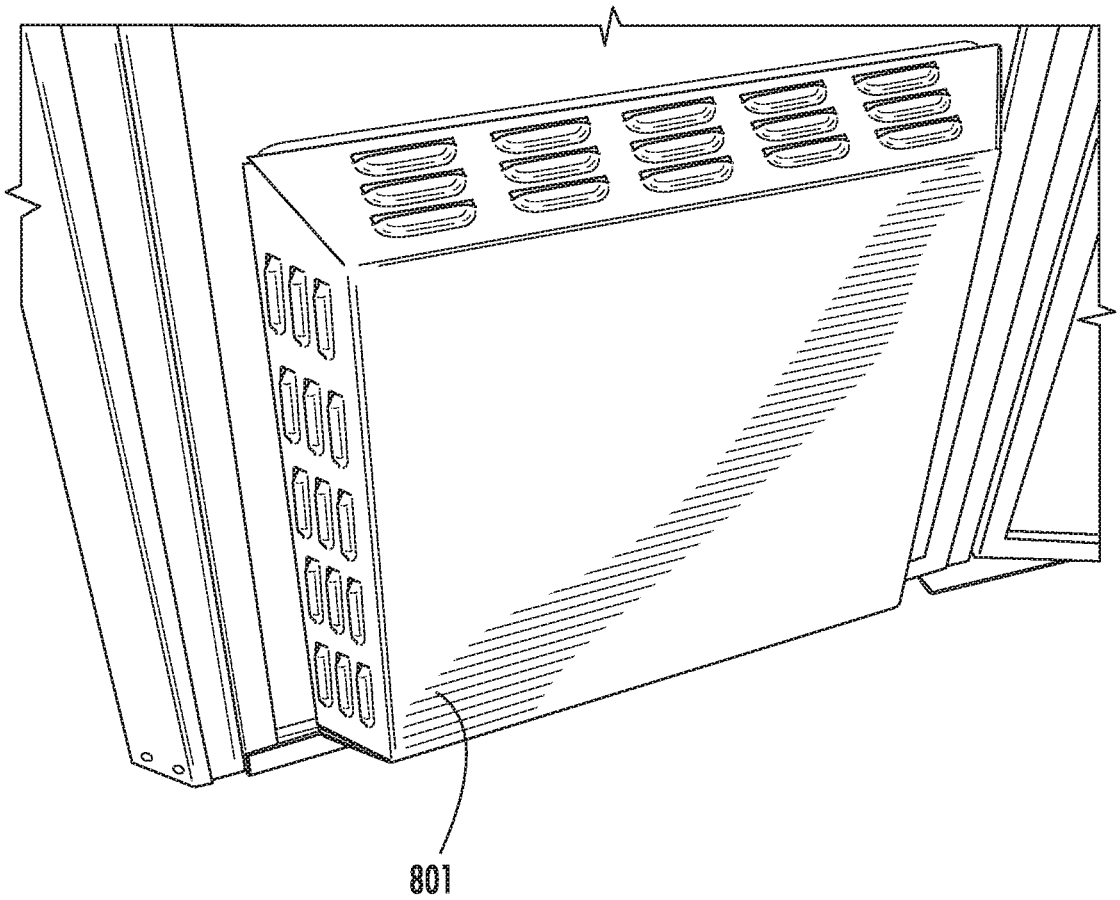
FIG. 18J is a diffuser of the exhaust panel assembly of FIG. 18A.

As shown in FIG. 18J, the exhaust panel assembly 501 may include a diffuser 801 acting as a baffle such that the air flowing through the exhaust panel assembly 501 is not expelled in a single direction. The diffuser 801 may also include a filter.

Figure 19A:
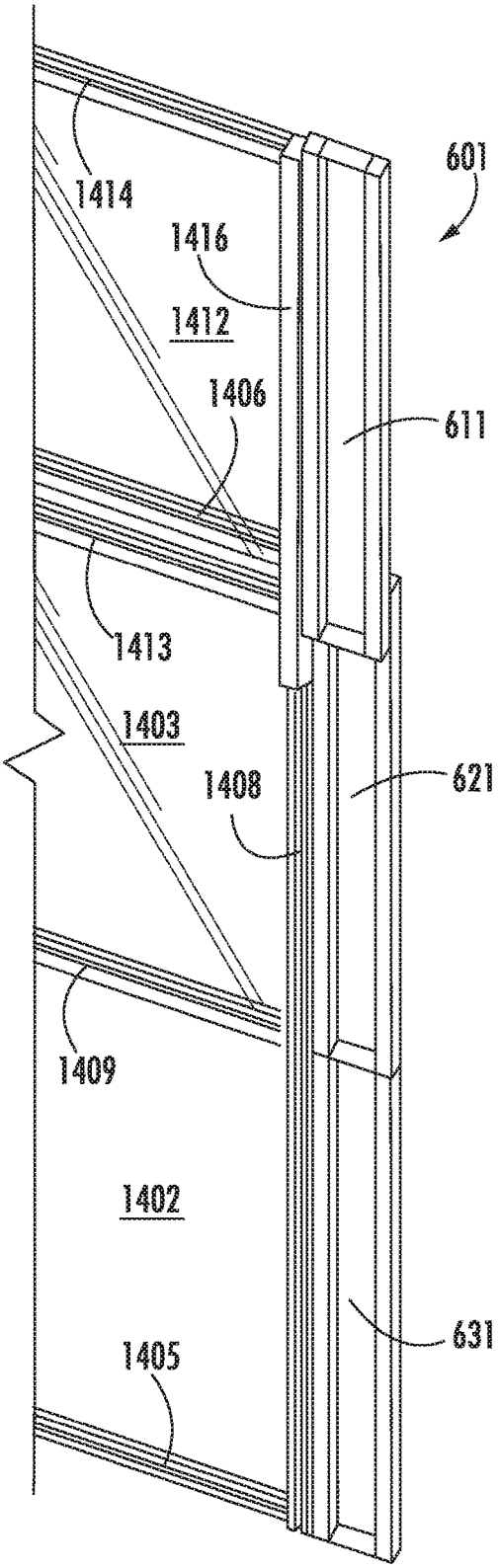
FIG. 19A is an interior perspective view of a wall seal assembly of the containment system depicted in FIG. 1.

One example of a wall seal assembly 601 is shown in FIGS. 19A-19D. The wall seal assembly 601 may be attached to an edge of a portion of the containment system 100. As one example, as shown in FIG. 19A, the wall seal assembly 601 may be attached to an edge of wide panel assembly 140. In some examples, the wall seal assembly 601 includes an upper seal assembly 611 that attaches to upper assembly 1411 of wide panel assembly 140. The wall seal assembly 601 also includes at least one lower seal assembly (621, 631) that attaches to lower assembly 1401 of wide panel assembly 140. In some examples, a first lower seal assembly 621 attaches to the portion of lower assembly 1401 above horizontal cross brace 1409 and a second lower seal assembly 631 attaches to the portion of lower assembly 1401 below horizontal cross brace 1409 where the first lower seal assembly 621 and the second lower seal assembly 631 are similar to one another. In other examples, the first lower seal assembly 621 and the second lower seal assembly 631 have different structures. In still other examples, a single lower seal assembly extends the full height of lower assembly 1401.

Figure 19B:
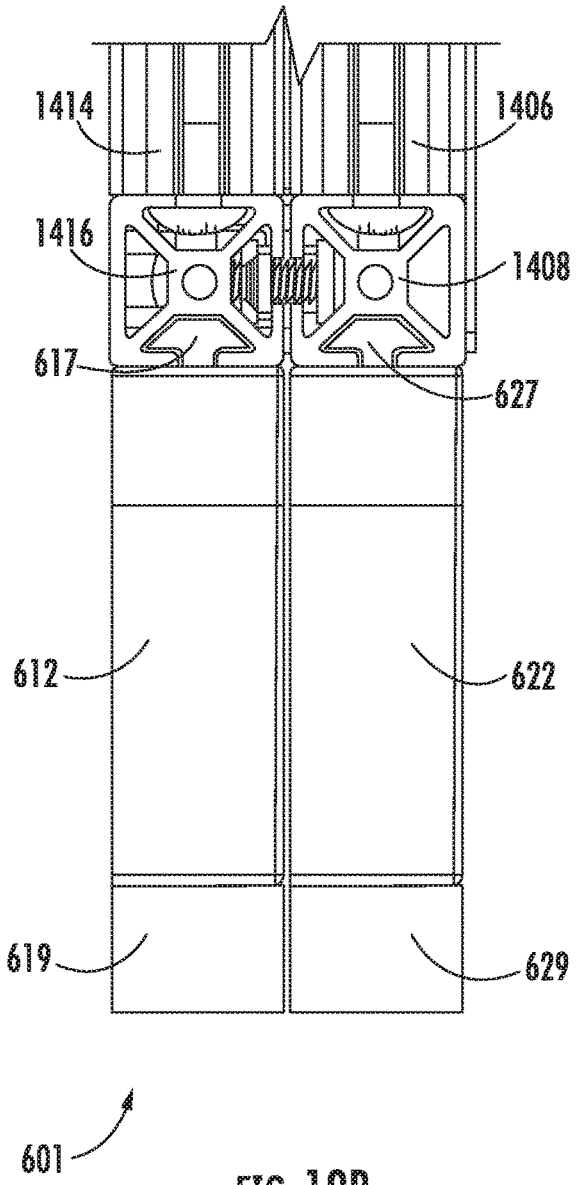
FIG. 19B is a top view of the wall seal assembly of FIG. 19A.
Figure 19C:
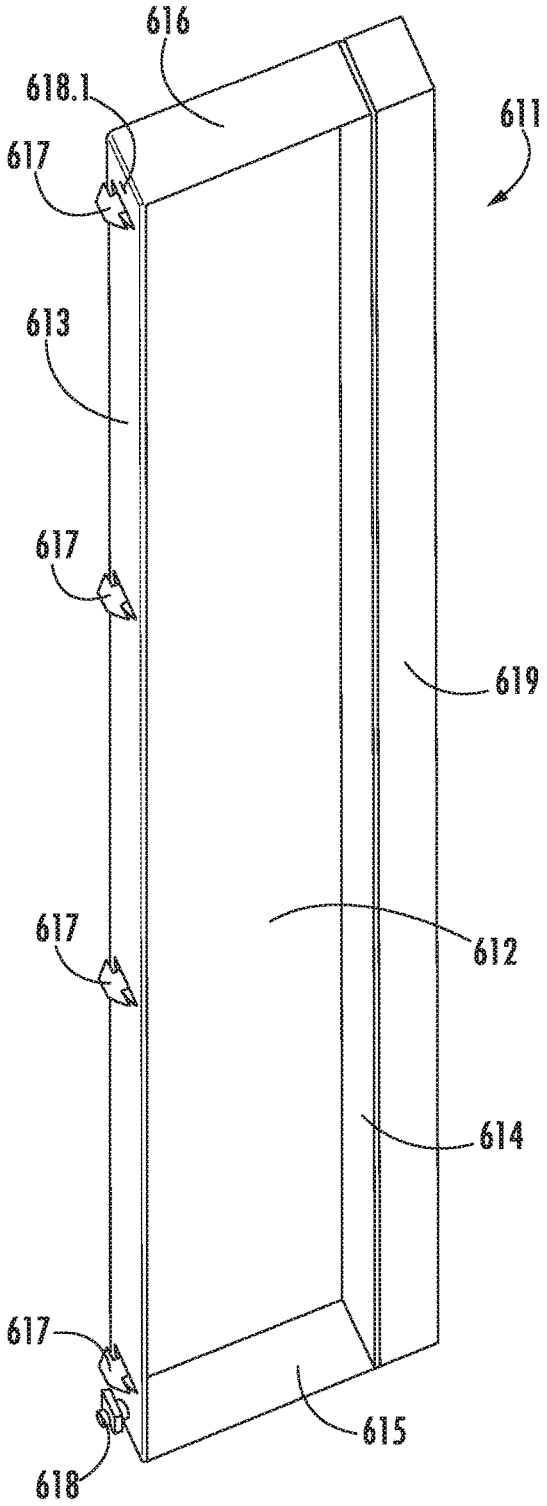
FIG. 19C is an interior perspective view of an upper seal assembly of the wall seal assembly of FIG. 19A.

As shown in FIGS. 19B and 19C, the upper seal assembly 611 may include an extension panel 612 and a compressible member 619. The extension panel 612 may include an inner wall 613, an outer wall 614, a lower wall 615, and an upper wall 616. The inner wall 613 may include a plurality of bent tabs 617 that engage a channel of the adjacent member of the upper assembly 1411 such that the upper seal assembly 611 is slideably engaged with the upper assembly 1411. As shown in FIG. 19B, bent tabs 617 are inserted into a channel of vertical side member 1416. The bent tabs 617 are each a portion of inner wall 613 that is bent to a deployed configuration that is approximately perpendicular to the surface of inner wall 613. The inner wall 613 may also include at least one securing member 618 that attaches to a hole 618.1 of the inner wall 613 and engages the channel of the vertical side member 1416 to prevent sliding along the length of vertical side member 1416. In other words, once the upper seal assembly 611 is moved to a desired location relative to the upper assembly 1411, the at least one securing member 618 is activated to secure the upper seal assembly 611 relative to vertical side member 1416. In some examples, the securing member 618 is a fastener and a nut, a clamp, or any other appropriate object for securing the upper seal assembly 611. The upper seal assembly 611 may be arranged such that the compressible member 619 may be pressed against a wall or other object adjacent to the containment system 100. The upper seal assembly 611 may have a standard width (defined by the length of lower wall 615 and upper wall 616) and/or may be available in a number of standard sizes (e.g., 3", 6", 9", or any other appropriate width) to accommodate various arrangements for the containment system 100.

Figure 19D:
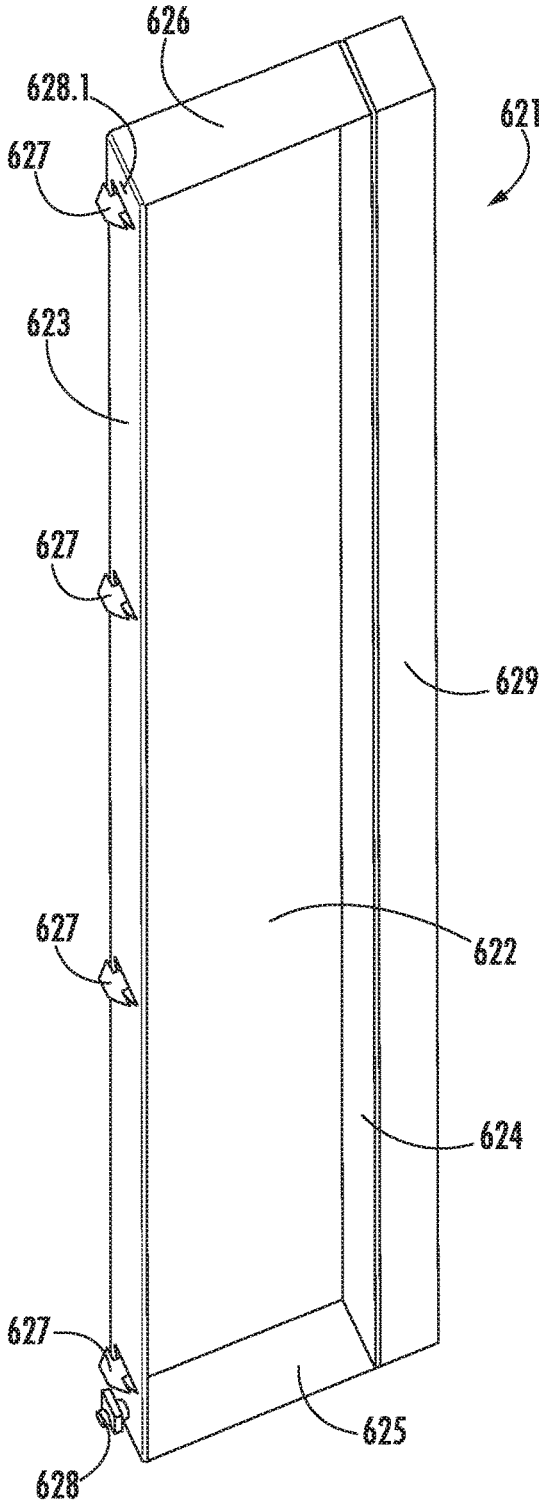
FIG. 19D is an interior perspective view of a lower seal assembly of the wall seal assembly of FIG. 19A.

As shown in FIGS. 19B and 19D, the first lower seal assembly 621 may include an extension panel 622 and a compressible member 629. The extension panel 622 may include an inner wall 623, an outer wall 624, a lower wall 625, and an upper wall 626. The inner wall 623 may include a plurality of bent tabs 627 that engage a channel of the adjacent member of the lower assembly 1401 such that the first lower seal assembly 621 is slideably engaged with the lower assembly 1401. As shown in FIG. 19B, bent tabs 627 are inserted into a channel of vertical side member 1408. The inner wall 623 may also include at least one securing member 628 that attaches to a hole 628.1 of the inner wall 623 and engages the channel of the vertical side member 1408 to prevent sliding along the length of vertical side member 1408. In other words, once the first lower seal assembly 621 is moved to a desired location relative to the lower assembly 1401, the at least one securing member 628 is activated to secure the first lower seal assembly 621 relative to vertical side member 1408. In some examples, the securing member 628 is a fastener and nut, a clamp, or any other appropriate object for securing the first lower seal assembly 621. The first lower seal assembly 621 may be arranged such that the compressible member 629 may be pressed against a wall or other object adjacent to the containment system 100. The first lower seal assembly 621 may have a standard width (defined by the length of lower wall 625 and upper wall 626) and/or may be available in a number of standard sizes (e.g., 3", 6", 9", or any other appropriate width) to accommodate various arrangements for the containment system 100. In the illustrated examples, the second lower seal assembly 631 has a similar structure to that of the first lower seal assembly 621 and thus is not illustrated in detail. In some examples, the first lower seal assembly 621 and the second lower seal assembly 631 are replaced by one lower seal assembly, which has a length that is approximately twice that of the first lower seal assembly 621 (defined by the length of the inner wall 623 and the outer wall 624).

Figure 20:
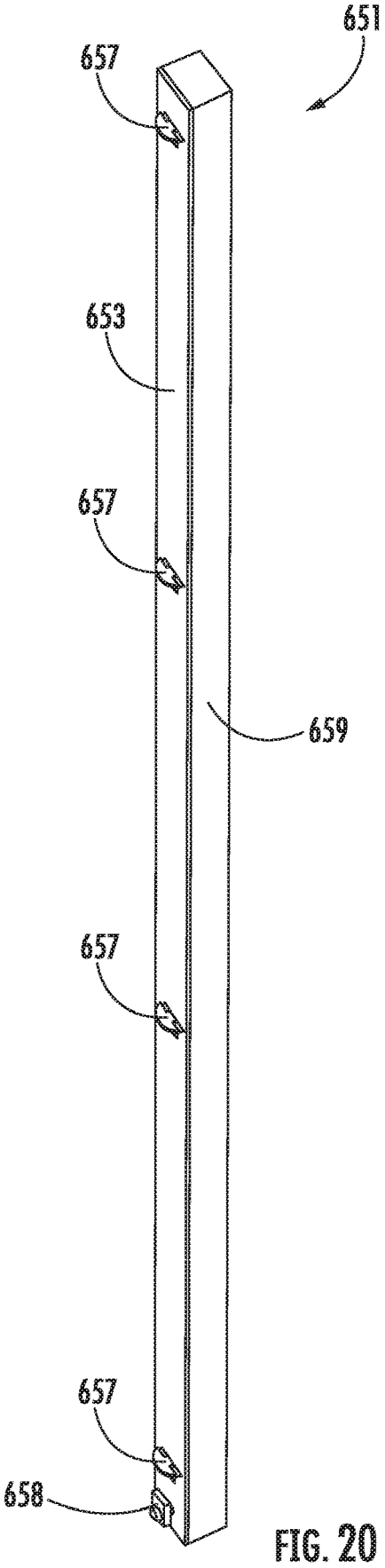
FIG. 20 is a perspective view of a low profile wall seal assembly of the containment system depicted in FIG. 1.

In some examples, where a minimum width is needed to reach an adjacent object (e.g., a wall), a low profile wall seal assembly 651 includes a flat backing panel 653 that replaces the extension panel (e.g., 612, 622), where the flat backing panel 653 directly attaches to a compressible member 659. As shown in FIG. 20, the flat backing panel 653 includes a plurality of bent tabs 657 and at least one securing member 658 and attaches to an adjacent member in a similar manner as the upper seal assembly 611 or the first lower seal assembly 621. In some examples, at least one low profile wall seal assembly 651 seals the upper assembly of the adjacent panel (e.g., upper assembly 1411) and at least one low profile wall seal assembly 651 seals the lower assembly of the adjacent panel (e.g., lower assembly 1401).

One example of a wall seal assembly 701 is shown in FIGS. 21A-21D. The wall seal assembly 701 may be attached to an edge of a portion of the containment system 100. As one example, the wall seal assembly 701 may be attached to an edge of wide panel assembly 140. In some examples, the wall seal assembly 701 includes an upper seal member 711 that attaches to upper assembly 1411 of wide panel assembly 140. The wall seal assembly 701 also includes at least one lower seal member (721, 731) that attaches to lower assembly 1401 of wide panel assembly 140. In some examples a first lower seal member 721 attaches to the portion of lower assembly 1401 above horizontal cross brace 1409 and a second lower seal member 731 attaches to the portion of lower assembly 1401 below horizontal cross brace 1409 where the first lower seal member 721 and the second lower seal member 731 are similar to one another. In other examples, the first lower seal member 721 and the second lower seal member 731 have different structures. In still other examples, a single lower seal member extends the full height of lower assembly 1401.

As shown in FIGS. 21A-21F, the upper seal member 711 has an "L" cross-section and includes a flange outer surface 712, a flange inner surface 713, and a member interface surface 714. The member interface surface 714 may include a plurality of bent tabs 717 for interfacing with a channel of an adjacent member (e.g., vertical side member 1416 of the upper assembly 1411). The bent tabs 717 are shown in a retracted configuration (parallel to member interface surface 714) in FIGS. 21A-21C. As shown in the top view in FIG. 21B, the upper seal member 711 includes an offset bend such that the upper seal member 711 does not interfere with the first lower seal member 721 in an area where the upper and lower assemblies overlap one another (such as upper assembly 1411 and lower assembly 1401).

Figure 21A:
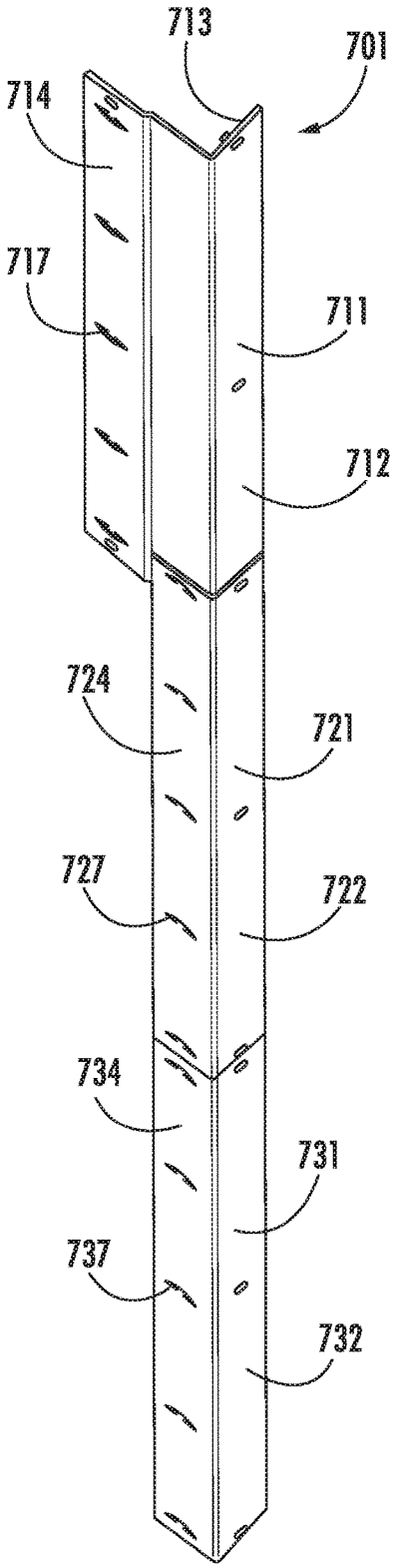
FIG. 21A is a perspective view of a wall seal assembly of the containment system depicted in FIG. 1.
Figure 21B:
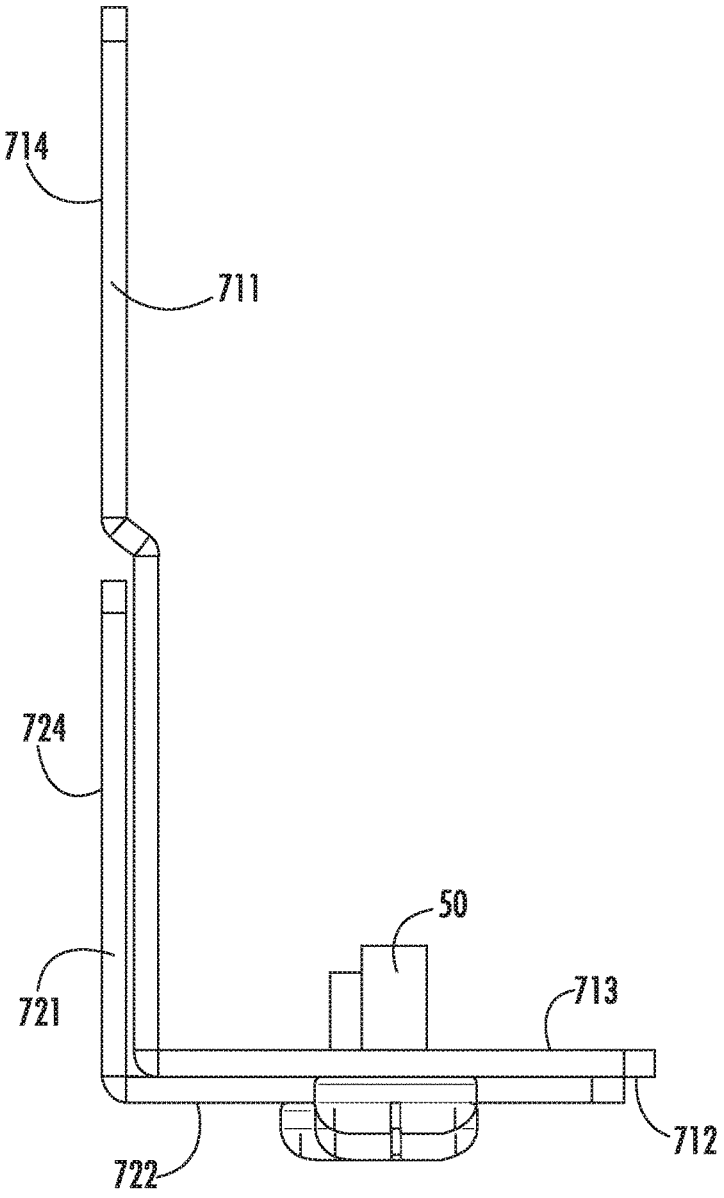
FIG. 21B is a top view of the wall seal assembly of FIG. 21A.
Figure 21C:
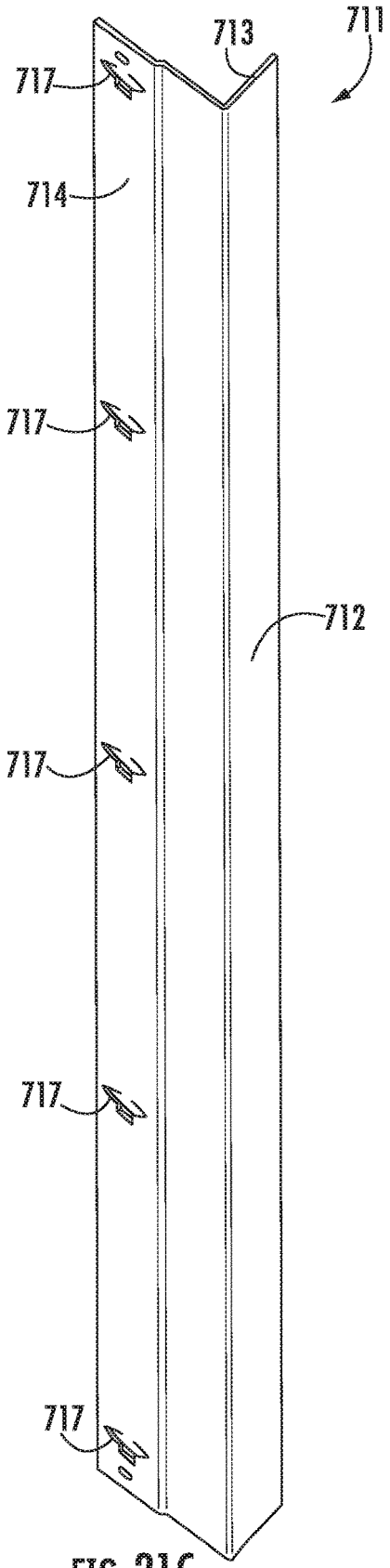
FIG. 21C is a perspective view of an upper seal member of the wall seal assembly of FIG. 21A.
Figure 21D:
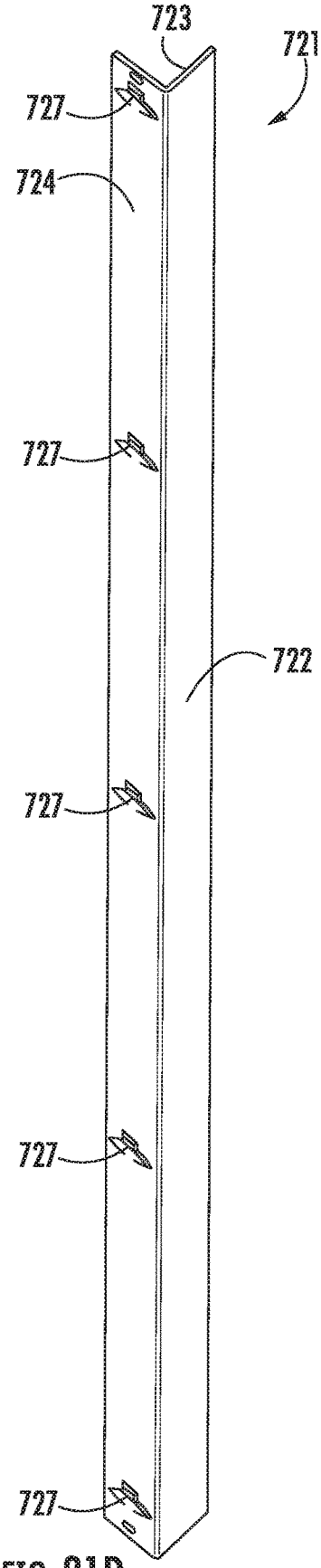
FIG. 21D is a perspective view of a lower seal member of the wall seal assembly of FIG. 21A.

As shown in FIGS. 21A, 21B, and 21D, the first lower seal member 721 has an "L" cross-section and includes a flange outer surface 722, a flange inner surface 723, and a member interface surface 724. The member interface surface 724 may include a plurality of bent tabs 727 for interfacing with a channel of an adjacent member (e.g., vertical side member 1408 of the lower assembly 1401). The bent tabs 727 are shown in a retracted configuration (parallel to member interface surface 724) in FIGS. 21A, 21B, and 21D.

In the illustrated examples, the second lower seal member 731 has a similar structure to that of the first lower seal member 721 and thus is not illustrated in detail. In some examples, the first lower seal member 721 and the second lower seal member 731 are replaced by one lower seal member, which has a length that is approximately twice that of the first lower seal member 721.

Figure 21E:
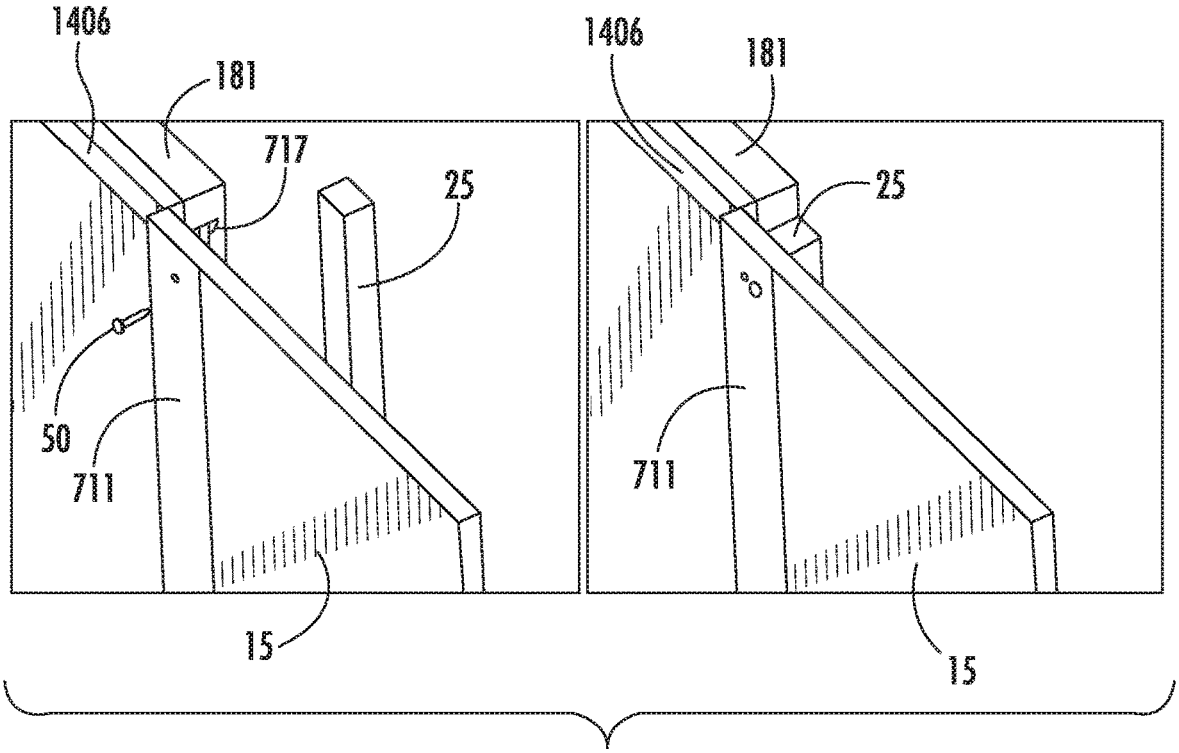
FIG. 21E is a partial perspective view of the wall seal assembly of FIG. 21A.
Figure 21F:
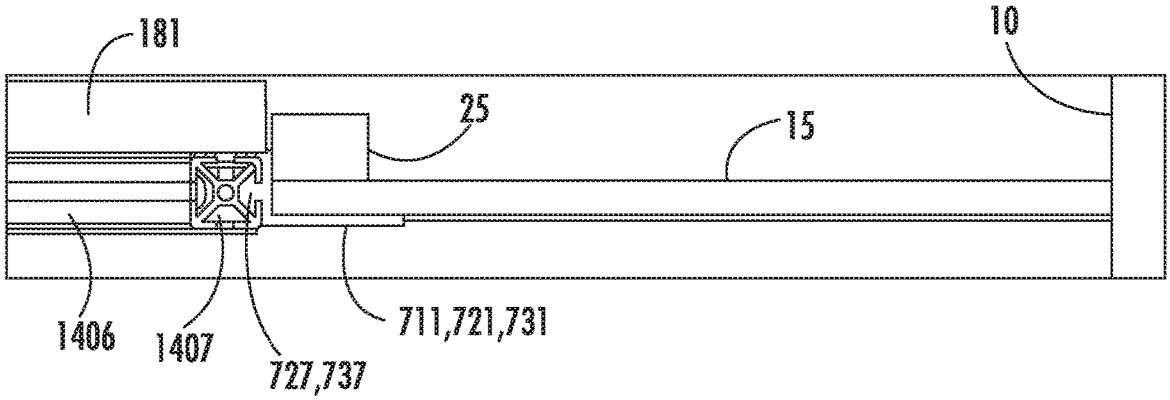
FIG. 21F is a top view of the wall seal assembly of FIG. 21A.

The seal members (711, 721, 731) may be attached to at least one seal panel 15 to extend between the containment system 100 and an adjacent object (e.g., a wall 10). In some embodiments, the seal panel 15 may be cut/modified to adapt to other objects, such as handrails or other obstructions. The seal panel 15 may attach to the flange inner surfaces (713, 723, etc.) of the seal members using fasteners 50. In some examples, the seal panel 15 is drywall such that the edges of the drywall is hidden behind the flanges of the seal members. Drywall panels would allow a user to cut the panel to a desired length and finish (i.e., joint compound, paint, etc.) the panels for sealing and/or aesthetic purposes. In some examples, the seal panel 15 may include other materials, such as polycarbonate, plastic, or composite. As shown in FIGS. 21E and 21F, the fastener(s) 50 pass through the seal panel 15 and into a furring strip 25 to secure the attachment between the seal members (711, 721, 731) and the seal panel 15.

Figure 22A:
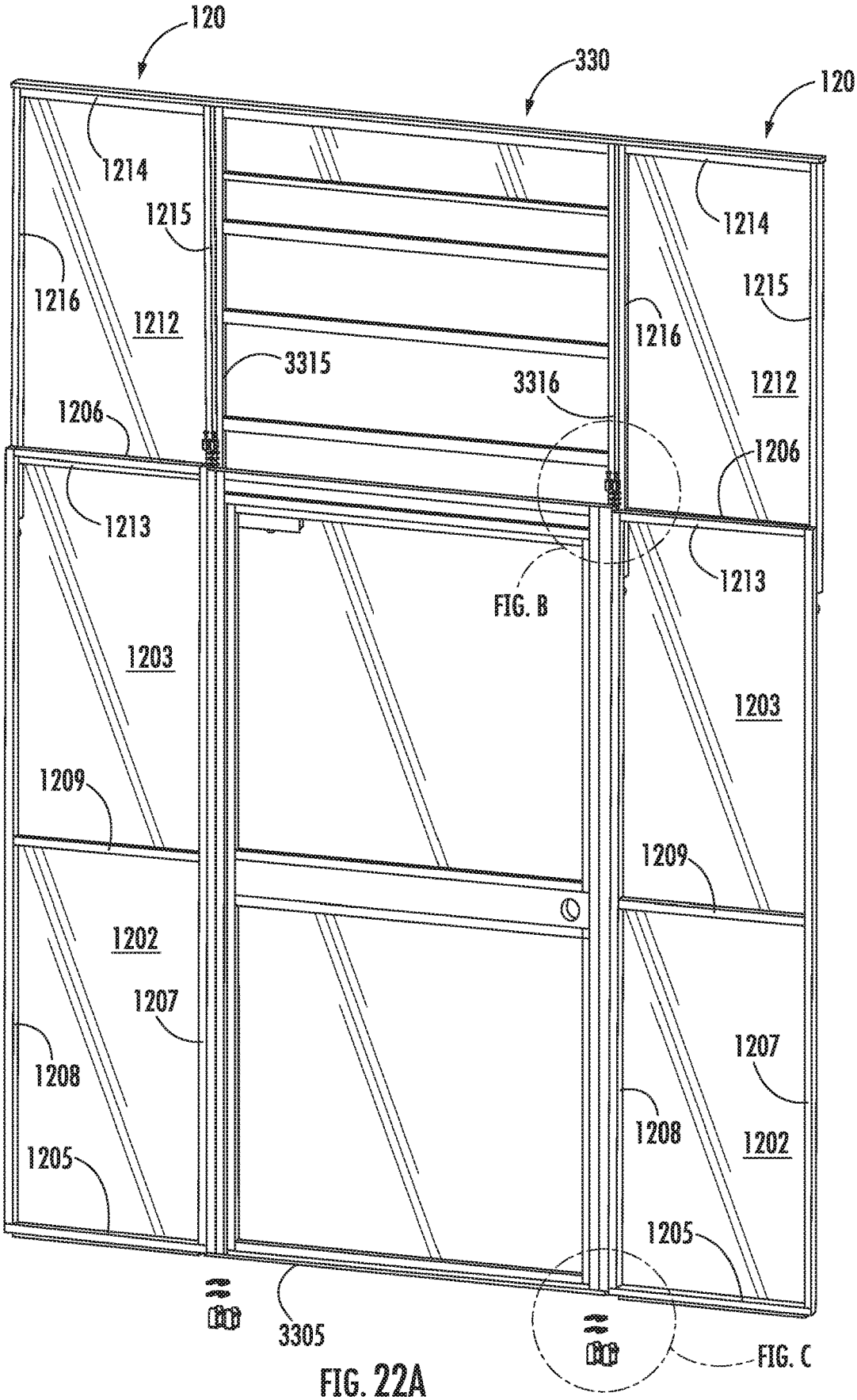
FIG. 22A is an exterior perspective view of the door assembly of FIG. 11A attached to two panel assemblies of FIG. 2B.
Figure 22B:
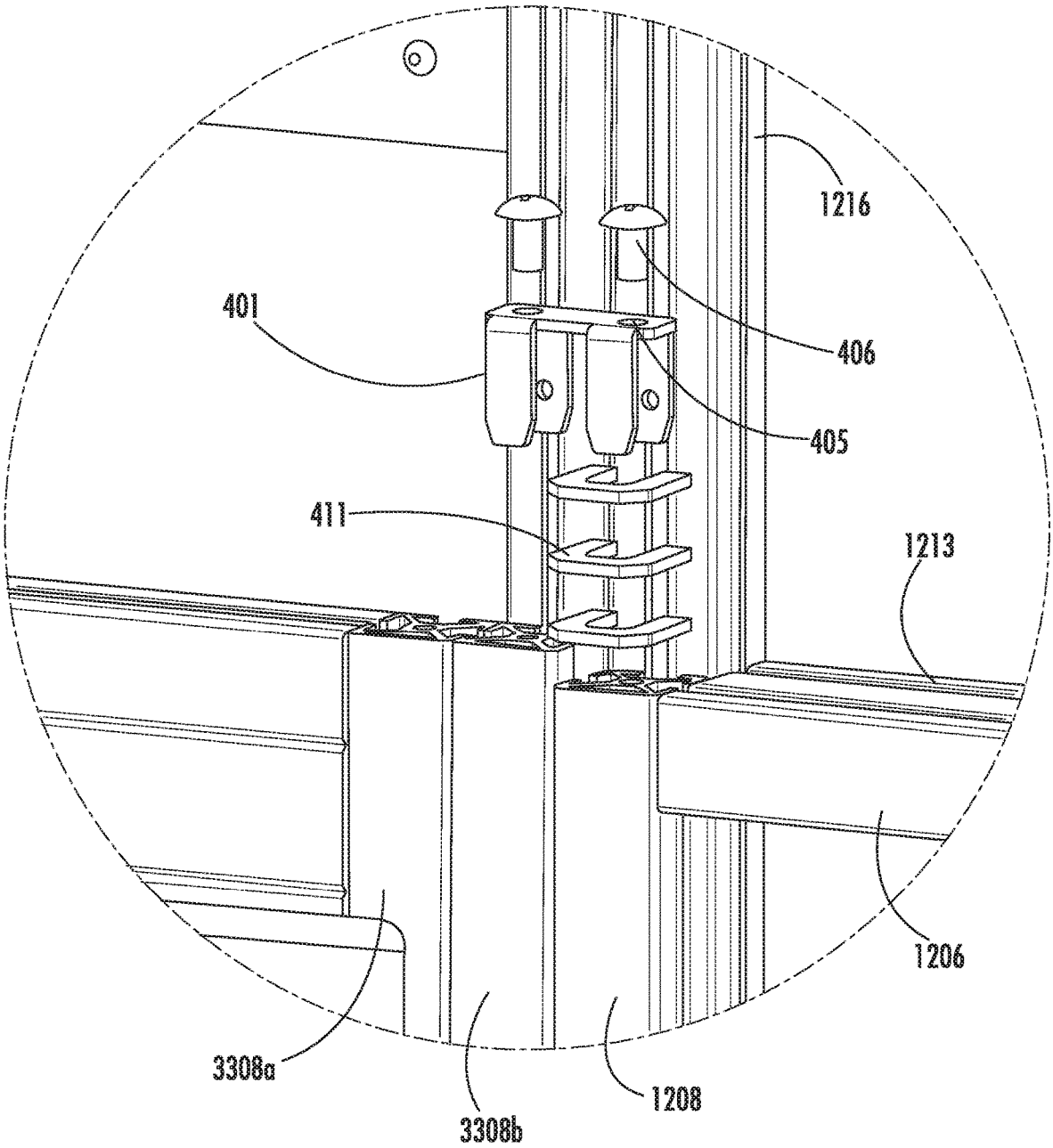
FIG. 22B is a detail exterior perspective view of the encircled area B of FIG. 22A.
Figure 22C:
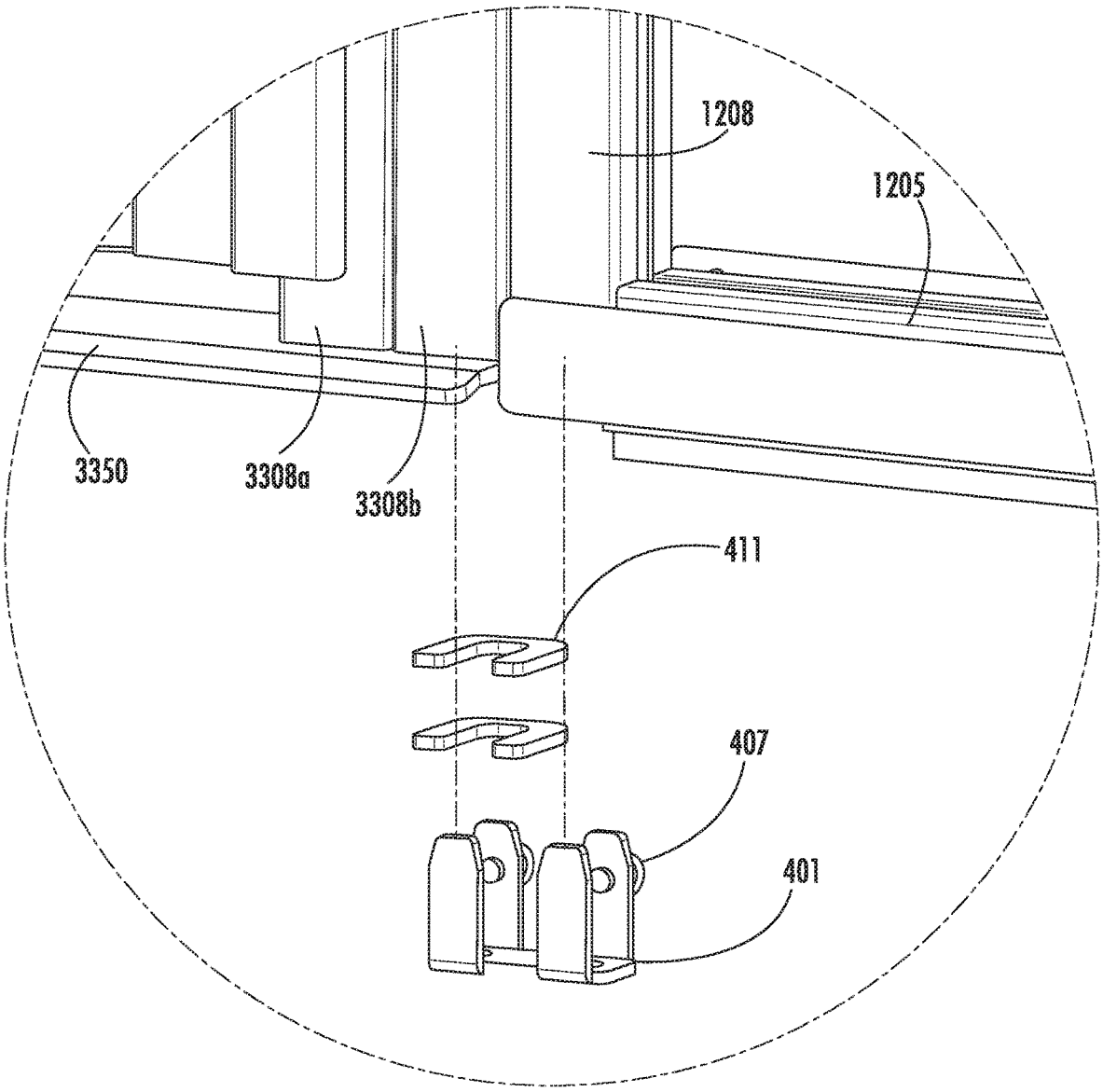
FIG. 22C is a detail exterior perspective view of the encircled area C of FIG. 22A.

FIGS. 22A-22C show one example of an installation of a door assembly 330 installation with a narrow panel assembly 120 on either side of the door assembly 330.

In some situations, it may be necessary to configure the containment system 100 to subdivide a containment area and/or create an anteroom. To address such needs, the containment system 100 may include at least one three-way corner or 'T' intersection between adjacent panels, where the third wall/panel may extend from an exterior surface of the containment system 100 (see FIGS. 23A-23G) or the third wall/panel may extend from an interior surface of the containment system 100 (see FIGS. 24A-24G). Although the various three-way corner assemblies are illustrated as interfacing with wide panel assemblies 140, the corner assemblies may interface with any component of the containment system 100 described herein including, for example, a small panel assembly 130, a narrow panel assembly 120, a medium panel assembly 110, a door assembly 330, or any other appropriate component. As shown in FIGS. 23A-23G, the containment system 100 may include an outside three-way corner assembly 340 where a third panel assembly 140' extends from an exterior surface of the containment system 100 (see schematic view in FIG. 23E).

Figure 23A:
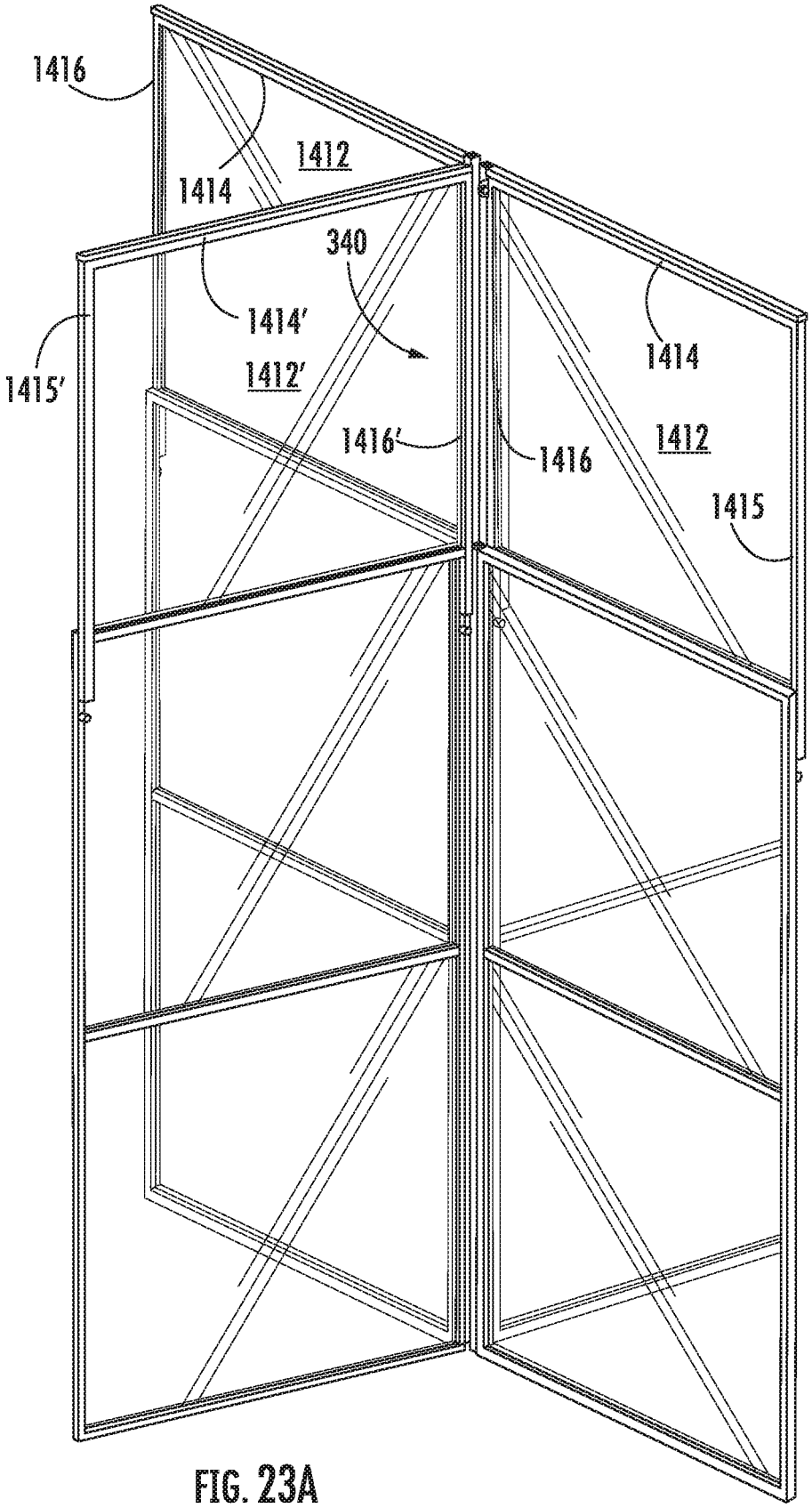
FIG. 23A is an exterior perspective view of an outside three-way corner assembly of the containment system depicted in FIG. 1.
Figure 23B:
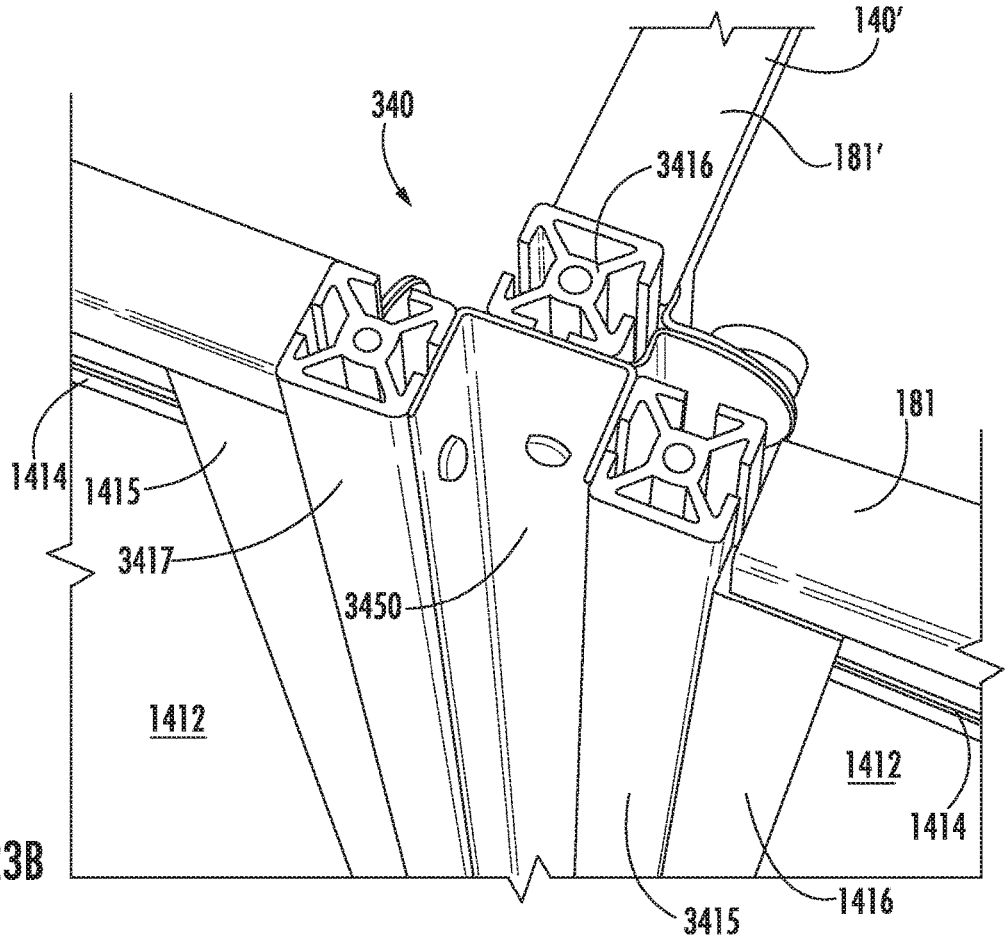
FIG. 23B is a perspective view of an upper portion of the outside three-way corner assembly of FIG. 23A.

FIG. 23B shows a perspective view of an upper portion of the outside three-way corner assembly 340 where the outside three-way corner assembly 340 includes upper components including upper vertical side member 3415, upper vertical side member 3417, third member 3416, and upper channel 3450. In some embodiments, these upper components are configured to interface with corresponding upper components of an adjacent panel (e.g., upper assembly 1411 of panel assembly 140). For example, upper vertical side member 3415 interfaces with a vertical side member 1416 of an adjacent panel and upper vertical side member 3417 interfaces with a vertical side member 1415 of an adjacent panel. The third member 3416 interfaces with third panel assembly 140' extending from an exterior surface of the containment system 100. In some embodiments, the upper channel 3450 has a 'C' cross section and attaches to a side of each of the upper vertical side member 3415, the upper vertical side member 3417, and the third member 3416 (see FIGS. 23B and 23C). In some embodiments, the upper channel 3450 may include at least one non-orthogonal angle (e.g., if the third panel assembly 140' is not perpendicular to the other panels).

Figure 23C:
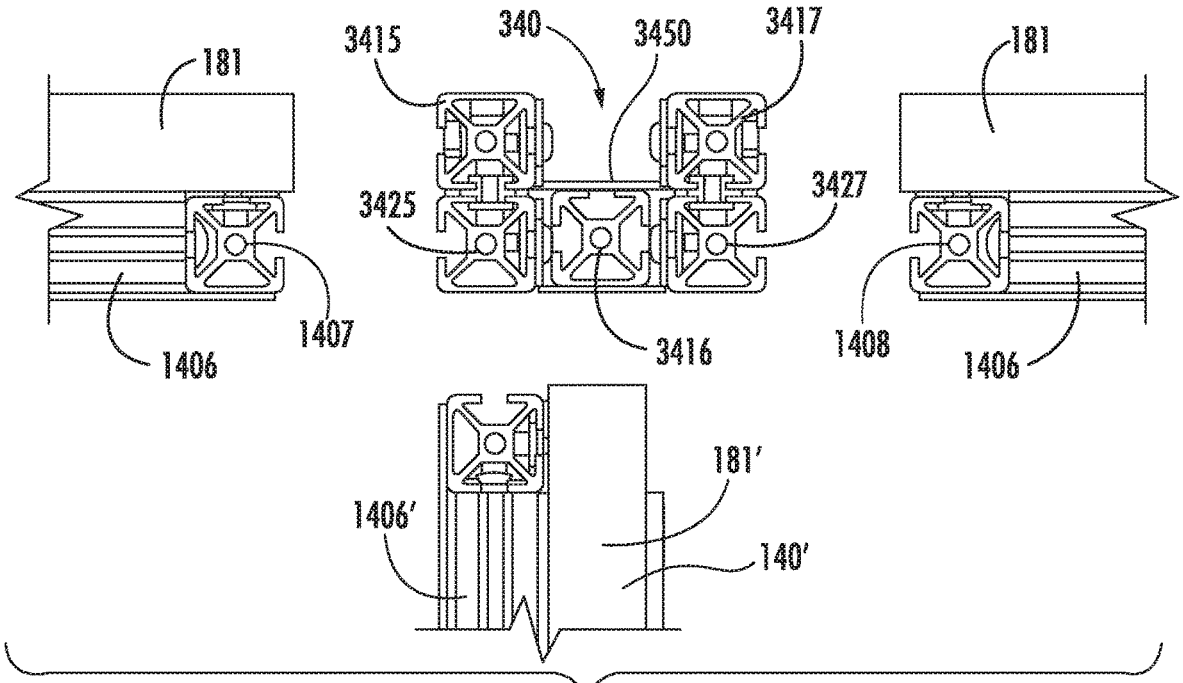
FIG. 23C is a top exploded view of the outside three-way corner assembly of FIG. 23A.
Figure 23D:
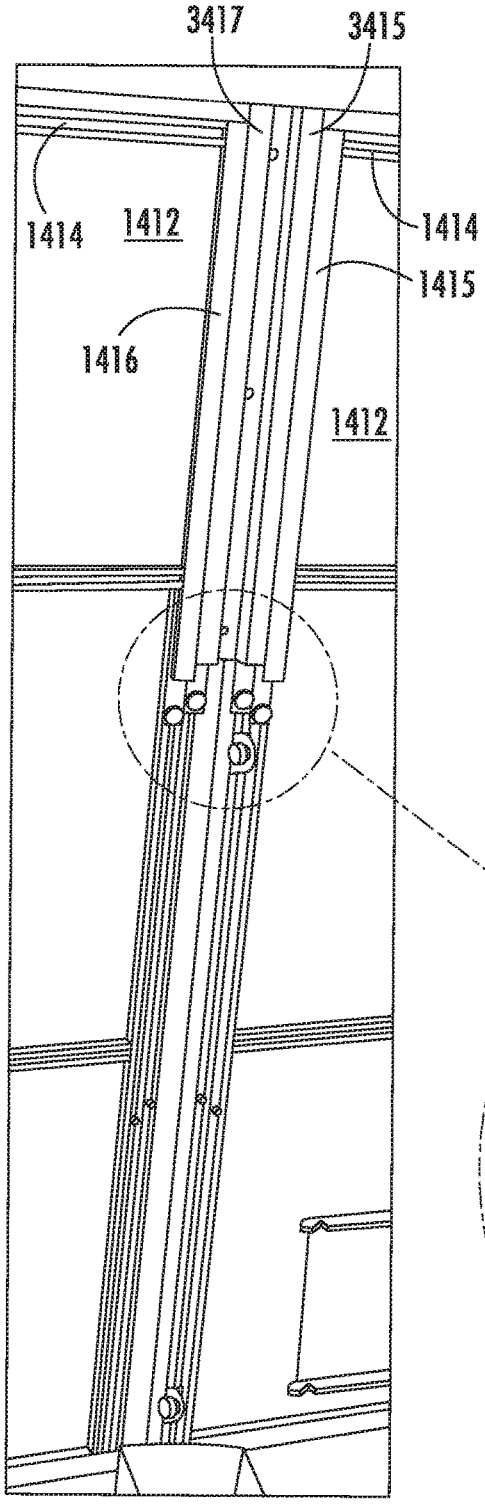
FIG. 23D is an interior perspective view of the outside three-way corner assembly of FIG. 23A.
Figure 23E:
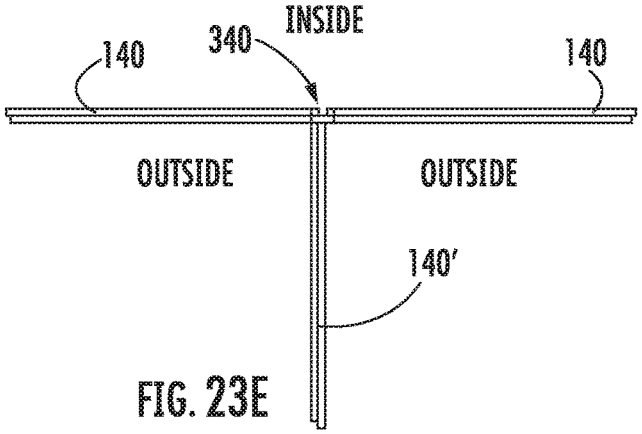
FIG. 23E is a top schematic view of the outside three-way corner assembly of FIG. 23A.
Figure 23F:
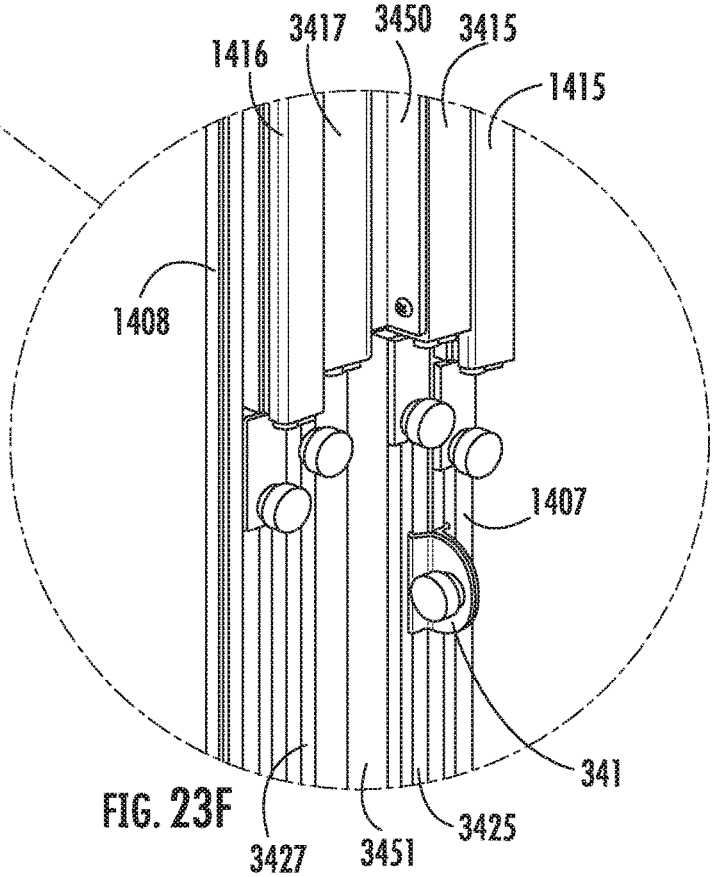
FIG. 23F is a detail interior perspective view of the encircled area F of FIG. 23D.
Figure 23G:
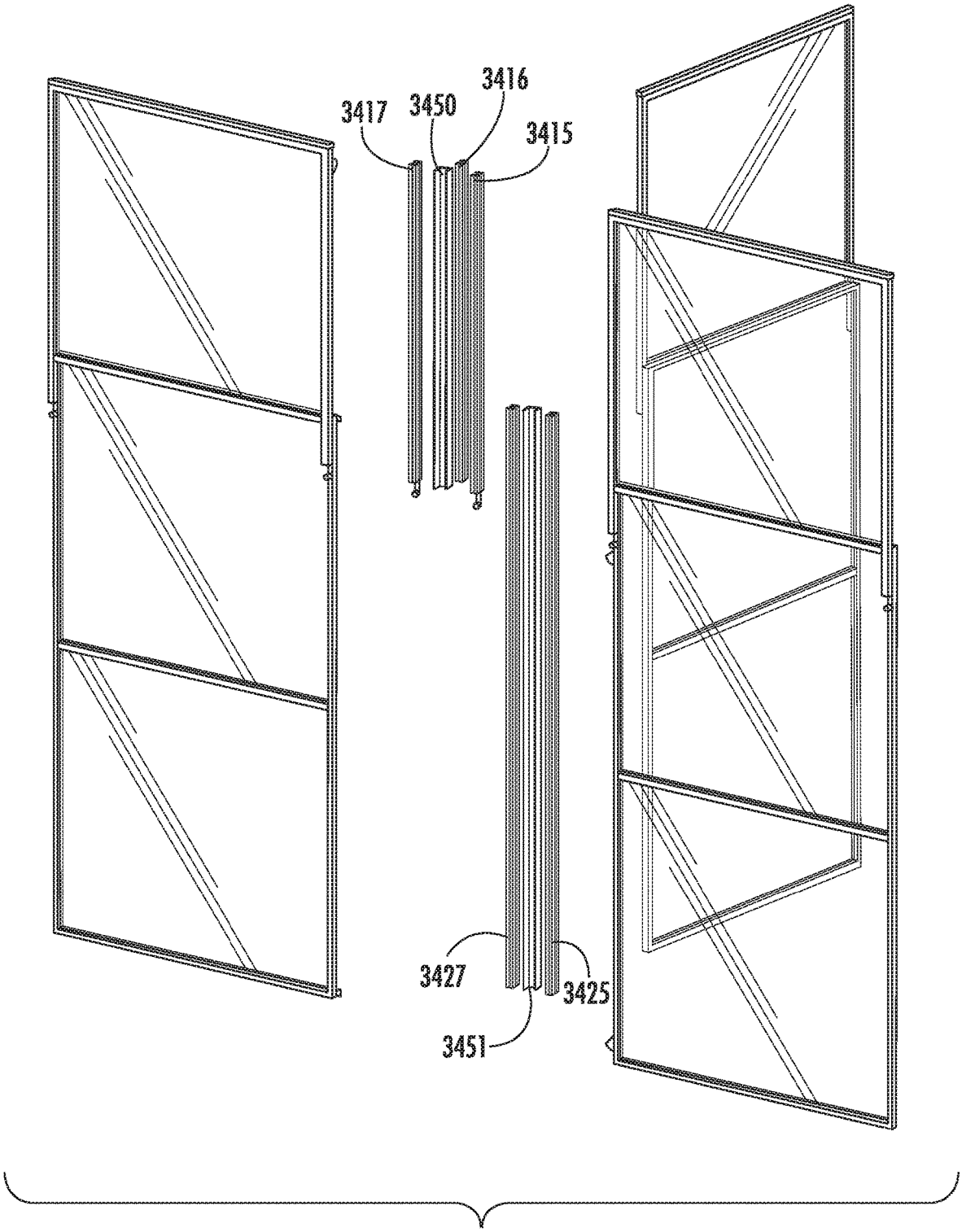
FIG. 23G is an internal exploded perspective view of the outside three-way corner assembly of FIG. 23A.

In addition, the outside three-way corner assembly 340 may include lower components including lower vertical side member 3425, lower vertical side member 3427, and lower channel 3451. In some embodiments, these lower components are configured to interface with corresponding lower components of an adjacent panel (e.g., lower assembly 1401 of panel assembly 140). As shown in FIGS. 23C, 23F, and 23G, in addition to interfacing with a vertical side member 1407 of an adjacent panel, the lower vertical side member 3425 interfaces with upper vertical side member 3415 to facilitate vertical adjustment such that the height of the outside three-way corner assembly 340 may be adapted for particular circumstances (similar to the other components and assemblies described above). As shown in FIGS. 23C, 23F, and 23G, in addition to interfacing with a vertical side member 1408 of an adjacent panel, the lower vertical side member 3427 interfaces with upper vertical side member 3417 to facilitate vertical adjustment such that the height of the outside three-way corner assembly 340 may be adapted for particular circumstances (similar to the other components and assemblies described above). The lower channel 3451 may also have a 'C' cross section and may attach to the lower vertical side member 3425 and the lower vertical side member 3427. In addition, the lower channel 3451 may interface with the upper channel 3450 to facilitate vertical adjustment of the outside three-way corner assembly 340.

Figure 25A:
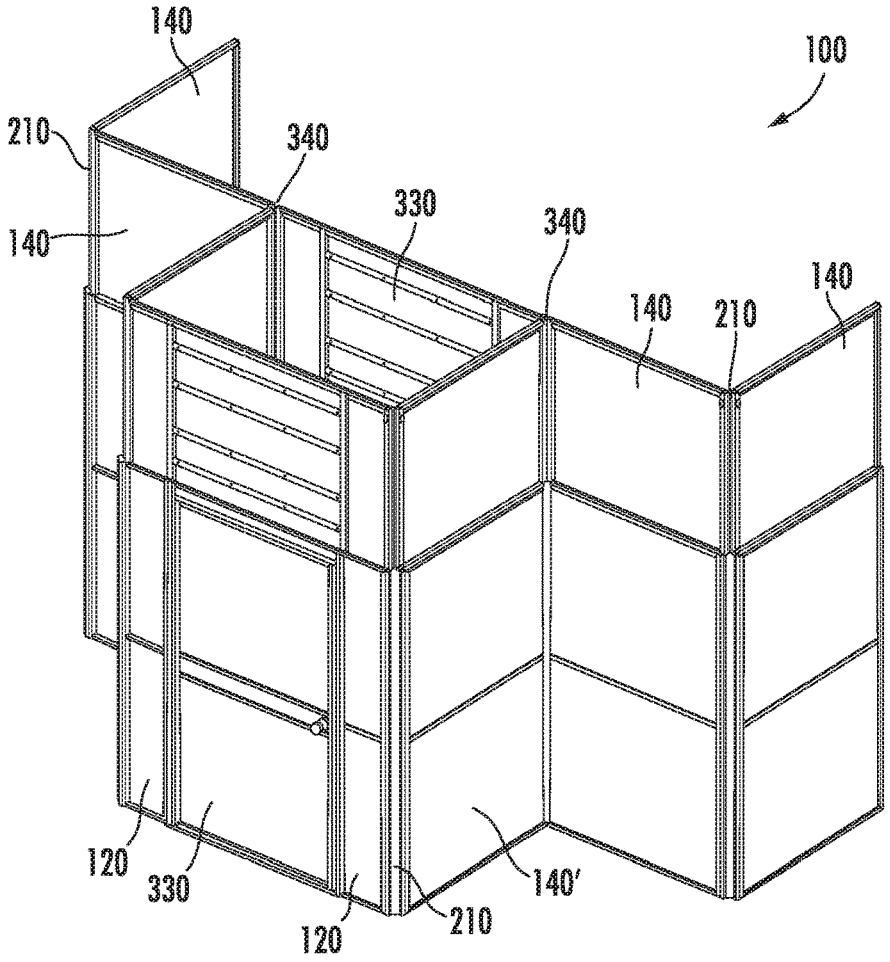
FIG. 25A is an exterior perspective view of a containment system incorporating the outside three-way corner assembly of FIG. 23A.
Figure 25B:
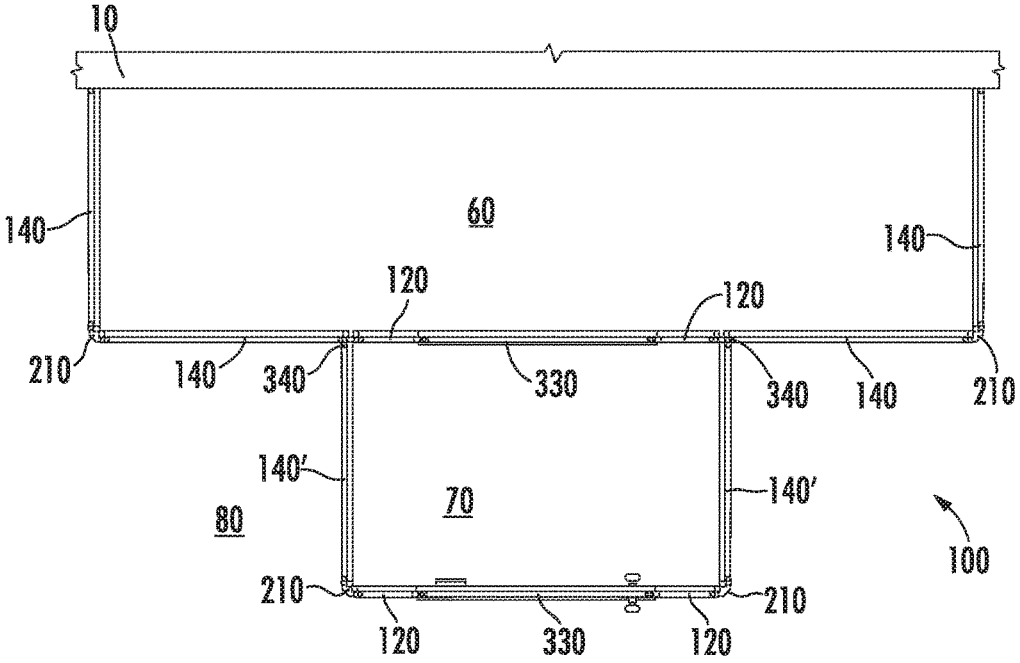
FIG. 25B is a top view of the containment system of FIG. 25A.

FIGS. 25A and 25B illustrate one example of a containment system 100 that includes two outside three-way corner assemblies 340 to create an anteroom 70 that is separated from both a containment area 60 and the external environment 80. Adjacent to the anteroom 70, there is a door assembly 330 to access the containment area 60 and a door assembly 330 separating the anteroom 70 from the external environment 80. As shown in FIG. 25B, the containment area 60 is bordered on one side by a wall 10. The anteroom 70 is bordered on two sides by panel assemblies 140' that each extend from respective outside three-way corner assembly 340.

Figure 24A:
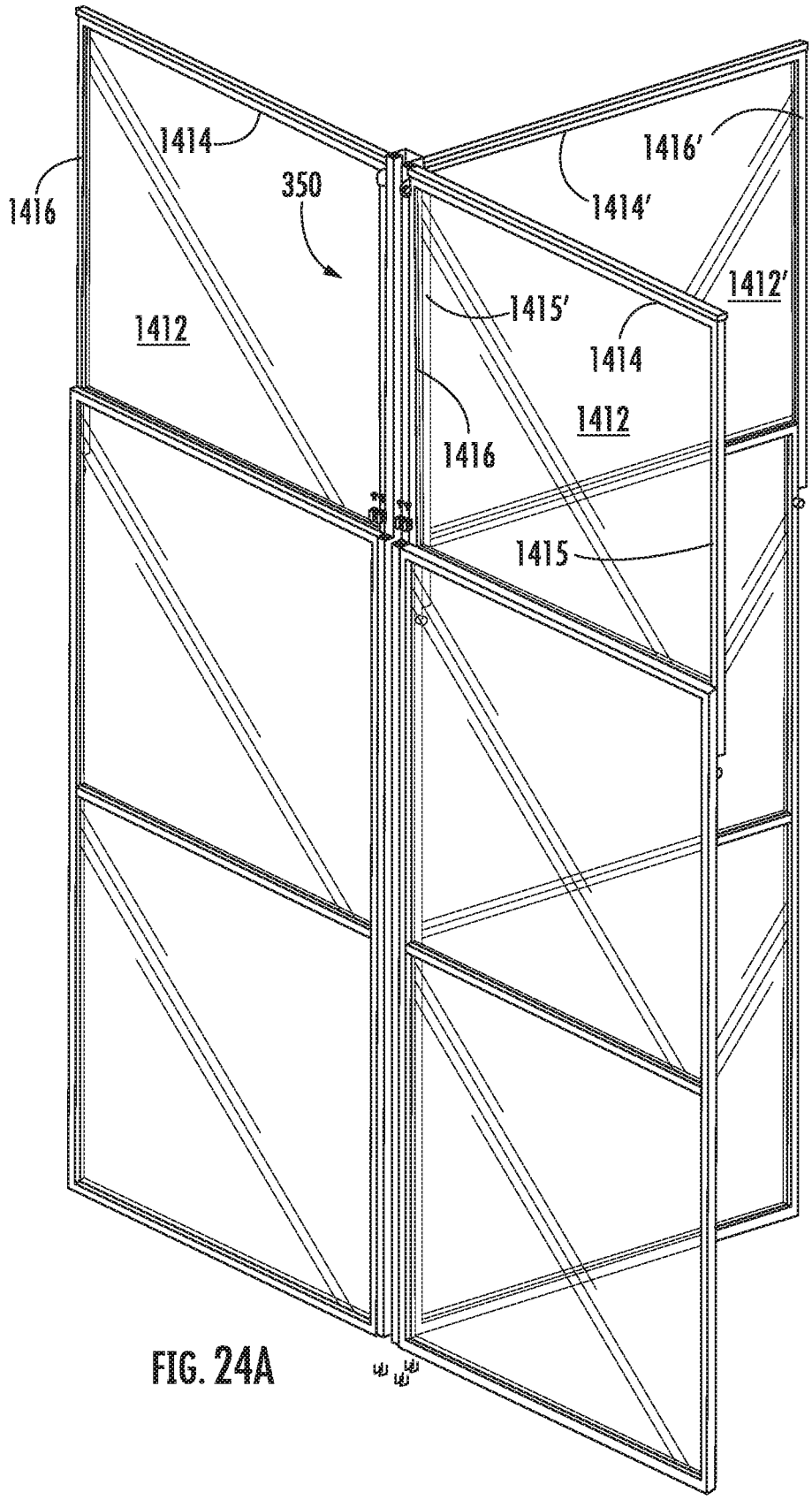
FIG. 24A is an exterior perspective view of an inside three-way corner assembly of the containment system depicted in FIG. 1.
Figure 24B:
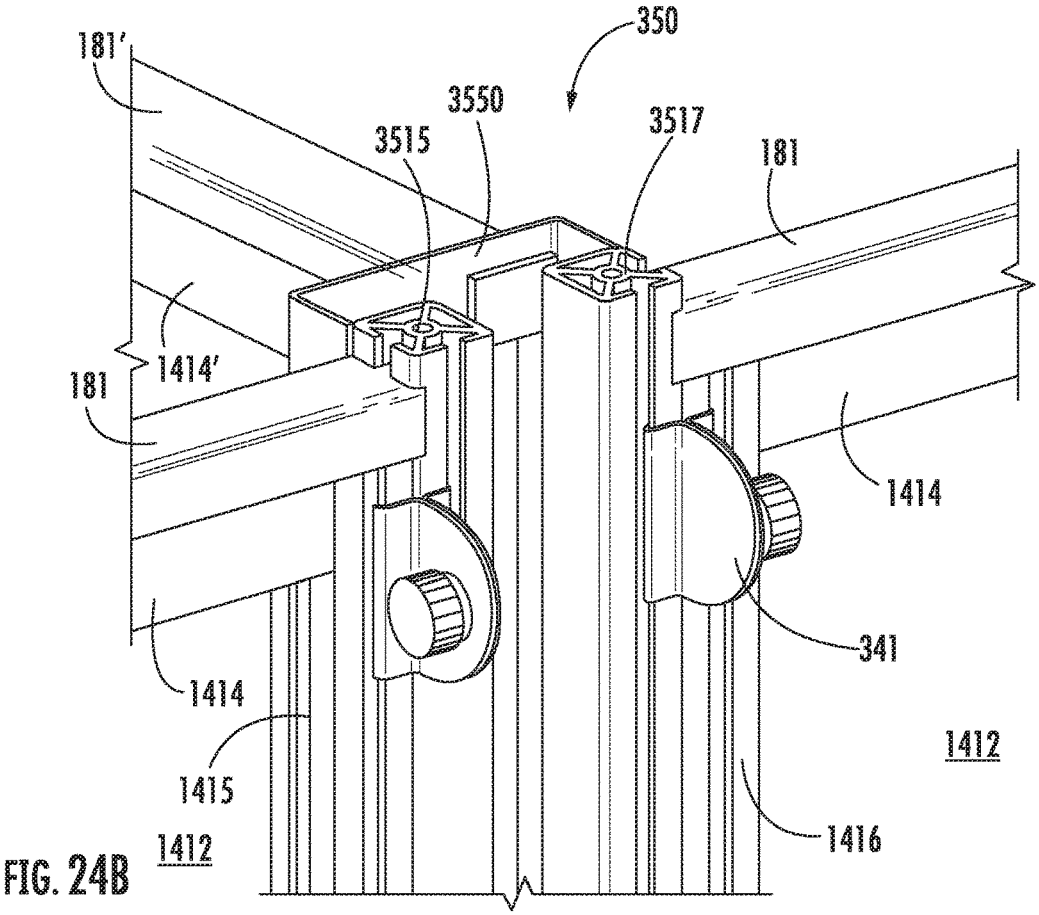
FIG. 24B is a perspective view of an upper portion of the inside three-way corner assembly of FIG. 24A.
Figure 24C:
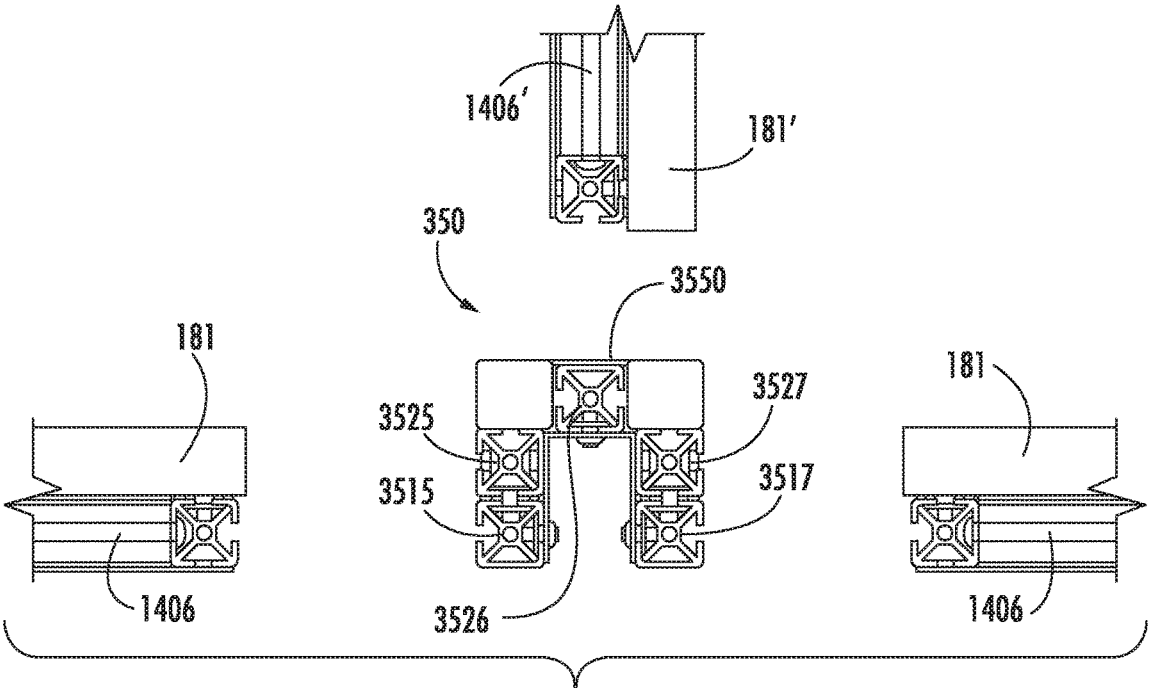
FIG. 24C is a top exploded view of the inside three-way corner assembly of FIG. 24A.
Figure 24D:
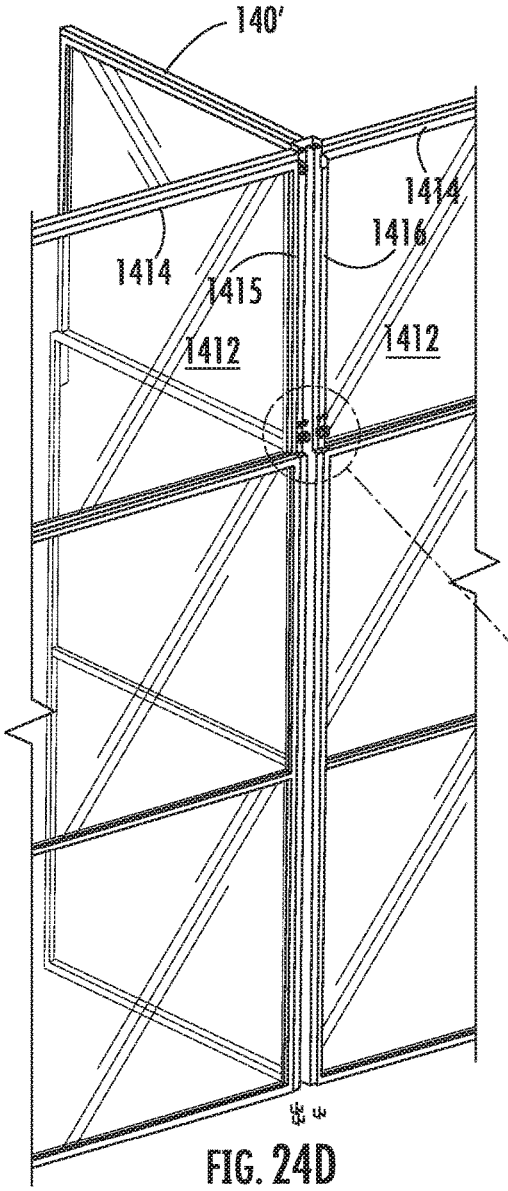
FIG. 24D is an exterior perspective view of the inside three-way corner assembly of FIG. 24A.
Figure 24E:
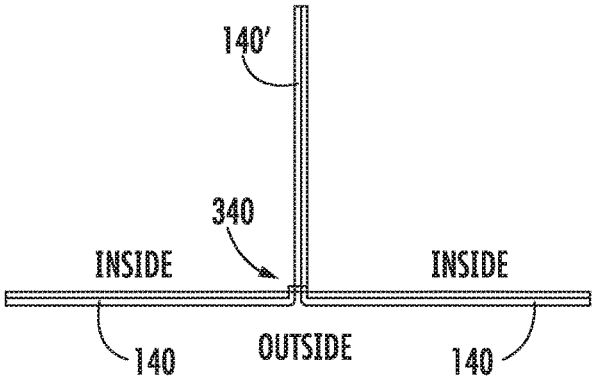
FIG. 24E is a top schematic view of the inside three-way corner assembly of FIG. 24A.

As shown in FIGS. 24A-24G, the containment system 100 may include an inside three-way corner assembly 350 where a third panel assembly 140' extends from an interior surface of the containment system 100 (see schematic view in FIG. 24E).

FIG. 24B shows a perspective view of an upper portion of the inside three-way corner assembly 350 where the inside three-way corner assembly 350 includes upper components including upper vertical side member 3515, upper vertical side member 3517, and upper channel 3550. In some embodiments, these upper components are configured to interface with corresponding upper components of an adjacent panel (e.g., upper assembly 1411 of panel assembly 140). For example, upper vertical side member 3515 interfaces with a vertical side member 1415 of an adjacent panel and upper vertical side member 3517 interfaces with a vertical side member 1416 of an adjacent panel. In some embodiments, the upper channel 3550 has a box channel (or a 'C' as shown for upper channel 3450) cross section and attaches to a side of each of the upper vertical side member 3515 and the upper vertical side member 3517 (see FIGS. 23B and 23C). In some embodiments, as shown in FIG. 24B, the upper channel 3450 may include return flanges such that the upper vertical side member 3515 and the upper vertical side member 3517 are attached to exterior surfaces thereof to increase the offset for the third panel assembly 140'.

Figure 24F:
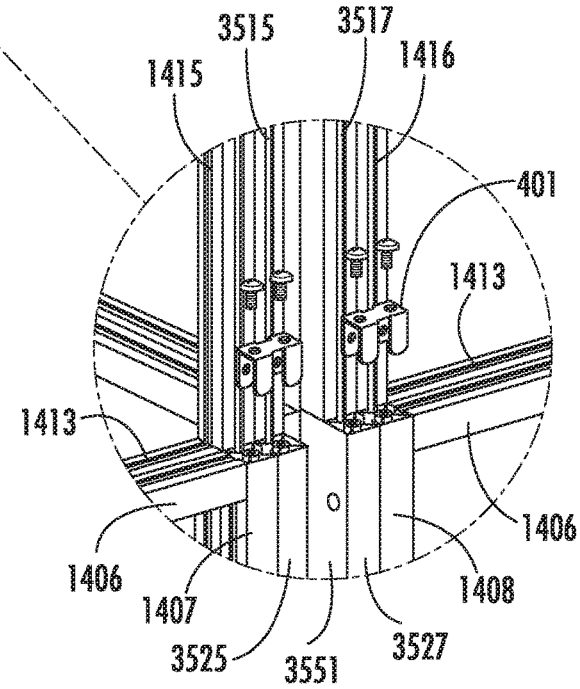
FIG. 24F is a detail exterior perspective view of the encircled area F of FIG. 24D.
Figure 24G:
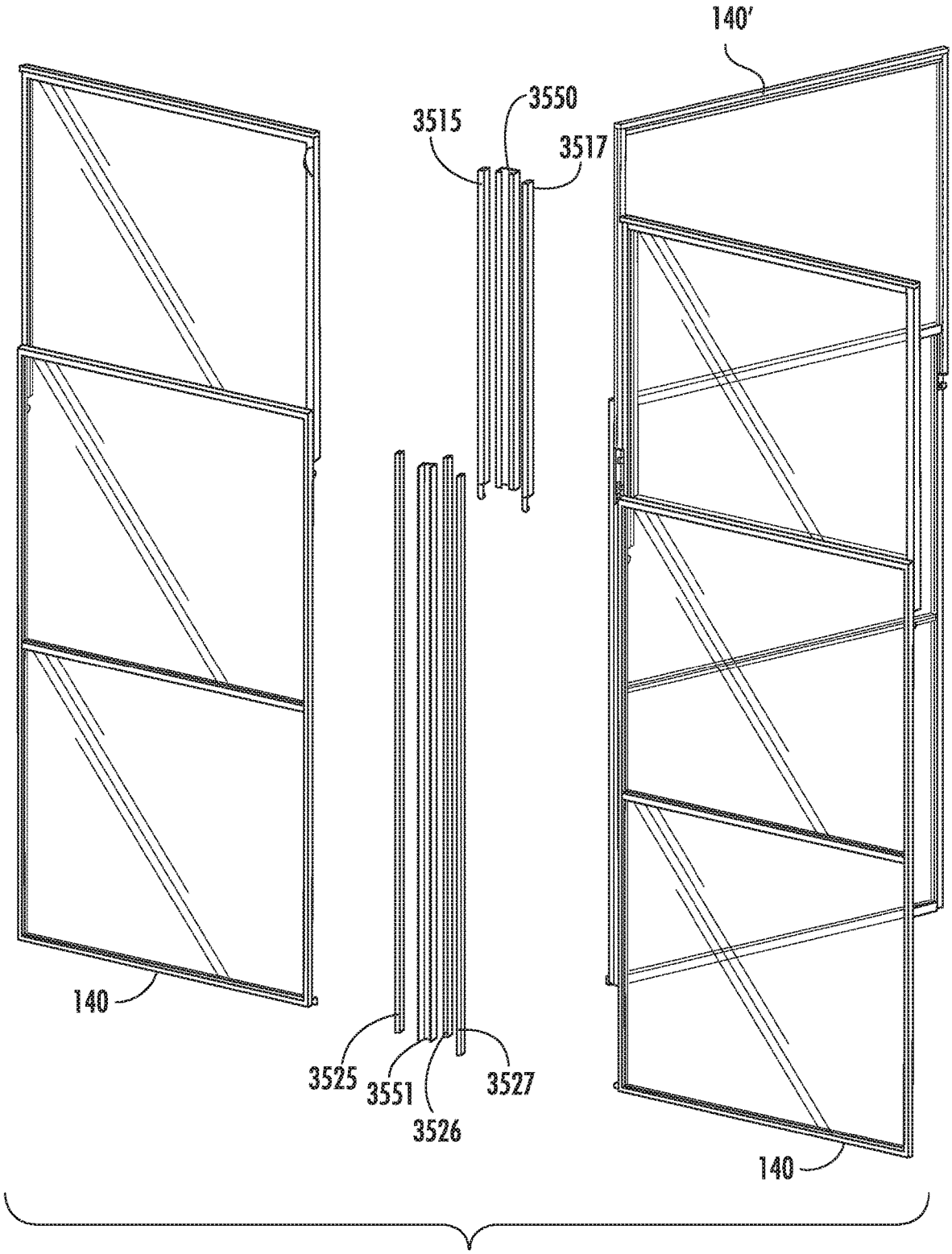
FIG. 24G is an external exploded perspective view of the inside three-way corner assembly of FIG. 24A.

In addition, the inside three-way corner assembly 350 may include lower components including lower vertical side member 3525, lower vertical side member 3527, third member 3526, and lower channel 3451. In some embodiments, these lower components are configured to interface with corresponding lower components of an adjacent panel (e.g., lower assembly 1401 of panel assembly 140). As shown in FIGS. 24F and 24G, in addition to interfacing with a vertical side member 1407 of an adjacent panel, the lower vertical side member 3525 interfaces with upper vertical side member 3515 to facilitate vertical adjustment such that the height of the inside three-way corner assembly 350 may be adapted for particular circumstances (similar to the other components and assemblies described above). As shown in FIGS. 24C and 24G, in addition to interfacing with a vertical side member 1408 of an adjacent panel, the lower vertical side member 3527 interfaces with upper vertical side member 3517 to facilitate vertical adjustment such that the height of the inside three-way corner assembly 350 may be adapted for particular circumstances (similar to the other components and assemblies described above). The lower channel 3551 may have a 'C' cross section and may attach to the lower vertical side member 3525, the lower vertical side member 3527, and the third member 3526. In addition, the lower channel 3551 may interface with the upper channel 3550 to facilitate vertical adjustment of the inside three-way corner assembly 350.

Figure 26A:
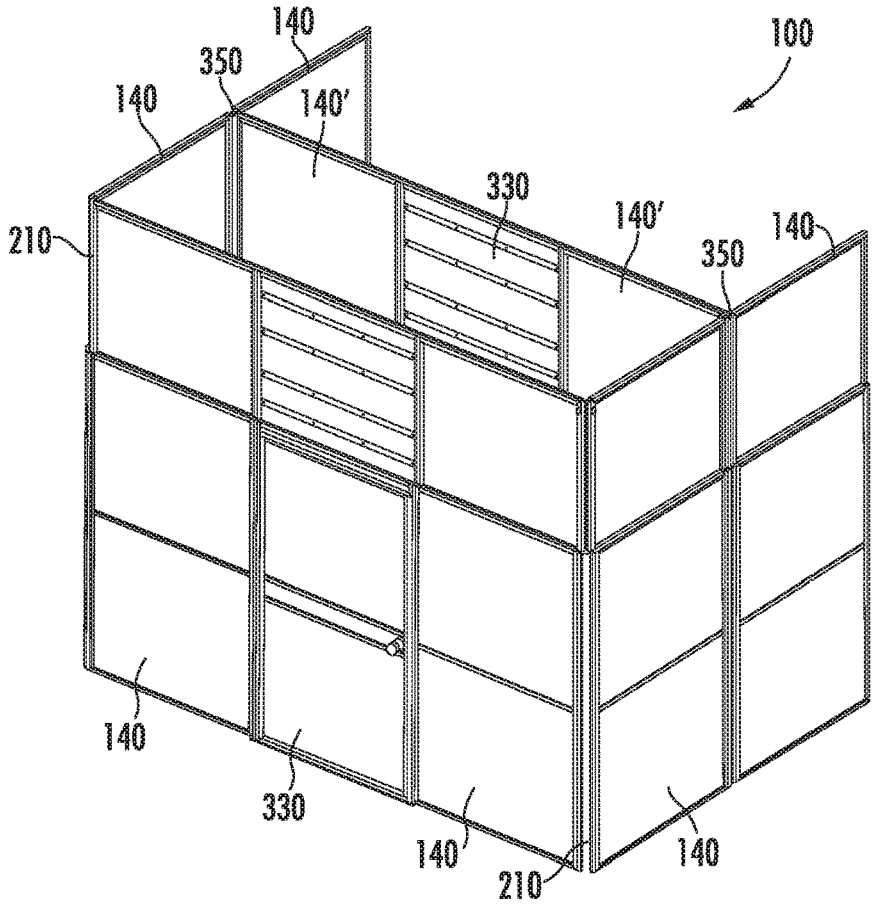
FIG. 26A is an exterior perspective view of a containment system incorporating the inside three-way corner assembly of FIG. 24A.
Figure 26B:
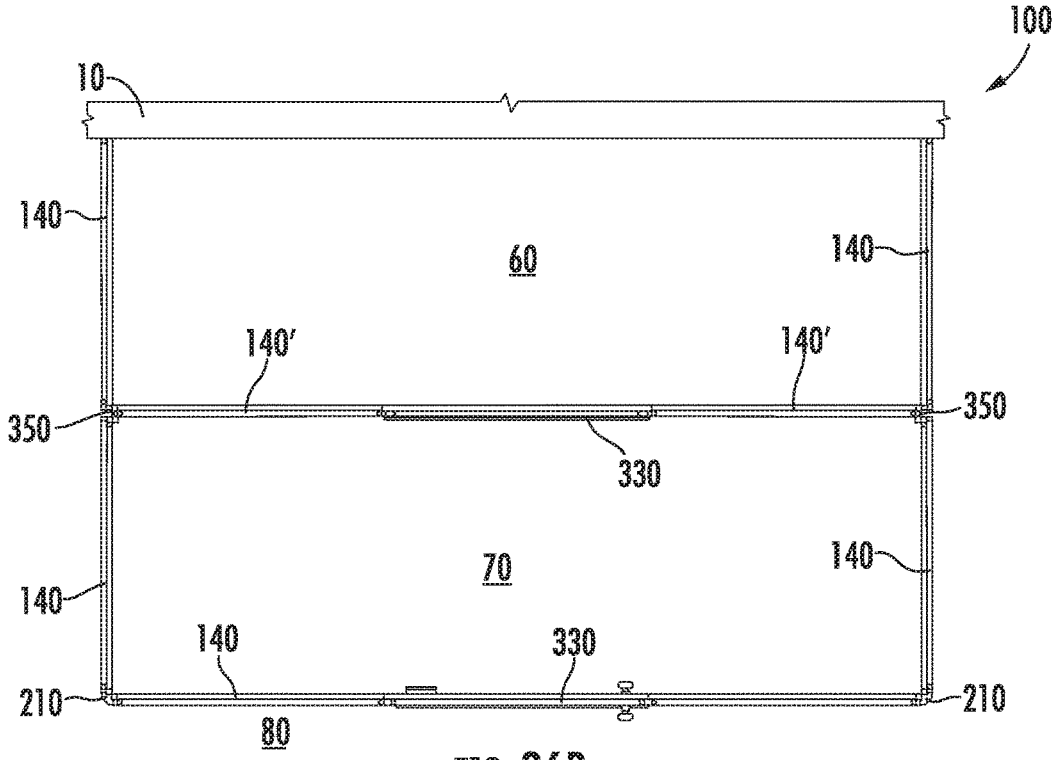
FIG. 26B is a top view of the containment system of FIG. 26A.

FIGS. 26A and 26B illustrate one example of a containment system 100 that includes two inside three-way corner assemblies 350 to create an anteroom 70 that is separated from both a containment area 60 and the external environment 80. Adjacent to the anteroom 70, there is a door assembly 330 to access the containment area 60 and a door assembly 330 separating the anteroom 70 from the external environment 80. As shown in FIG. 26B, the containment area 60 is bordered on one side by a wall 10. The anteroom 70 is bordered on one side by surface created by two panel assemblies 140' (that each extend from respective inside three-way corner assembly 350) and a door assembly 330.

In some examples, each module or component (i.e., panel assembly, corner assembly, door assembly, etc.) may include additional feature(s) related to thermal and/or acoustical insulation. In some examples, the features include gypsum wall board, at least one metallic layer on the interior and/or exterior side of the module, and/or any other necessary thermal insulation and/or acoustical insulation. For example, outer metallic layers may sandwich insulation (along with the structural components of the module) between the metallic layers. Such arrangements would allow the containment system 100 to meet fire rating standards and/or noise exposure standards. In some examples, the containment system 100 is configured to meet various standards provided in publications from organizations including the Canadian Standards Association (CSA) and/or the Centers of Disease Control and Prevention (CDC) such as, but not limited to, (1) CSA Z317.13—Infection Control during Construction, Renovation, and Maintenance of Health Care Facilities or (2) Guidelines for Environmental Infection Control in Health-Care Facilities: Recommendations of CDC and the Healthcare Infection Control Practices Advisory Committee (HICPAC).

Any of the components of the containment system 100 may be attached to one another via suitable fasteners, which include, but are not limited to, screws, bolts, rivets, 3M® Very High Bond (VHB) tape, other acrylic foam tapes, or other mechanical or chemical fasteners. In some examples, the components of the containment system 100 are assembled using seals/gaskets to minimize airflow thus reducing the transmission of hazardous airborne contaminants from the interior of the containment system 100 to the external environment.

In certain embodiments, a method of assembling a containment system comprises: locating at least one adjustable height panel assembly: adjusting a bottom cover of the at least one adjustable height panel assembly to conform to a ground surface; raising an upper assembly of the at least one adjustable height panel assembly relative to a lower assembly of the at least one adjustable height panel assembly such that an upper edge of the upper assembly is adjacent to a ceiling; engaging at least one adjustment mechanism to lock the upper assembly and the lower assembly relative to one another; and adjusting a sealing member that extends between the upper assembly and the lower assembly. Other methods of assembling and/or using a containment system using the components described herein is also disclosed.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A containment system for separating a containment area from an external environment, the containment system comprising:

a lower assembly;

an upper assembly slideably attached to the lower assembly, wherein the containment system is movable between:

a locked configuration where the upper assembly and the lower assembly are constrained from movement relative to one another in a vertical direction; and an unlocked configuration where the upper assembly and the lower assembly are movable relative to one another in the vertical direction to adjust a height of the containment system; and wherein:

the containment system seals the containment area from the external environment regardless of whether the containment system is in the unlocked configuration or in the locked configuration, wherein the lower assembly and the upper assembly together form an assembly panel, wherein the containment system includes a plurality of assembly panels, and wherein the plurality of assembly panels includes a wall assembly, a corner assembly, a window assembly, or a door assembly, and wherein each of the plurality of assembly panels comprises a plurality of components constructed from a strut, wherein the strut comprises a generally square cross-section with one side having a continuous surface and three sides with channels therein.

2. The containment system of claim 1, further comprising an adjustment mechanism that moves the containment system between the unlocked configuration and the locked configuration, wherein the adjustment mechanism is located on an interior side of the containment system such that the adjustment mechanism is in the containment area and unexposed to the external environment.

3. The containment system of claim 1, further comprising a sealing member that extends between the upper assembly and the lower assembly to seal the containment area from the external environment, wherein the sealing member extends perpendicular to an exterior face of the containment system, wherein the exterior face is in the external environment.

4. The containment system of claim 3, wherein the sealing member comprises at least one of polycarbonate, plastic, composite, rubber, or a polymer.

5. A containment system for separating a containment area from an external environment, the containment system comprising:

a plurality of adjustable height assembly panels attached to one another in a side-by-side arrangement to form a continuous wall that serves as a barrier between the containment area and the external environment, wherein each of the adjustable height assembly panels comprises a lower assembly and an upper assembly slideably attached to the lower assembly, wherein each of the adjustable height assembly panels is movable between:

a locked configuration where the upper assembly and the lower assembly are constrained from movement relative to one another in a vertical direction; and an unlocked configuration where the upper assembly and the lower assembly are movable relative to one another in the vertical direction to adjust a height of the adjustable height assembly panel; and wherein the containment system seals the containment area from the external environment regardless of whether the plurality of adjustable height assembly panels are in the unlocked configuration or in the locked configuration, wherein each of the plurality of adjustable height assembly panels comprises an adjustment mechanism that moves the adjustable height assembly panel between the unlocked configuration and the locked configuration, wherein each of the adjustment mechanisms is located on an interior side of the containment system such that the adjustment mechanisms are in the containment area.

6. The containment system of claim 5, wherein the plurality of adjustable height assembly panels includes at least one door assembly comprising a door and at least one window assembly comprising a window.

7. The containment system of claim 5, wherein the plurality of adjustable height assembly panels includes at least one wall assembly and at least one door assembly comprising a door.

8. The containment system of claim 5, wherein the plurality of adjustable height assembly panels includes at least one corner assembly that positions two other panels of the plurality of adjustable height assembly panels at a desired angle relative to one another.

9. The containment system of claim 5, wherein the adjustment mechanisms are unexposed to the external environment.

10. The containment system of claim 5, wherein each of the plurality of adjustable height assembly panels comprises a sealing member that extends between the upper assembly and the lower assembly and seals the containment area from the external environment, wherein each of the sealing members extends perpendicular to an exterior face of the containment system, wherein the exterior face is in the external environment.

11. The containment system of claim 10, wherein each sealing member comprises at least one of polycarbonate, plastic, composite, rubber, or a polymer.

12. The containment system of claim 5, wherein each of the plurality of adjustable height assembly panels comprises a plurality of components constructed from a strut, wherein the strut comprises a generally square cross-section with one side having a continuous surface and three sides with channels therein.

13. A method of assembling a containment system for separating a containment area from an external environment, the method comprising:

providing at least one adjustable height panel assembly, the at least one adjustable height assembly panel comprising a lower assembly and an upper assembly slideably attached to the lower assembly;

raising the upper assembly of the at least one adjustable height panel assembly relative to the lower assembly of the at least one adjustable height panel assembly such that an upper edge of the upper assembly is adjacent to a ceiling; and engaging at least one adjustment mechanism to lock the upper assembly and the lower assembly relative to one another, wherein the containment system seals the containment area from the external environment while the upper assembly is being raised relative to the lower assembly; and wherein the containment system also seals the containment area from the external environment when the upper assembly and the lower assembly are locked relative to one another, wherein the method further comprises adjusting a bottom cover of the at least one adjustable height panel assembly to conform to a ground surface.

14. The method of claim 13, wherein the at least one adjustable height panel assembly comprises a plurality of adjustable height assembly panels, and the method further comprises attaching the plurality of adjustable height assembly panels to one another in a side-by-side configuration to form a continuous wall that serves as a barrier between the containment area and the external environment.

15. The method of claim 14, wherein the plurality of adjustable height assembly panels includes at least one wall assembly and at least one door assembly comprising a door.

16. The method of claim 14, wherein the plurality of adjustable height assembly panels includes at least one corner assembly and the method further comprises positioning the at least one corner assembly between two other panels of the plurality of adjustable height assembly panels at a desired angle relative to one another.

17. A containment system for separating a containment area from an external environment, the containment system comprising:

a plurality of adjustable height assembly panels attached to one another in a side-by-side arrangement to form a continuous wall that serves as a barrier between the containment area and the external environment, wherein each of the adjustable height assembly panels comprises a lower assembly and an upper assembly slideably attached to the lower assembly, wherein each of the adjustable height assembly panels is movable between:

a locked configuration where the upper assembly and the lower assembly are constrained from movement relative to one another in a vertical direction; and an unlocked configuration where the upper assembly and the lower assembly are movable relative to one another in the vertical direction to adjust a height of the adjustable height assembly panel; and wherein the containment system seals the containment area from the external environment regardless of whether the plurality of adjustable height assembly panels are in the unlocked configuration or in the locked configuration, wherein each of the plurality of adjustable height assembly panels comprises a plurality of components constructed from a strut, wherein the strut comprises a generally square cross-section with one side haying a continuous surface and three sides with channels therein.

* * * * *